US008246446B2

(12) United States Patent
Wollner

(10) Patent No.: US 8,246,446 B2
(45) Date of Patent: Aug. 21, 2012

(54) METHOD FOR MAPPING POSSIBLE OUTCOMES OF A RANDOM EVENT TO CONCURRENT DISSIMILAR WAGERING GAMES OF CHANCE

(76) Inventor: Martin Wollner, Livonia, MI (US)

( * ) Notice: Subject to any disclaimer, the term of this patent is extended or adjusted under 35 U.S.C. 154(b) by 399 days.

(21) Appl. No.: 12/465,240

(22) Filed: May 13, 2009

(65) Prior Publication Data

US 2010/0019447 A1 Jan. 28, 2010

Related U.S. Application Data

(60) Provisional application No. 61/082,536, filed on Jul. 22, 2008.

(51) Int. Cl.
*A63F 9/00* (2006.01)

(52) U.S. Cl. ..... 463/22; 463/16; 463/17; 273/138.2; 273/274; 273/292

(58) Field of Classification Search ..... 463/22, 463/16, 17, 20; 273/138.2, 274, 292, 143 R
See application file for complete search history.

(56) References Cited

U.S. PATENT DOCUMENTS 4,334,685 A 6/1982 Robbins et al.
4,743,025 A 5/1988 Gramera
5,413,351 A 5/1995 Franklin
5,707,286 A 1/1998 Carlson
5,806,847 A 9/1998 White et al.
6,209,874 B1 4/2001 Jones
6,272,223 B1 8/2001 Carlson
6,273,423 B1 8/2001 Promutico
6,378,869 B1 4/2002 Hedge, Jr. et al.
6,537,150 B1 3/2003 Luciano et al.
6,601,848 B1 8/2003 Timmons, Sr.
6,893,019 B2 5/2005 Gaygen
6,923,719 B2 8/2005 Wolf
6,986,055 B2 1/2006 Carlson
7,152,863 B2 12/2006 Scheb, Jr. et al.
RE39,770 E 8/2007 Promutico
7,367,562 B2 5/2008 Scheb, Jr. et al.
7,399,227 B2 7/2008 Michaelson et al.
2006/0014583 A1 1/2006 Harris et al.
2007/0184888 A1 8/2007 Asher et al.
2007/0187889 A1 * 8/2007 Asher et al. ..... 273/146
2009/0258693 A1 * 10/2009 Preston et al. ..... 463/20

* cited by examiner

*Primary Examiner* — Benjamin Layno
(74) *Attorney, Agent, or Firm* — Endurance Law Group PLC

(57) ABSTRACT

The subject invention comprises a method and apparatus for which, from a single random event such as a spin of a roulette wheel or a roll of dice, a casino provides many concurrent games of chance. By mapping sets of randomization results (such as the results from rolling dice) to multiple sets of randomization ranges, a casino may run a number of disparate games concurrently from one randomly generated event. Players of the various games enjoy the common experience of all playing together against the same randomization events.

20 Claims, 19 Drawing Sheets

METHOD FOR MAPPING POSSIBLE OUTCOMES OF A RANDOM EVENT TO CONCURRENT DISSIMILAR WAGERING GAMES OF CHANCE

CROSS REFERENCE TO RELATED APPLICATIONS

This application claims priority to Provisional Patent Application No. 61/082,536 filed Jul. 22, 2008, the entire disclosure of which is hereby incorporated by reference and relied upon.

BACKGROUND OF THE INVENTION

1. Field of the Invention

The invention relates to wagering games, such as those typically played in a casino or online, and more specifically to wagering games played by placing bets on an outcome derived from a random event.

2. Related Art

Wagering on outcomes derived from a random event has been and remains a common source of entertainment. In fact, the development of gambling techniques led to the beginning of modern statistics. See, for example, Galilei's work, *Sopra le Scoperte dei Dadi* (1620), which was first published in 1718. A number of casino table games, such as craps, roulette, and keno are based on the placing of bets or wagers on randomized events. Similarly, a number of electronic casino games are based on placing bets on randomized events.

In general, game players wager on a variety of randomized outcomes. Outcomes that have a lesser probability of occurring usually have a higher payout-to-wager ratio than outcomes that have a greater probability of occurring. A number of wagering games are complex in that the games provide for a great number of wagers. For example, craps and roulette have a great number of wager options. For many gamblers, having more betting options increases the entertainment value of a wagering game. However, by increasing wager options, the game may become too complex for a novice gambler that prefers simpler wagering games. For example, in a coin-toss game there are only two outcomes to wager on, heads or tails, and both outcomes have the same probability of occurring. Such a game may be enjoyable for a novice or a gambler that is in the mood for a simpler game. Some games provide both complex and simple wagers. For example, in roulette, a player may place a simple bet on red or black. On the other hand, a player may place a more complex wager by betting on several numbers on a roulette board. The complex and simple options for wagering in roulette derive from the various events that may occur from spinning a roulette wheel.

Another apparatus well-suited for generating random events to wager on is a die or dice. The most commonly used die for wagering is the six-sided die like that showing all six sides in two dimension, i.e., unfolded, in FIG. 1. For example, a player can roll a die and wager on one of six outcomes. Another game that could come out of rolling one die is wagering on odd or even results, in other words, wagering on two possible outcomes of a single die roll. Another game that could come out of rolling one die is wagering on a roll of one or two (low roll), three or four (middle roll), or five or six (high roll), in other words, wagering on three possible outcomes of a single die roll. From one roll of a die, a casino could thus provide three concurrent games; one based upon randomizations in a range of 1 to 6, one based upon randomizations in the range of 1 to 2, and the last based upon randomizations in the range of 1 to 3.

A number of wagering games use more than one die. By increasing the number of dice, the possible outcomes in a roll of the dice increase. For example, when rolling one die there are six possible outcomes and rolling two dice there are thirty-six possible outcomes. However, for all 36 possibilities to be determined, the dice used must be distinguished from each other, for example, by using one red die and one blue die. If the roll is, say, a 1 on the red die and a 2 on the blue die, this can be distinguished from a 1 on the blue die and a 2 on the red die.

If the dice used are indistinguishable from each other, and if both dice are thrown at the same time, there is no way to distinguish between these example rolls. Thus, using indistinguishable dice, from the thirty-six possible outcomes, there are twenty-one distinct outcomes. (A list of such outcomes is shown below in Table 8.) So the roll of two indistinguishable dice provides a randomization of elements in a set of 21 identifiers. In addition, the value of each die can be summed together, resulting in another randomization value ranging from 2 to 12. The basis of craps, the most popular casino dice game in the world, is wagering on these twenty-one distinct outcomes and on the 11 sums resulting from the rolling of two indistinguishable dice. For many people, craps is a complex game; however, a two dice roll can also be suited for simpler games. For example, one could bet on low (2-6) or high (8-12) outcomes of a two dice roll.

When rolling three distinguishable dice, 216 possible rolls result. If the dice are non-distinguishable, 56 distinct rolls result, and the sums range from 3 to 18. The basis of popular casino games, including Ricochet, is wagering on one of the 56 distinct outcomes and on the 16 sums resulting. (A list of such outcomes is shown in Table 10.)

People have created many games using three six-sided dice. For example, a dice game described in U.S. Pat. No. 5,879,006 (Bowling) makes use of three indistinguishable dice, all rolled at the same time. Furthermore, people have created games employing three six-sided dice in which there are various physical or procedural differences, providing ways to distinguish the dice from one another, creating more than the 56 distinct results. Sic Bo is a 3-dice game, but actually uses two indistinguishable dice and one die colored differently from the other 2. So, Sic Bo is not based upon 56 distinct rolls, it is based upon 126 distinct rolls. In U.S. Pat. No. 6,209,874 (Jones), the game disclosed uses three dice, each having a different color, providing 216 possible outcomes. U.S. Pat. No. 6,893,019 (Gaygen) provides a three dice roll outcome, as well as a two dice roll outcome, and a one die roll outcome, all in the same roll. This game and many others like it boast the capability of providing multiple outcome ranges from a given roll.

Similarly, in U.S. Pat. No. 6,378,869 (Hedge and Hedge), two dice are thrown, and then the one die; a procedural way of providing the same numerical distinction of U.S. Pat. No. 6,893,019, thus also providing multiple outcome ranges from a given roll. U.S. Pat. No. 4,743,025 (Gramera) discloses a set of three distinguishable six-sided dice, where each of the two hundred and sixteen possible numerical combinations of the roll are visually differentiated by varying the numeral formats on each die. Hence, 216 possible outcomes can be deciphered from such a three dice roll. Gramera describes the need for multiple outcome ranges from a given roll as follows: "Since the three dice in a set of conventional dice are of identical color, it is virtually impossible for game participants to visually differentiate each of the two-hundred-sixteen possible rolled combinations that display the sixteen numerical sums, ranging in values from three through eighteen. Without the ability to visually differentiate each of the two-hundred-sixteen possible numerical combinations of three dice, all current dice related games using a conventional set of 3 dice of one color, incorporating various game boards, playing cards or a combination thereof, are limited to only the normally expected sixteen visually discernable numerical scores, each of which turns up with varying odds. As a result, a great number of games currently available, utilize either several six-sided dice or dice with more than six sides, to compensate for the scoring limitation that is clearly evident when either a set of two or three conventional six-sided dies are used in various games of chance." (Gramera at Column 2, lines 4-22.)

Other examples can be found also attempting to provide additional wagering and outcome ranges from a given roll. Specifically, to provide the two-dice roll outcome range from a three dice roll, all of the prior art examples are implemented by providing a means to distinguish between the dice thrown. What has never before been done is to provide additional wagering and outcome ranges using three indistinguishable dice, all thrown at once. It is widely believed that this is not possible, as Gramera states. (Supra.)

U.S. Pat. No. 4,743,025 (Scheb et al.) discloses another game using 3 distinguishable dice. Scheb et al. describes as disclosing U.S. Pat. No. 6,234,482, a multiple dice game wherein players' wager relate to the outcome of a roll of three dice without differentiation of three dice. Wagers are limited to wagers regarding the total of the three dice and/or the existence of two or three identical numbers being rolled.

Therefore, a method and apparatus is needed in the gaming art to provide additional randomization ranges, and in particular a method and apparatus to facilitate multiple games to all be played concurrently against the same randomization event, e.g., a dice roll, wheel spin, etc. These games should have the ability to greatly range in variety and complexity. The literature sites many examples of the need for simple games, as well as more complex games to captivate the interest of novice and experienced players alike. By providing a wide range of game selections based upon the various mappings, it is possible that players of all ranges of experience can enjoy playing games of their choice, all together at the same time, against the same randomization event, e.g., a live roll of dice, spin of a prize wheel or selection of a player card from a deck.

SUMMARY OF THE INVENTION

The subject invention overcomes the shortcomings and disadvantages found in prior art methods and apparatus by providing a method for concurrently resolving a plurality of different games of chance having different decision ranges using a single randomization event. The method comprises the steps of providing a first game of chance having an outcome determined by the selection of a number in a first number range and providing a second game of chance, different than the first game of chance, which has an outcome determined by the selection of a number within a second range. An input data range is provided, which is defined as numbers derived from all possible outcomes of a randomizer machine. The input data range is dissimilar to at least one of the first and second number ranges. A randomizer machine is provided and configured to randomly select a number from the input data range. Wagers are placed on the respective first and second games of chance and then a number is obtained from the randomizer machine. The number obtained from the randomizer machine is mapped to the first number range using a first data map which associates each number in the first number range with a number in the input data range. Similarly, the number selected by the randomizer machine is mapped to a number in the second data range using a second data map which associates each number in the second number range with a number in the input data range. Through this method, the first and second (and possibly more) games of chance can be concurrently resolved based on the input data from the randomizer machine. As a result, a plurality of disparate games of chance can be predictably decided on the basis of a common randomization event.

The invention also provides for a gaming system used to concurrently play and resolve a plurality of disparate games of chance using a single randomization event. The gaming system comprises a first game of chance of the type having an outcome determined by the selection of a number within a first number range. A second game of chance is provided that is different than the first game of chance and remotely spaced therefrom. The second game of chance is of the type having an outcome determined by the selection of a number within a second number range. A randomizer machine is configured to randomly select one number from an input data range, where the input data range is defined as numbers derived from all possible outcomes of the randomizer machine. A first data map associates each number in the first number range with a number in the input data range, and a second data map associates each number in the second number range with a number in the input data range. A computer processor is configured to map the number from the randomizer machine to a number in the first number range using the first data map and to a number in the second data range using the second data map. By this, the first and second games of chance can be concurrently resolved based on the input data from the randomizer machine.

In creating a group experience for gamblers of different levels, the excitement of gambling may increase. For example, simultaneously, one gambler may bet on the first game of chance which could be a simple "heads or tails of a coin flip", another player may wager on the second game of chance which could be traditional two-dice craps rolls, and another player may wager on yet another game of chance which might be a complex set of three-dice craps rolls. Though the three gamblers are playing different games, they are sharing the excitement of gambling together, where they are betting on outcomes of the same random event.

In addition, the apparatus provides new and exciting combinations of randomizer machines, i.e., random number generator devices, and the games for which they are played. For example, casinos can set up configurations employing the invention, where players can spin a roulette wheel, and wagering can occur for a traditional craps game, or, players can throw dice and make wagers for a traditional roulette game.

The mapping provided by the subject invention may occur through various known methods of computerized and non-computerized methods of mapping one set of values to another set of values. In the case where users embed the apparatus in a computerized system, an input value is associated with a random event and the apparatus maps the input value to output values that represent outcomes associated with various wagering games. The apparatus then goes on to broadcast these results to two or more games being run so that they can be concurrently resolved.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 2:
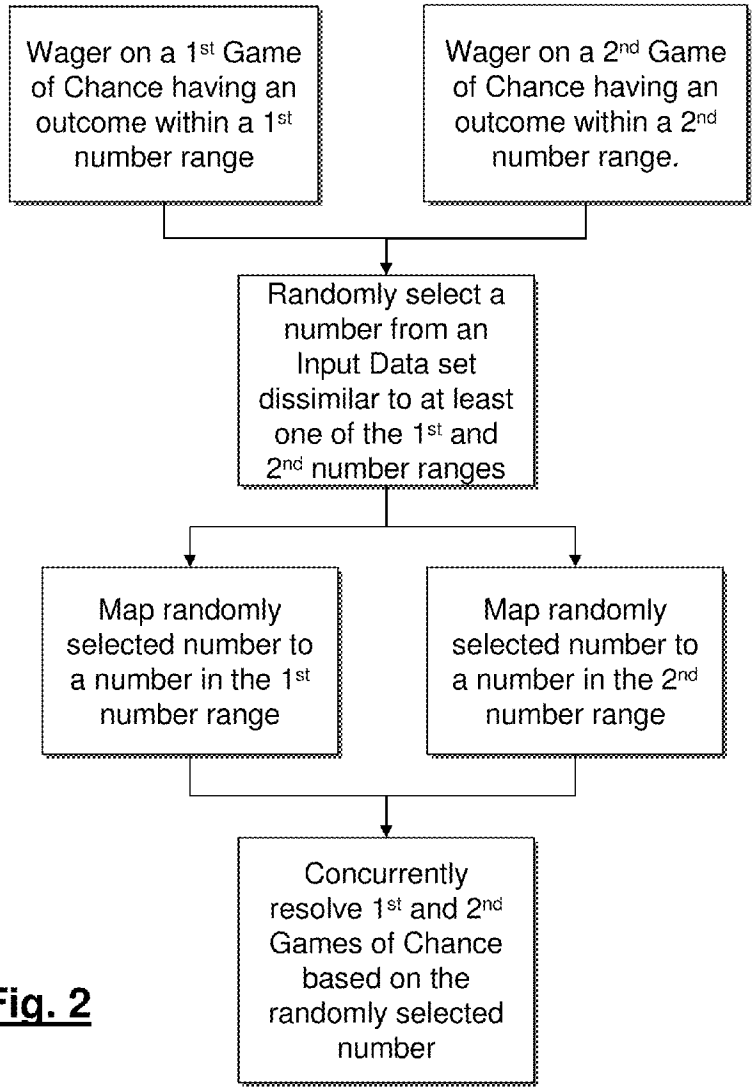
FIG. 2 is a diagram representing the method steps of this invention.
Figure 1:
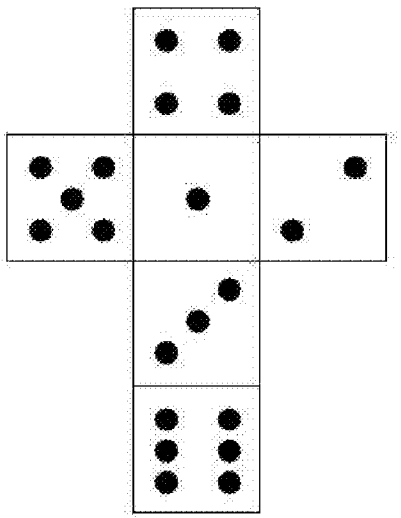
FIG. 1 is a two-dimensional representation of the surfaces of a six-sided die unfolded to reveal all six sides, with indicia representing the numbers 1-6 according to the traditional die construction.

The present specification explains preferred embodiments of a method and apparatus that maps a set of numbers associated with possibilities of a random event to another set of numbers associated with events wagered on in a wagering game. By mapping random events to various outcomes associated with various games, multiple games can be played concurrently. Multiple players of differing experience and game preference may enjoy the wagering experience together as they play different games, where the differing games' results derive from the same initial random event. In general, the method uses data structures that comprise a set of numbers representing a set of possible outcomes of a random event, referred to as input data for the method. In addition, the method comprises at least two other sets of numbers representing events to wager on in respective, disparate wagering games, and a known manner of mapping the input data set of numbers to each of the other sets of numbers, referred to as output data.

In general, the mapping may occur through various know methods of computerized and non-computerized methods of mapping a set of values to another set of values. Non-computerized methods may include using lookup charts and making verbal calls. In preferred embodiments of an apparatus implementing this invention, where the apparatus exists in a computerized system, the preferred data structures are a set of data tables. Other preferred data structures employed by preferred embodiments of the apparatus include arrays and linked lists. A data table comprises at least two columns where one column lists the possible input values and the other columns lists the possible output values. Each row of the table associates a single input value with one or more output values in the same row.

The randomly generated numbers may result from several methods, including a computerized method for generating random numbers, a manual method for generating random numbers, and any combination thereof. Manual methods for generating random numbers may include rolling dice, spinning a roulette wheel, flipping a coin, selecting a playing card from a deck of playing cards, any other known method for manually generating random numbers, or any combination thereof.

A set of mathematic relationships between elements in input and elements in output data sets is the basis of a process called "Fixed Randomization Mapping". This process is used to create the mapping tables utilized by this invention, and would be used as the basis for additional mapping tables that may be hereafter created but based on the precepts of this invention.

Following is an example of the use of Fixed Randomization Mapping, in which a single dice roll will result in three games that can all be played at the same time. The example input set is a representation of possible outcomes of rolling a single six-sided die, where members of the set represent rolls having values ranging from one to six. The input data set is described as having a range of 1 to 6. The range of an output set may be less than or equal to the range of the input set. In this example, one of the output data sets consists of only 2 values, described as having a range of 1 to 2. Table 1 below provides a simple example of a mapping table utilized by the invention, illustrating the mapping of members of the input set comprised of single die rolls to members of a set that ranges from 1 to 2, herein referred to as "Map 1:6 to 1:2".

TABLE 1

| Map 1:6 to 1:2 | |
|---|---|
| Input Data | Output Data |
| 1 | 1 |
| 2 | 1 |
| 3 | 1 |
| 4 | 2 |
| 5 | 2 |
| 6 | 2 |

For many input data sets, there are a number of possible maps that fixed randomization may employ. Table 2 illustrates an alternative mapping of single die rolls to members of a 1 to 2-range set.

TABLE 2

| Alternative Map 1:6 to 1:2 | |
|---|---|
| Input Data | Output Data |
| 1 | 1 |
| 2 | 2 |
| 3 | 1 |
| 4 | 2 |
| 5 | 1 |
| 6 | 2 |

These are both shown to introduce the fact that multiple mappings can be made between an input data set and an output data range. However, in preferred embodiments of the invention, it is intended to be used with only one map for each output range, thus the term "FIXED randomization mapping" is used to describe the process.

Table 3 illustrates another mapping of single die rolls to members of a 1 to 2-range set.

TABLE 3

| Unfair alternative Map 1:6 to 1:2 | |
|---|---|
| Input Data | Output Data |
| 1 | 1 |
| 2 | 1 |
| 3 | 1 |
| 4 | 1 |
| 5 | 2 |
| 6 | 2 |

This is shown to introduce the concept of a "fair mapping". A "Fair mapping" is one in which the range of randomly selected members from the input set are equally distributed over the range of members in the output set. By contrast, Table 3 represents an "Unfair" 1:6 to 1:2 mapping. Some preferred embodiments of the invention are intended to be used with only fair mappings for each output range, thus the term "FAIR randomization mapping" is used to describe the mapping process, as it applies to use in gaming and the wagering processes.

Table 4 illustrates the mapping of members of an input set comprised of single die rolls to members of a set that ranges from 1 to 3, herein referred to as map "1:6 to 1:3".

TABLE 4

| Map 1:6 to 1:3 | |
|---|---|
| Input Data | Output Data |
| 1 | 1 |
| 2 | 1 |
| 3 | 2 |
| 4 | 2 |
| 5 | 3 |
| 6 | 3 |

Table 5 illustrates an example of a mapping for which the output set equals the input set, herein referred to as the "zero" map. Each element from the input data set maps to an output data set element, where the respective elements of each set are equivalent or equal to each other. The example shows the "1:6 to 1:6" map, also called the "zero map for 1:6".

TABLE 5

| Map 1:6 to 1:6, also called the Zero Map for 1:6 | |
|---|---|
| Input Data | Output Data |
| 1 | 1 |
| 2 | 2 |
| 3 | 3 |
| 4 | 4 |
| 5 | 5 |
| 6 | 6 |

Figure 3:
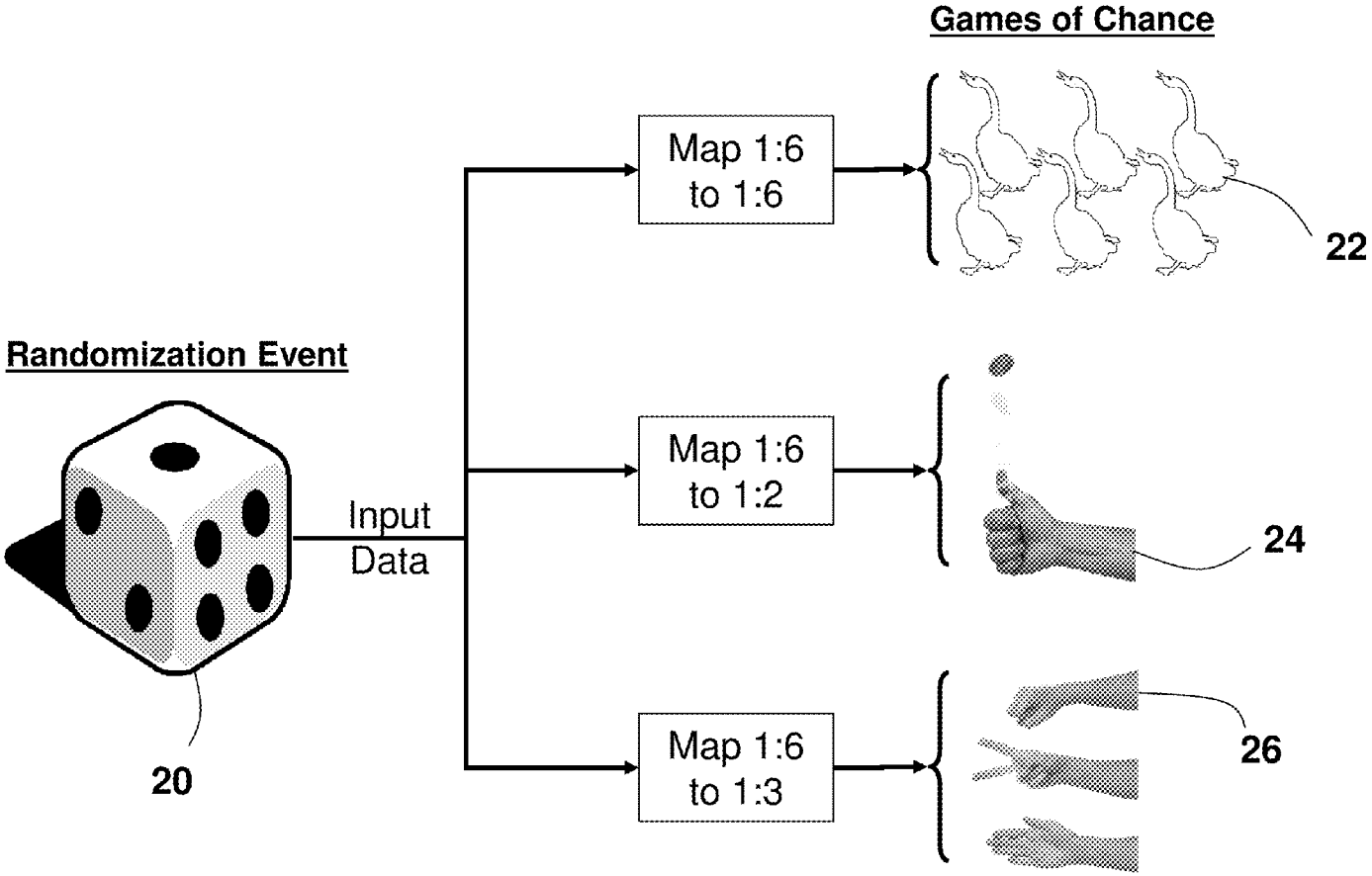
FIG. 3 is a simplified schematic view representing the mapping of a single die roll to concurrent games of chance in the 1:2, 1:3 and 1:6 output ranges.

The invention executing this example accepts a single 1-6 range identifier as input, and outputs three numbers; one for each of the ranges of 1-2, 1-3 and 1-6. So, for a practical example, when a single die is rolled, the outcome can be used as a randomization not just for a game of chance based upon a single die roll (like "6 geese"), it can also be used concurrently as a randomization for games of chance base upon a 1-3 range, like "Rock Paper Scissors", and also for games of chance based upon a 1-2 range, like "Coin Flip", all at the same time. This is illustrated in FIG. 3, and described in greater detail below.

Other examples of fixed randomization mapping include two-number combinations as elements of an input set. For example, each combination may represent a combination of two numbers from two sets of numbers ranging from one through six, commonly known as a 2-dice roll. Furthermore, the fixed randomization mapping includes three number combinations as elements of an input set, including 3-dice rolls. These input data sets need special consideration.

Table 7 lists all of the 36 possible combinations that occur when throwing two distinguishable dice.

TABLE 7

| 1:36 Index | Die #1 | Die #2 |
|---|---|---|
| 1 | 1 | 1 |
| 2 | 1 | 2 |
| 3 | 1 | 3 |
| 4 | 1 | 4 |
| 5 | 1 | 5 |
| 6 | 1 | 6 |
| 7 | 2 | 1 |
| 8 | 2 | 2 |
| 9 | 2 | 3 |
| 10 | 2 | 4 |
| 11 | 2 | 5 |
| 12 | 2 | 6 |
| 13 | 3 | 1 |
| 14 | 3 | 2 |
| 15 | 3 | 3 |
| 16 | 3 | 4 |
| 17 | 3 | 5 |
| 18 | 3 | 6 |
| 19 | 4 | 1 |
| 20 | 4 | 2 |
| 21 | 4 | 3 |
| 22 | 4 | 4 |
| 23 | 4 | 5 |
| 24 | 4 | 6 |
| 25 | 5 | 1 |
| 26 | 5 | 2 |
| 27 | 5 | 3 |
| 28 | 5 | 4 |
| 29 | 5 | 5 |
| 30 | 5 | 6 |
| 31 | 6 | 1 |
| 32 | 6 | 2 |
| 33 | 6 | 3 |

TABLE 7-continued

| 1:36 Index | Die #1 | Die #2 |
|---|---|---|
| 34 | 6 | 4 |
| 35 | 6 | 5 |
| 36 | 6 | 6 |

As mentioned above, for all 36 possibilities to be determined from a 2-dice roll, the dice used must be distinguished from each other, for example, by using one red die and one blue die. If the roll is, say, a 1 on the red die and a 2 on the blue die, this can be distinguished from a 1 on the blue die and a 2 on the red die. If the dice used are indistinguishable from each other, and if both dice are thrown at the same time, there is no practical way to distinguish between these example rolls. Thus, using indistinguishable dice, from the thirty-six possible outcomes, there are twenty-one distinct outcomes. This list is shown in Table 8 below.

Table 8 lists the 21 distinct roll combinations that can occur when rolling 2 indistinguishable dice at the same time, and introduces the concept of a "point", the numerical sum of the dice rolled. It also shows the number of ambiguous combinations that make up each distinct roll. If the combination is a "double" (both of the dice are the same number), there is only one way to make it. If the combination is a "single" (the dice are not the same number), there are 2 ways to make it.

TABLE 8

| 1:21 Index | Dice Combination | Point | Ways |
|---|---|---|---|
| 1 | 1-1 | 2 | 1 |
| 2 | 1-2 | 3 | 2 |
| 3 | 1-3 | 4 | 2 |
| 4 | 1-4 | 5 | 2 |
| 5 | 1-5 | 6 | 2 |
| 6 | 1-6 | 7 | 2 |
| 8 | 2-2 | 4 | 1 |
| 9 | 2-3 | 5 | 2 |
| 10 | 2-4 | 6 | 2 |
| 11 | 2-5 | 7 | 2 |
| 12 | 2-6 | 8 | 2 |
| 15 | 3-3 | 6 | 1 |
| 16 | 3-4 | 7 | 2 |
| 17 | 3-5 | 8 | 2 |
| 18 | 3-6 | 9 | 2 |
| 22 | 4-4 | 8 | 2 |
| 23 | 4-5 | 9 | 2 |
| 24 | 4-6 | 10 | 2 |
| 29 | 5-5 | 10 | 1 |
| 30 | 5-6 | 11 | 2 |
| 36 | 6-6 | 12 | 1 |

Table 8A shows the same information as presented in Table 8, but orders it by the resulting point number. This shows the natural "arrowhead" shaped distribution curve, demonstrating more "ways" to achieve the point toward the median point number, 7.

TABLE 8A

| Point | Ways | Dice Combinations |
|---|---|---|
| 2 | 1 | 1-1 |
| 3 | 2 | 1-2, 2-1 |
| 4 | 3 | 1-3, 2-2, 3-1 |
| 5 | 4 | 1-4, 2-3, 3-2, 4-1 |
| 6 | 5 | 1-5, 2-4, 3-3, 4-2, 5-1 |
| 7 | 6 | 1-6, 2-5, 3-4, 4-3, 5-2, 6-1 |
| 8 | 5 | 2-6, 3-5, 4-4, 5-3, 6-2 |
| 9 | 4 | 3-6, 4-5, 5-4, 6-3 |
| 10 | 3 | 4-6, 5-5, 6-4 |

TABLE 8A-continued

| Point | Ways | Dice Combinations |
|---|---|---|
| 11 | 2 | 5-6, 6-5 |
| 12 | 1 | 6-6 |

The game of traditional craps, the most popular dice game in the world, is based upon the 1-21 range of distinct dice rolls, upon the 2-12 point range, upon the stronger probability of rolling a 7 than rolling any other point, and upon the relative probability of rolling the 7 point vs. the probability of rolling the other points. The game of craps uses the 7-point as the "table-out" rolls, signaling a significant change in the game's wagering phases.

When 3 dice are thrown, 216 possible combinations result. Table 9 lists all of the 216 possible combinations that occur when throwing three distinguishable dice.

TABLE 9

| 1:216 Index | Die #1 | Die #2 | Die #3 | Point |
|---|---|---|---|---|
| 1 | 1 | 1 | 1 | 3 |
| 2 | 1 | 1 | 2 | 4 |
| 3 | 1 | 1 | 3 | 5 |
| 4 | 1 | 1 | 4 | 6 |
| 5 | 1 | 1 | 5 | 7 |
| 6 | 1 | 1 | 6 | 8 |
| 7 | 2 | 1 | 1 | 4 |
| 8 | 2 | 1 | 2 | 5 |
| 9 | 2 | 1 | 3 | 6 |
| 10 | 2 | 1 | 4 | 7 |
| 11 | 2 | 1 | 5 | 8 |
| 12 | 2 | 1 | 6 | 9 |
| 13 | 3 | 1 | 1 | 5 |
| 14 | 3 | 1 | 2 | 6 |
| 15 | 3 | 1 | 3 | 7 |
| 16 | 3 | 1 | 4 | 8 |
| 17 | 3 | 1 | 5 | 9 |
| 18 | 3 | 1 | 6 | 10 |
| 19 | 4 | 1 | 1 | 6 |
| 20 | 4 | 1 | 2 | 7 |
| 21 | 4 | 1 | 3 | 8 |
| 22 | 4 | 1 | 4 | 9 |
| 23 | 4 | 1 | 5 | 10 |
| 24 | 4 | 1 | 6 | 11 |
| 25 | 5 | 1 | 1 | 7 |
| 26 | 5 | 1 | 2 | 8 |
| 27 | 5 | 1 | 3 | 9 |
| 28 | 5 | 1 | 4 | 10 |
| 29 | 5 | 1 | 5 | 11 |
| 30 | 5 | 1 | 6 | 12 |
| 31 | 6 | 1 | 1 | 8 |
| 32 | 6 | 1 | 2 | 9 |
| 33 | 6 | 1 | 3 | 10 |
| 34 | 6 | 1 | 4 | 11 |
| 35 | 6 | 1 | 5 | 12 |
| 36 | 6 | 1 | 6 | 13 |
| 37 | 1 | 2 | 1 | 4 |
| 38 | 1 | 2 | 2 | 5 |
| 39 | 1 | 2 | 3 | 6 |
| 40 | 1 | 2 | 4 | 7 |
| 41 | 1 | 2 | 5 | 8 |
| 42 | 1 | 2 | 6 | 9 |
| 43 | 2 | 2 | 1 | 5 |
| 44 | 2 | 2 | 2 | 6 |
| 45 | 2 | 2 | 3 | 7 |
| 46 | 2 | 2 | 4 | 8 |
| 47 | 2 | 2 | 5 | 9 |
| 48 | 2 | 2 | 6 | 10 |
| 49 | 3 | 2 | 1 | 6 |
| 50 | 3 | 2 | 2 | 7 |
| 51 | 3 | 2 | 3 | 8 |
| 52 | 3 | 2 | 4 | 9 |
| 53 | 3 | 2 | 5 | 10 |
| 54 | 3 | 2 | 6 | 11 |
| 55 | 4 | 2 | 1 | 7 |

TABLE 9-continued

| 1:216 Index | Die #1 | Die #2 | Die #3 | Point |
|---|---|---|---|---|
| 56 | 4 | 2 | 2 | 8 |
| 57 | 4 | 2 | 3 | 9 |
| 58 | 4 | 2 | 4 | 10 |
| 59 | 4 | 2 | 5 | 11 |
| 60 | 4 | 2 | 6 | 12 |
| 61 | 5 | 2 | 1 | 8 |
| 62 | 5 | 2 | 2 | 9 |
| 63 | 5 | 2 | 3 | 10 |
| 64 | 5 | 2 | 4 | 11 |
| 65 | 5 | 2 | 5 | 12 |
| 66 | 5 | 2 | 6 | 13 |
| 67 | 6 | 2 | 1 | 9 |
| 68 | 6 | 2 | 2 | 10 |
| 69 | 6 | 2 | 3 | 11 |
| 70 | 6 | 2 | 4 | 12 |
| 71 | 6 | 2 | 5 | 13 |
| 72 | 6 | 2 | 6 | 14 |
| 73 | 1 | 3 | 1 | 5 |
| 74 | 1 | 3 | 2 | 6 |
| 75 | 1 | 3 | 3 | 7 |
| 76 | 4 | 3 | 4 | 8 |
| 77 | 1 | 3 | 5 | 9 |
| 78 | 1 | 3 | 6 | 10 |
| 79 | 2 | 3 | 1 | 6 |
| 80 | 2 | 3 | 2 | 7 |
| 81 | 2 | 3 | 3 | 8 |
| 82 | 2 | 3 | 4 | 9 |
| 83 | 2 | 3 | 5 | 10 |
| 84 | 2 | 3 | 6 | 11 |
| 85 | 3 | 3 | 1 | 7 |
| 86 | 3 | 3 | 2 | 8 |
| 87 | 3 | 3 | 3 | 9 |
| 88 | 3 | 3 | 4 | 10 |
| 89 | 3 | 3 | 5 | 11 |
| 90 | 3 | 3 | 6 | 12 |
| 91 | 4 | 3 | 1 | 8 |
| 92 | 4 | 3 | 2 | 9 |
| 93 | 4 | 3 | 3 | 10 |
| 94 | 4 | 3 | 4 | 11 |
| 95 | 4 | 3 | 5 | 12 |
| 96 | 4 | 3 | 6 | 13 |
| 97 | 5 | 3 | 1 | 9 |
| 98 | 5 | 3 | 2 | 10 |
| 99 | 5 | 3 | 3 | 11 |
| 100 | 5 | 3 | 4 | 12 |
| 101 | 5 | 3 | 5 | 13 |
| 102 | 5 | 3 | 6 | 14 |
| 103 | 6 | 3 | 1 | 10 |
| 104 | 6 | 3 | 2 | 11 |
| 105 | 6 | 3 | 3 | 12 |
| 106 | 6 | 3 | 4 | 13 |
| 107 | 6 | 3 | 5 | 14 |
| 108 | 6 | 3 | 6 | 15 |
| 109 | 1 | 4 | 1 | 6 |
| 110 | 1 | 4 | 2 | 7 |
| 111 | 1 | 4 | 3 | 8 |
| 112 | 1 | 4 | 4 | 9 |
| 113 | 1 | 4 | 5 | 10 |
| 114 | 1 | 4 | 6 | 11 |
| 115 | 2 | 4 | 1 | 7 |
| 116 | 2 | 4 | 2 | 8 |
| 117 | 2 | 4 | 3 | 9 |
| 118 | 2 | 4 | 4 | 10 |
| 119 | 2 | 4 | 5 | 11 |
| 120 | 2 | 4 | 6 | 12 |
| 121 | 3 | 4 | 1 | 8 |
| 122 | 3 | 4 | 2 | 9 |
| 123 | 3 | 4 | 3 | 10 |
| 124 | 3 | 4 | 4 | 11 |
| 125 | 3 | 4 | 5 | 12 |
| 126 | 3 | 4 | 6 | 13 |
| 127 | 4 | 4 | 1 | 9 |
| 128 | 4 | 4 | 2 | 10 |
| 129 | 4 | 4 | 3 | 11 |
| 130 | 4 | 4 | 4 | 12 |
| 131 | 4 | 4 | 5 | 13 |
| 132 | 4 | 4 | 6 | 14 |
| 133 | 5 | 4 | 1 | 10 |

TABLE 9-continued

| 1:216 Index | Die #1 | Die #2 | Die #3 | Point |
|---|---|---|---|---|
| 134 | 5 | 4 | 2 | 11 |
| 135 | 5 | 4 | 3 | 12 |
| 136 | 5 | 4 | 4 | 13 |
| 137 | 5 | 4 | 5 | 14 |
| 138 | 5 | 4 | 6 | 15 |
| 139 | 6 | 4 | 1 | 11 |
| 140 | 6 | 4 | 2 | 12 |
| 141 | 6 | 4 | 3 | 13 |
| 142 | 6 | 4 | 4 | 14 |
| 143 | 6 | 4 | 5 | 15 |
| 144 | 6 | 4 | 6 | 16 |
| 145 | 1 | 5 | 1 | 7 |
| 146 | 1 | 5 | 2 | 8 |
| 147 | 1 | 5 | 3 | 9 |
| 148 | 1 | 5 | 4 | 10 |
| 149 | 1 | 5 | 5 | 11 |
| 150 | 1 | 5 | 6 | 12 |
| 151 | 2 | 5 | 1 | 8 |
| 152 | 2 | 5 | 2 | 9 |
| 153 | 2 | 5 | 3 | 10 |
| 154 | 2 | 5 | 4 | 11 |
| 155 | 2 | 5 | 5 | 12 |
| 156 | 2 | 5 | 6 | 13 |
| 157 | 3 | 5 | 1 | 9 |
| 158 | 3 | 5 | 2 | 10 |
| 159 | 3 | 5 | 3 | 11 |
| 160 | 3 | 5 | 4 | 12 |
| 161 | 3 | 5 | 5 | 13 |
| 162 | 3 | 5 | 6 | 14 |
| 163 | 4 | 5 | 1 | 10 |
| 164 | 4 | 5 | 2 | 11 |
| 165 | 4 | 5 | 3 | 12 |
| 166 | 4 | 5 | 4 | 13 |
| 167 | 4 | 5 | 5 | 14 |
| 168 | 4 | 5 | 6 | 15 |
| 169 | 5 | 5 | 1 | 11 |
| 170 | 5 | 5 | 2 | 12 |
| 171 | 5 | 5 | 3 | 13 |
| 172 | 5 | 5 | 4 | 14 |
| 173 | 5 | 5 | 5 | 15 |
| 174 | 5 | 5 | 6 | 16 |
| 175 | 6 | 5 | 1 | 12 |
| 176 | 6 | 5 | 2 | 13 |
| 177 | 6 | 5 | 3 | 14 |
| 178 | 6 | 5 | 4 | 15 |
| 179 | 6 | 5 | 5 | 16 |
| 180 | 6 | 5 | 6 | 17 |
| 181 | 1 | 6 | 1 | 8 |
| 182 | 1 | 6 | 2 | 9 |
| 183 | 1 | 6 | 3 | 10 |
| 185 | 1 | 6 | 5 | 12 |
| 186 | 1 | 6 | 6 | 13 |
| 187 | 2 | 6 | 1 | 9 |
| 188 | 2 | 6 | 2 | 10 |
| 189 | 2 | 6 | 3 | 11 |
| 190 | 2 | 6 | 4 | 12 |
| 191 | 2 | 6 | 5 | 13 |
| 192 | 2 | 6 | 6 | 14 |
| 193 | 3 | 6 | 1 | 10 |
| 194 | 3 | 6 | 2 | 11 |
| 195 | 3 | 6 | 3 | 12 |
| 196 | 3 | 6 | 4 | 13 |
| 197 | 3 | 6 | 5 | 14 |
| 198 | 3 | 6 | 6 | 15 |
| 199 | 4 | 6 | 1 | 11 |
| 200 | 4 | 6 | 2 | 12 |
| 201 | 4 | 6 | 3 | 13 |
| 202 | 4 | 6 | 4 | 14 |
| 203 | 4 | 6 | 5 | 15 |
| 204 | 4 | 6 | 6 | 16 |
| 205 | 5 | 6 | 1 | 12 |
| 206 | 5 | 6 | 2 | 13 |
| 207 | 5 | 6 | 3 | 14 |
| 208 | 5 | 6 | 4 | 15 |
| 209 | 5 | 6 | 5 | 16 |
| 210 | 5 | 6 | 6 | 17 |
| 211 | 6 | 6 | 1 | 13 |
| 212 | 6 | 6 | 2 | 14 |

TABLE 9-continued

| 1:216 Index | Die #1 | Die #2 | Die #3 | Point |
|---|---|---|---|---|
| 213 | 6 | 6 | 3 | 15 |
| 214 | 6 | 6 | 4 | 16 |
| 215 | 6 | 6 | 5 | 17 |
| 216 | 6 | 6 | 6 | 18 |

Table 10 by contrast with Table 9, lists the 56 distinct roll combinations that can occur when rolling 3 indistinguishable dice at the same time, shows the resulting points (the numerical sum of the dice rolled), and shows the number of ambiguous combinations that make up each distinct roll. If the combination is a "triple" (all of the dice are the same number), there is only one way to make it. If the combination is a "pair" (two of the dice are the same number), there are 3 ways to make it. If the combination is a "single" (none of the dice are the same number), there are 6 ways to make it.

TABLE 10

| 1:56 Index | Dice Combination | Point | Ways |
|---|---|---|---|
| 1 | 1-1-1 | 3 | 1 |
| 2 | 1-1-2 | 4 | 3 |
| 3 | 1-1-3 | 5 | 3 |
| 4 | 1-1-4 | 6 | 3 |
| 5 | 1-1-5 | 7 | 3 |
| 6 | 1-1-6 | 8 | 3 |
| 7 | 1-2-6 | 9 | 6 |
| 8 | 1-3-6 | 10 | 6 |
| 9 | 1-4-6 | 11 | 6 |
| 10 | 1-5-6 | 12 | 6 |
| 11 | 1-6-6 | 13 | 3 |
| 12 | 2-6-6 | 14 | 3 |
| 13 | 3-6-6 | 15 | 3 |
| 14 | 4-6-6 | 16 | 3 |
| 15 | 5-6-6 | 17 | 3 |
| 16 | 6-6-6 | 18 | 1 |
| 17 | 1-2-2 | 5 | 3 |
| 18 | 1-2-3 | 6 | 6 |
| 19 | 1-2-4 | 7 | 6 |
| 20 | 1-2-5 | 8 | 6 |
| 21 | 1-3-5 | 9 | 6 |
| 22 | 1-4-5 | 10 | 6 |
| 23 | 1-5-5 | 11 | 3 |
| 24 | 2-4-6 | 12 | 6 |
| 25 | 2-5-6 | 13 | 6 |
| 26 | 3-5-6 | 14 | 6 |
| 27 | 4-5-6 | 15 | 6 |
| 28 | 5-5-6 | 16 | 3 |
| 29 | 2-2-2 | 6 | 1 |
| 30 | 1-3-3 | 7 | 3 |
| 31 | 1-3-4 | 8 | 6 |
| 32 | 1-4-4 | 9 | 3 |
| 33 | 2-2-6 | 10 | 3 |
| 34 | 2-3-6 | 11 | 6 |
| 35 | 2-5-5 | 12 | 3 |
| 36 | 3-4-6 | 13 | 6 |
| 37 | 4-4-6 | 14 | 3 |
| 38 | 5-5-5 | 15 | 1 |
| 39 | 2-2-3 | 7 | 3 |
| 40 | 2-2-4 | 8 | 3 |
| 41 | 2-2-5 | 9 | 3 |
| 42 | 2-3-5 | 10 | 6 |
| 43 | 2-4-5 | 11 | 6 |
| 44 | 3-3-6 | 12 | 3 |
| 45 | 3-5-5 | 13 | 3 |
| 46 | 4-5-5 | 14 | 3 |
| 47 | 2-2-3 | 8 | 3 |
| 48 | 2-3-4 | 9 | 6 |
| 49 | 2-4-4 | 10 | 3 |
| 50 | 3-3-5 | 11 | 3 |
| 51 | 3-4-5 | 12 | 6 |
| 52 | 4-4-5 | 13 | 3 |
| 53 | 3-3-3 | 9 | 1 |
| 54 | 3-3-4 | 10 | 3 |
| 55 | 3-4-4 | 11 | 3 |
| 56 | 4-4-4 | 12 | 1 |

Table 11 shows the same information as in Table 10 but orders it by the resulting point number. This shows the natural "arrowhead" shape demonstrating more "ways" to achieve the point toward the median point numbers, 10 and 11, just like the points in a 2-dice game, as shown in Table 8A above. This table was useful in creating the 3-dice to 2-dice mapping.

TABLE 11

| Point | Dice Combinations |
|---|---|
| 3 | \|1-1-1 :1\| |
| 4 | \|1-1-2 :3\| |
| 5 | \|1-1-3 :3\|1-2-2 :3\| |
| 6 | \|1-1-4 :3\|1-2-3 :6\|2-2-2 :1\| |
| 7 | \|1-1-5 :3\|1-2-4 :6\|1-3-3 :3\|2-2-3 :3\| |
| 8 | \|1-1-6 :3\|1-2-5 :6\|1-3-4 :6\|2-2-4 :3\|2-3-3 :3\| |
| 9 | \|1-2-6 :6\|1-3-5 :6\|1-4-4 :3\|2-2-5 :3\|2-3-4 :6\|3-3-3 :1\| |
| 10 | \|1-3-6 :6\|1-4-5 :6\|2-2-6 :3\|2-3-5 :6\|2-4-4 :3\|3-3-4 :3\| |
| 11 | \|1-4-6 :6\|1-5-5 :3\|2-3-6 :6\|2-4-5 :6\|3-3-5 :3\|3-4-4 :3\| |
| 12 | \|1-5-6 :6\|2-4-6 :6\|2-5-5 :3\|3-3-6 :3\|3-4-5 :6\|4-4-4 :1\| |
| 13 | \|1-6-6 :3\|2-5-6 :6\|3-4-6 :6\|3-5-5 :3\|4-4-5 :3\| |
| 14 | \|2-6-6 :3\|3-5-6 :6\|4-4-6 :3\|4-5-5 :3\| |
| 15 | \|3-6-6 :3\|4-5-6 :6\|5-5-5 :1\| |
| 16 | \|4-6-6 :3\|5-5-6 :3\| |
| 17 | \|5-6-6 :3\| |
| 18 | \|6-6-6 :1\| |

Using three indistinguishable dice, it is possible to devise new and interesting wagering games. For example, a new game of 3-dice craps may be based upon the 1-56 range of distinct dice rolls, upon the 3-18 point range, upon the stronger probability of rolling a 10 or 11 than rolling any other point, and upon the relative probability of rolling the 10 or 11 point vs. the probability of rolling the other points. Such a game could be devised to exactly parallel what occurs in traditional 2-dice craps games, but use the 10 and 11 points as the "table-out" rolls, signaling significant changes in the game's wagering phases. Other similar 3-dice craps games may be developed utilizing other point numbers as the table-out rolls.

Table 12 shows a very special map of all two hundred and sixteen three dice rolls mapped to a set of thirty-six identifiers representing each possible two dice roll, described as the "3-dice roll to 2-dice roll map".

TABLE 12

| 3 Dice Roll (Input Data) | | | | | | Maps to 2 Dice (Output Data) | | | |
|---|---|---|---|---|---|---|---|---|---|
| 1:216 Index | Dice Combination | | | Point | Ways | 1:36 Index (Table 7) | Dice Combination | | Point |
| 1 | 1 | 1 | 1 | 3 | 1 | 6 | 1 | 6 | 7 |
| 2 | 1 | 1 | 2 | 4 | 3 | 1 | 1 | 1 | 2 |
| 3 | 1 | 1 | 3 | 5 | 6 | 1 | 1 | 1 | 2 |
| 4 | 1 | 1 | 4 | 6 | 10 | 2 | 1 | 2 | 3 |
| 5 | 1 | 1 | 5 | 7 | 15 | 6 | 1 | 6 | 7 |
| 6 | 1 | 1 | 6 | 8 | 21 | 3 | 1 | 3 | 4 |
| 7 | 1 | 2 | 1 | 4 | 3 | 1 | 1 | 1 | 2 |
| 8 | 1 | 2 | 2 | 5 | 6 | 2 | 1 | 2 | 3 |
| 9 | 1 | 2 | 3 | 6 | 10 | 7 | 2 | 1 | 3 |
| 10 | 1 | 2 | 4 | 7 | 15 | 11 | 2 | 5 | 7 |
| 11 | 1 | 2 | 5 | 8 | 21 | 8 | 2 | 2 | 4 |
| 12 | 1 | 2 | 6 | 9 | 25 | 9 | 2 | 3 | 5 |
| 13 | 1 | 3 | 1 | 5 | 6 | 1 | 1 | 1 | 2 |

TABLE 12-continued

| 3 Dice Roll (Input Data) | | | | | | Maps to 2 Dice (Output Data) | | | |
|---|---|---|---|---|---|---|---|---|---|
| 1:216 Index | Dice Combination | | | Point | Ways | 1:36 Index (Table 7) | Dice Combination | | Point |
| 14 | 1 | 3 | 2 | 6 | 10 | 7 | 2 | 1 | 3 |
| 15 | 1 | 3 | 3 | 7 | 15 | 16 | 3 | 4 | 7 |
| 16 | 1 | 3 | 4 | 8 | 21 | 13 | 3 | 1 | 4 |
| 17 | 1 | 3 | 5 | 9 | 25 | 14 | 3 | 2 | 5 |
| 18 | 1 | 3 | 6 | 10 | 27 | 5 | 1 | 5 | 6 |
| 19 | 1 | 4 | 1 | 6 | 10 | 2 | 1 | 2 | 3 |
| 20 | 1 | 4 | 2 | 7 | 15 | 11 | 2 | 5 | 7 |
| 21 | 1 | 4 | 3 | 8 | 21 | 13 | 3 | 1 | 4 |
| 22 | 1 | 4 | 4 | 9 | 25 | 4 | 1 | 4 | 5 |
| 23 | 1 | 4 | 5 | 10 | 27 | 10 | 2 | 4 | 6 |
| 24 | 1 | 4 | 6 | 11 | 27 | 32 | 6 | 2 | 8 |
| 25 | 1 | 5 | 1 | 7 | 15 | 6 | 1 | 6 | 7 |
| 26 | 1 | 5 | 2 | 8 | 21 | 8 | 2 | 2 | 4 |
| 27 | 1 | 5 | 3 | 9 | 25 | 14 | 3 | 2 | 5 |
| 28 | 1 | 5 | 4 | 10 | 27 | 10 | 2 | 4 | 6 |
| 29 | 1 | 5 | 5 | 11 | 27 | 18 | 3 | 6 | 9 |
| 30 | 1 | 5 | 6 | 12 | 25 | 28 | 5 | 4 | 9 |
| 31 | 1 | 6 | 1 | 8 | 21 | 3 | 1 | 3 | 4 |
| 32 | 1 | 6 | 2 | 9 | 25 | 9 | 2 | 3 | 5 |
| 33 | 1 | 6 | 3 | 10 | 27 | 5 | 1 | 5 | 6 |
| 34 | 1 | 6 | 4 | 11 | 27 | 32 | 6 | 2 | 8 |
| 35 | 1 | 6 | 5 | 12 | 25 | 28 | 5 | 4 | 9 |
| 36 | 1 | 6 | 6 | 13 | 21 | 34 | 6 | 4 | 10 |
| 37 | 2 | 1 | 1 | 4 | 3 | 1 | 1 | 1 | 2 |
| 38 | 2 | 1 | 2 | 5 | 6 | 2 | 1 | 2 | 3 |
| 39 | 2 | 1 | 3 | 6 | 10 | 7 | 2 | 1 | 3 |
| 40 | 2 | 1 | 4 | 7 | 15 | 11 | 2 | 5 | 7 |
| 41 | 2 | 1 | 5 | 8 | 21 | 8 | 2 | 2 | 4 |
| 42 | 2 | 1 | 6 | 9 | 25 | 9 | 2 | 3 | 5 |
| 43 | 2 | 2 | 1 | 5 | 6 | 2 | 1 | 2 | 3 |
| 44 | 2 | 2 | 2 | 6 | 10 | 6 | 1 | 6 | 7 |
| 45 | 2 | 2 | 3 | 7 | 15 | 16 | 3 | 4 | 7 |
| 46 | 2 | 2 | 4 | 8 | 21 | 3 | 1 | 3 | 4 |
| 47 | 2 | 2 | 5 | 9 | 25 | 19 | 4 | 1 | 5 |
| 48 | 2 | 2 | 6 | 10 | 27 | 19 | 4 | 1 | 5 |
| 49 | 2 | 3 | 1 | 6 | 10 | 7 | 2 | 1 | 3 |
| 50 | 2 | 3 | 2 | 7 | 15 | 16 | 3 | 4 | 7 |
| 51 | 2 | 3 | 3 | 8 | 21 | 4 | 1 | 4 | 5 |
| 52 | 2 | 3 | 4 | 9 | 25 | 25 | 5 | 1 | 6 |
| 53 | 2 | 3 | 5 | 10 | 27 | 15 | 3 | 3 | 6 |
| 54 | 2 | 3 | 6 | 11 | 27 | 27 | 5 | 3 | 8 |
| 55 | 2 | 4 | 1 | 7 | 15 | 11 | 2 | 5 | 7 |
| 56 | 2 | 4 | 2 | 8 | 21 | 3 | 1 | 3 | 4 |
| 57 | 2 | 4 | 3 | 9 | 25 | 25 | 5 | 1 | 6 |
| 58 | 2 | 4 | 4 | 10 | 27 | 20 | 4 | 2 | 6 |
| 59 | 2 | 4 | 5 | 11 | 27 | 22 | 4 | 4 | 8 |
| 60 | 2 | 4 | 6 | 12 | 25 | 23 | 4 | 5 | 9 |
| 61 | 2 | 5 | 1 | 8 | 21 | 8 | 2 | 2 | 4 |
| 62 | 2 | 5 | 2 | 9 | 25 | 19 | 4 | 1 | 5 |
| 63 | 2 | 5 | 3 | 10 | 27 | 15 | 3 | 3 | 6 |
| 64 | 2 | 5 | 4 | 11 | 27 | 22 | 4 | 4 | 8 |
| 65 | 2 | 5 | 5 | 12 | 25 | 33 | 6 | 3 | 9 |
| 66 | 2 | 5 | 6 | 13 | 21 | 29 | 5 | 5 | 10 |
| 67 | 2 | 6 | 1 | 9 | 25 | 9 | 2 | 3 | 5 |
| 68 | 2 | 6 | 2 | 10 | 27 | 19 | 4 | 1 | 5 |
| 69 | 2 | 6 | 3 | 11 | 27 | 27 | 5 | 3 | 8 |
| 70 | 2 | 6 | 4 | 12 | 25 | 23 | 4 | 5 | 9 |
| 71 | 2 | 6 | 5 | 13 | 21 | 29 | 5 | 5 | 10 |
| 72 | 2 | 6 | 6 | 14 | 15 | 31 | 6 | 1 | 7 |
| 73 | 3 | 1 | 1 | 5 | 6 | 1 | 1 | 1 | 2 |
| 74 | 3 | 1 | 2 | 6 | 10 | 7 | 2 | 1 | 3 |
| 75 | 3 | 1 | 3 | 7 | 15 | 16 | 3 | 4 | 7 |
| 76 | 3 | 1 | 4 | 8 | 21 | 13 | 3 | 1 | 4 |
| 77 | 3 | 1 | 5 | 9 | 25 | 14 | 3 | 2 | 5 |
| 78 | 3 | 1 | 6 | 10 | 27 | 5 | 1 | 5 | 6 |
| 79 | 3 | 2 | 1 | 6 | 10 | 7 | 2 | 1 | 3 |
| 80 | 3 | 2 | 2 | 7 | 15 | 16 | 3 | 4 | 7 |
| 81 | 3 | 2 | 3 | 8 | 21 | 4 | 1 | 4 | 5 |
| 82 | 3 | 2 | 4 | 9 | 25 | 25 | 5 | 1 | 6 |
| 83 | 3 | 2 | 5 | 10 | 27 | 15 | 3 | 3 | 6 |
| 84 | 3 | 2 | 6 | 11 | 27 | 27 | 5 | 3 | 8 |
| 85 | 3 | 3 | 1 | 7 | 15 | 16 | 3 | 4 | 7 |
| 86 | 3 | 3 | 2 | 8 | 21 | 4 | 1 | 4 | 5 |
| 87 | 3 | 3 | 3 | 9 | 25 | 6 | 1 | 6 | 7 |
| 88 | 3 | 3 | 4 | 10 | 27 | 20 | 4 | 2 | 6 |

TABLE 12-continued

| 3 Dice Roll (Input Data) | | | | | | Maps to 2 Dice (Output Data) | | | |
|---|---|---|---|---|---|---|---|---|---|
| 1:216 Index | Dice Combination | | | Point | Ways | 1:36 Index (Table 7) | Dice Combination | | Point |
| 89 | 3 | 3 | 5 | 11 | 27 | 17 | 3 | 5 | 8 |
| 90 | 3 | 3 | 6 | 12 | 25 | 18 | 3 | 6 | 9 |
| 91 | 3 | 4 | 1 | 8 | 21 | 13 | 3 | 1 | 4 |
| 92 | 3 | 4 | 2 | 9 | 25 | 25 | 5 | 1 | 6 |
| 93 | 3 | 4 | 3 | 10 | 27 | 20 | 4 | 2 | 6 |
| 94 | 3 | 4 | 4 | 11 | 27 | 17 | 3 | 5 | 8 |
| 95 | 3 | 4 | 5 | 12 | 25 | 12 | 2 | 6 | 8 |
| 96 | 3 | 4 | 6 | 13 | 21 | 24 | 4 | 6 | 10 |
| 97 | 3 | 5 | 1 | 9 | 25 | 14 | 3 | 2 | 5 |
| 98 | 3 | 5 | 2 | 10 | 27 | 15 | 3 | 3 | 6 |
| 99 | 3 | 5 | 3 | 11 | 27 | 17 | 3 | 5 | 8 |
| 100 | 3 | 5 | 4 | 12 | 25 | 12 | 2 | 6 | 8 |
| 101 | 3 | 5 | 5 | 13 | 21 | 34 | 6 | 4 | 10 |
| 102 | 3 | 5 | 6 | 14 | 15 | 21 | 4 | 3 | 7 |
| 103 | 3 | 6 | 1 | 10 | 27 | 5 | 1 | 5 | 6 |
| 104 | 3 | 6 | 2 | 11 | 27 | 27 | 5 | 3 | 8 |
| 105 | 3 | 6 | 3 | 12 | 25 | 18 | 3 | 6 | 9 |
| 106 | 3 | 6 | 4 | 13 | 21 | 24 | 4 | 6 | 10 |
| 107 | 3 | 6 | 5 | 14 | 15 | 21 | 4 | 3 | 7 |
| 108 | 3 | 6 | 6 | 15 | 10 | 35 | 6 | 5 | 11 |
| 109 | 4 | 1 | 1 | 6 | 10 | 2 | 1 | 2 | 3 |
| 110 | 4 | 1 | 2 | 7 | 15 | 11 | 2 | 5 | 7 |
| 111 | 4 | 1 | 3 | 8 | 21 | 13 | 3 | 1 | 4 |
| 112 | 4 | 1 | 4 | 9 | 25 | 4 | 1 | 4 | 5 |
| 113 | 4 | 1 | 5 | 10 | 27 | 10 | 2 | 4 | 6 |
| 114 | 4 | 1 | 6 | 11 | 27 | 32 | 6 | 2 | 8 |
| 115 | 4 | 2 | 1 | 7 | 15 | 11 | 2 | 5 | 7 |
| 116 | 4 | 2 | 2 | 8 | 21 | 3 | 1 | 3 | 4 |
| 117 | 4 | 2 | 3 | 9 | 25 | 25 | 5 | 1 | 6 |
| 118 | 4 | 2 | 4 | 10 | 27 | 20 | 4 | 2 | 6 |
| 119 | 4 | 2 | 5 | 11 | 27 | 22 | 4 | 4 | 8 |
| 120 | 4 | 2 | 6 | 12 | 25 | 23 | 4 | 5 | 9 |
| 121 | 4 | 3 | 1 | 8 | 21 | 13 | 3 | 1 | 4 |
| 122 | 4 | 3 | 2 | 9 | 25 | 25 | 5 | 1 | 6 |
| 123 | 4 | 3 | 3 | 10 | 27 | 20 | 4 | 2 | 6 |
| 124 | 4 | 3 | 4 | 11 | 27 | 17 | 3 | 5 | 8 |
| 125 | 4 | 3 | 5 | 12 | 25 | 12 | 2 | 6 | 8 |
| 126 | 4 | 3 | 6 | 13 | 21 | 24 | 4 | 6 | 10 |
| 127 | 4 | 4 | 1 | 9 | 25 | 4 | 1 | 4 | 5 |
| 128 | 4 | 4 | 2 | 10 | 27 | 20 | 4 | 2 | 6 |
| 129 | 4 | 4 | 3 | 11 | 27 | 17 | 3 | 5 | 8 |
| 130 | 4 | 4 | 4 | 12 | 25 | 31 | 6 | 1 | 7 |
| 131 | 4 | 4 | 5 | 13 | 21 | 33 | 6 | 3 | 9 |
| 132 | 4 | 4 | 6 | 14 | 15 | 26 | 5 | 2 | 7 |
| 133 | 4 | 5 | 1 | 10 | 27 | 10 | 2 | 4 | 6 |
| 134 | 4 | 5 | 2 | 11 | 27 | 22 | 4 | 4 | 8 |
| 135 | 4 | 5 | 3 | 12 | 25 | 12 | 2 | 6 | 8 |
| 136 | 4 | 5 | 4 | 13 | 21 | 33 | 6 | 3 | 9 |
| 137 | 4 | 5 | 5 | 14 | 15 | 26 | 5 | 2 | 7 |
| 138 | 4 | 5 | 6 | 15 | 10 | 30 | 5 | 6 | 11 |
| 139 | 4 | 6 | 1 | 11 | 27 | 32 | 6 | 2 | 8 |
| 140 | 4 | 6 | 2 | 12 | 25 | 23 | 4 | 5 | 9 |
| 141 | 4 | 6 | 3 | 13 | 21 | 24 | 4 | 6 | 10 |
| 142 | 4 | 6 | 4 | 14 | 15 | 26 | 5 | 2 | 7 |
| 143 | 4 | 6 | 5 | 15 | 10 | 30 | 5 | 6 | 11 |
| 144 | 4 | 6 | 6 | 16 | 6 | 36 | 6 | 6 | 12 |
| 145 | 5 | 1 | 1 | 7 | 15 | 6 | 1 | 6 | 7 |
| 146 | 5 | 1 | 2 | 8 | 21 | 8 | 2 | 2 | 4 |
| 147 | 5 | 1 | 3 | 9 | 25 | 14 | 3 | 2 | 5 |
| 148 | 5 | 1 | 4 | 10 | 27 | 10 | 2 | 4 | 6 |
| 149 | 5 | 1 | 5 | 11 | 27 | 18 | 3 | 6 | 9 |
| 150 | 5 | 1 | 6 | 12 | 25 | 28 | 5 | 4 | 9 |
| 151 | 5 | 2 | 1 | 8 | 21 | 8 | 2 | 2 | 4 |
| 152 | 5 | 2 | 2 | 9 | 25 | 19 | 4 | 1 | 5 |
| 153 | 5 | 2 | 3 | 10 | 27 | 15 | 3 | 3 | 6 |
| 154 | 5 | 2 | 4 | 11 | 27 | 22 | 4 | 4 | 8 |
| 155 | 5 | 2 | 5 | 12 | 25 | 33 | 6 | 3 | 9 |
| 156 | 5 | 2 | 6 | 13 | 21 | 29 | 5 | 5 | 10 |
| 157 | 5 | 3 | 1 | 9 | 25 | 14 | 3 | 2 | 5 |
| 158 | 5 | 3 | 2 | 10 | 27 | 15 | 3 | 3 | 6 |
| 159 | 5 | 3 | 3 | 11 | 27 | 17 | 3 | 5 | 8 |
| 160 | 5 | 3 | 4 | 12 | 25 | 12 | 2 | 6 | 8 |
| 161 | 5 | 3 | 5 | 13 | 21 | 34 | 6 | 4 | 10 |
| 162 | 5 | 3 | 6 | 14 | 15 | 21 | 4 | 3 | 7 |
| 163 | 5 | 4 | 1 | 10 | 27 | 10 | 2 | 4 | 6 |

TABLE 12-continued

| 3 Dice Roll (Input Data) | | | | | | Maps to 2 Dice (Output Data) | | | |
|---|---|---|---|---|---|---|---|---|---|
| 1:216 Index | Dice Combination | | | Point | Ways | 1:36 Index (Table 7) | Dice Combination | | Point |
| 164 | 5 | 4 | 2 | 11 | 27 | 22 | 4 | 4 | 8 |
| 165 | 5 | 4 | 3 | 12 | 25 | 12 | 2 | 6 | 8 |
| 166 | 5 | 4 | 4 | 13 | 21 | 33 | 6 | 3 | 9 |
| 167 | 5 | 4 | 5 | 14 | 15 | 26 | 5 | 2 | 7 |
| 168 | 5 | 4 | 6 | 15 | 10 | 30 | 5 | 6 | 11 |
| 169 | 5 | 5 | 1 | 11 | 27 | 18 | 3 | 6 | 9 |
| 170 | 5 | 5 | 2 | 12 | 25 | 33 | 6 | 3 | 9 |
| 171 | 5 | 5 | 3 | 13 | 21 | 34 | 6 | 4 | 10 |
| 172 | 5 | 5 | 4 | 14 | 15 | 26 | 5 | 2 | 7 |
| 173 | 5 | 5 | 5 | 15 | 10 | 31 | 6 | 1 | 7 |
| 174 | 5 | 5 | 6 | 16 | 6 | 35 | 6 | 5 | 11 |
| 175 | 5 | 6 | 1 | 12 | 25 | 28 | 5 | 4 | 9 |
| 176 | 5 | 6 | 2 | 13 | 21 | 29 | 5 | 5 | 10 |
| 177 | 5 | 6 | 3 | 14 | 15 | 21 | 4 | 3 | 7 |
| 178 | 5 | 6 | 4 | 15 | 10 | 30 | 5 | 6 | 11 |
| 179 | 5 | 6 | 5 | 16 | 6 | 35 | 6 | 5 | 11 |
| 180 | 5 | 6 | 6 | 17 | 3 | 36 | 6 | 6 | 12 |
| 181 | 6 | 1 | 1 | 8 | 21 | 3 | 1 | 3 | 4 |
| 182 | 6 | 1 | 2 | 9 | 25 | 9 | 2 | 3 | 5 |
| 183 | 6 | 1 | 3 | 10 | 27 | 5 | 1 | 5 | 6 |
| 184 | 6 | 1 | 4 | 11 | 27 | 32 | 6 | 2 | 8 |
| 185 | 6 | 1 | 5 | 12 | 25 | 28 | 5 | 4 | 9 |
| 186 | 6 | 1 | 6 | 13 | 21 | 34 | 6 | 4 | 10 |
| 187 | 6 | 2 | 1 | 9 | 25 | 9 | 2 | 3 | 5 |
| 188 | 6 | 2 | 2 | 10 | 27 | 19 | 4 | 1 | 5 |
| 189 | 6 | 2 | 3 | 11 | 27 | 27 | 5 | 3 | 8 |
| 190 | 6 | 2 | 4 | 12 | 25 | 23 | 4 | 5 | 9 |
| 191 | 6 | 2 | 5 | 13 | 21 | 29 | 5 | 5 | 10 |
| 192 | 6 | 2 | 6 | 14 | 15 | 31 | 6 | 1 | 7 |
| 193 | 6 | 3 | 1 | 10 | 27 | 5 | 1 | 5 | 6 |
| 194 | 6 | 3 | 2 | 11 | 27 | 27 | 5 | 3 | 8 |
| 195 | 6 | 3 | 3 | 12 | 25 | 18 | 3 | 6 | 9 |
| 196 | 6 | 3 | 4 | 13 | 21 | 24 | 4 | 6 | 10 |
| 197 | 6 | 3 | 5 | 14 | 15 | 21 | 4 | 3 | 7 |
| 198 | 6 | 3 | 6 | 15 | 10 | 35 | 6 | 5 | 11 |
| 199 | 6 | 4 | 1 | 11 | 27 | 32 | 6 | 2 | 8 |
| 200 | 6 | 4 | 2 | 12 | 25 | 23 | 4 | 5 | 9 |
| 201 | 6 | 4 | 3 | 13 | 21 | 24 | 4 | 6 | 10 |
| 202 | 6 | 4 | 4 | 14 | 15 | 26 | 5 | 2 | 7 |
| 203 | 6 | 4 | 5 | 15 | 10 | 30 | 5 | 6 | 11 |
| 204 | 6 | 4 | 6 | 16 | 6 | 36 | 6 | 6 | 12 |
| 205 | 6 | 5 | 1 | 12 | 25 | 28 | 5 | 4 | 9 |
| 206 | 6 | 5 | 2 | 13 | 21 | 29 | 5 | 5 | 10 |
| 207 | 6 | 5 | 3 | 14 | 15 | 21 | 4 | 3 | 7 |
| 208 | 6 | 5 | 4 | 15 | 10 | 30 | 5 | 6 | 11 |
| 209 | 6 | 5 | 5 | 16 | 6 | 35 | 6 | 5 | 11 |
| 210 | 6 | 5 | 6 | 17 | 3 | 36 | 6 | 6 | 12 |
| 211 | 6 | 6 | 1 | 13 | 21 | 34 | 6 | 4 | 10 |
| 212 | 6 | 6 | 2 | 14 | 15 | 31 | 6 | 1 | 7 |
| 213 | 6 | 6 | 3 | 15 | 10 | 35 | 6 | 5 | 11 |
| 214 | 6 | 6 | 4 | 16 | 6 | 36 | 6 | 6 | 12 |
| 215 | 6 | 6 | 5 | 17 | 3 | 36 | 6 | 6 | 12 |
| 216 | 6 | 6 | 6 | 18 | 1 | 31 | 6 | 1 | 7 |

Table 13 is a view of the data in the map in Table 12, showing only the 56 distinct 3-dice rolls mapped to the 1-36 identifiers that represent each possible 2-dice roll.

TABLE 13

| 1:36 Index | 2 Dice Combination | 3 Dice Combination |
|---|---|---|
| 1 | 1-1 | 1-1-2 1-1-3 |
| 2 | 1-2 | 1-1-4 1-2-2 1-2-3 |
| 3 | 1-3 | 1-1-6 1-3-4 2-2-4 |
| 4 | 1-4 | 1-4-4 2-2-5 2-2-6 2-3-3 |
| 5 | 1-5 | 1-3-6 2-3-4 |
| 6 | 1-6 | 1-1-1 1-1-5 2-2-2 2-6-6 3-3-3 4-4-4 5-5-5 6-6-6 |
| 7 | 2-1 | 1-1-4 1-2-2 1-2-3 |
| 8 | 2-2 | 1-2-5 |
| 9 | 2-3 | 1-2-6 1-3-5 |
| 10 | 2-4 | 1-4-5 2-4-4 3-3-4 |

TABLE 13-continued

| 1:36 Index | 2 Dice Combination | 3 Dice Combination |
|---|---|---|
| 11 | 2-5 | 1-2-4 4-4-6 4-5-5 |
| 12 | 2-6 | 1-4-6 3-4-5 |
| 13 | 3-1 | 1-1-6 1-3-4 2-2-4 |
| 14 | 3-2 | 1-2-6 1-3-5 |
| 15 | 3-3 | 2-3-5 |
| 16 | 3-4 | 1-3-3 2-2-3 3-5-6 |
| 17 | 3-5 | 2-3-6 3-3-5 3-4-4 |
| 18 | 3-6 | 1-5-5 2-5-5 3-3-6 4-4-5 |
| 19 | 4-1 | 1-4-4 2-2-5 2-2-6 2-3-3 |
| 20 | 4-2 | 1-4-5 2-4-4 3-3-4 |
| 21 | 4-3 | 1-3-3 2-2-3 3-5-6 |
| 22 | 4-4 | 2-4-5 |
| 23 | 4-5 | 1-5-6 2-4-6 |
| 24 | 4-6 | 1-6-6 3-4-6 3-5-5 |
| 25 | 5-1 | 1-3-6 2-3-4 |
| 26 | 5-2 | 1-2-4 4-4-6 4-5-5 |
| 27 | 5-3 | 2-3-6 3-3-5 3-4-4 |
| 28 | 5-4 | 1-5-6 2-4-6 |
| 29 | 5-5 | 2-5-6 |
| 30 | 5-6 | 3-6-6 4-5-6 5-5-6 |
| 31 | 6-1 | 1-1-1 1-1-5 2-2-2 2-6-6 3-3-3 4-4-4 5-5-5 6-6-6 |
| 32 | 6-2 | 1-4-6 3-4-5 |
| 33 | 6-3 | 1-5-5 2-5-5 3-3-6 4-4-5 |
| 34 | 6-4 | 1-6-6 3-4-6 3-5-5 |
| 35 | 6-5 | 3-6-6 4-5-6 5-5-6 |
| 36 | 6-6 | 4-6-6 5-6-6 |

Table 14 shows another view of the data in the map in Table 12, with the 56 distinct 3-dice rolls mapped to the distinct 21 identifiers, which represent each possible indistinguishable 2-dice roll.

TABLE 14

| 1:21 Index | 2 Dice Combination | 3 Dice Combination |
|---|---|---|
| 1. (1) | 1-1 | 1-1-2 1-1-3 |
| 2. (2) | 1-2 | 1-1-4 1-2-2 1-2-3 |
| 3. (3) | 1-3 | 1-1-6 1-3-4 2-2-4 |
| 4. (4) | 1-4 | 1-4-4 2-2-5 2-2-6 2-3-3 |
| 5. (5) | 1-5 | 1-3-6 2-3-4 |
| 6. (6) | 1-6 | 1-1-1 1-1-5 2-2-2 2-6-6 3-3-3 4-4-4 5-5-5 6-6-6 |
| 7. (8) | 2-2 | 1-2-5 |
| 8. (9) | 2-3 | 1-2-6 1-3-5 |
| 9. (10) | 2-4 | 1-4-5 2-4-4 3-3-4 |
| 10. (11) | 2-5 | 1-2-4 4-4-6 4-5-5 |
| 11. (12) | 2-6 | 1-4-6 3-4-5 |
| 12. (15) | 3-3 | 2-3-5 |
| 13. (16) | 3-4 | 1-3-3 2-2-3 3-5-6 |
| 14. (17) | 3-5 | 2-3-6 3-3-5 3-4-4 |
| 15. (18) | 3-6 | 1-5-5 2-5-5 3-3-6 4-4-5 |
| 16. (22) | 4-4 | 2-4-5 |
| 17. (23) | 4-5 | 1-5-6 2-4-6 |
| 18. (24) | 4-6 | 1-6-6 3-4-6 3-5-5 |
| 19. (29) | 5-5 | 2-5-6 |
| 20. (30) | 5-6 | 3-6-6 4-5-6 5-5-6 |
| 21. (36) | 6-6 | 4-6-6 5-6-6 |

Table 15 shows yet another view of the data in the map in Table 12, with the resulting mapping of 2-dice and 3-dice points revealing its perfect bi-lateral symmetry across both the 2 and 3-dice point ranges and the nearly perfect one-to-one association of point numbers.

TABLE 15

| 3 Dice Point | 2 Dice Point |
|---|---|
| 3 | 7 |
| 4 | 2 2 2 |

TABLE 15-continued

| 3 Dice Point | 2 Dice Point |
|---|---|
| 5 | 2 3 2 3 3 2 |
| 6 | 3 3 3 3 3 7 3 3 3 3 |
| 7 | 7 7 7 7 7 7 7 7 7 7 7 7 7 7 7 |
| 8 | 4 4 4 4 4 4 4 4 5 4 4 4 5 5 4 4 4 4 4 4 4 |
| 9 | 5 5 5 5 5 5 5 6 6 5 5 5 6 7 6 5 5 6 6 5 5 5 5 5 |
| 10 | 6 6 6 6 5 6 6 6 5 6 6 6 6 6 6 6 6 6 6 6 6 6 6 6 5 6 |
| 11 | 8 9 8 8 8 8 8 8 8 8 8 8 8 8 8 8 8 8 9 8 8 8 9 8 8 8 8 |
| 12 | 9 9 9 9 9 9 8 8 9 9 8 7 8 9 9 9 8 8 9 9 9 9 9 9 |
| 13 | 10 10 10 10 10 10 10 10 9 9 10 10 10 9 10 10 10 10 10 10 10 10 |
| 14 | 7 7 7 7 7 7 7 7 7 7 7 7 7 7 |
| 15 | 11 11 11 11 7 11 11 11 11 11 |
| 16 | 12 11 11 12 11 12 |
| 17 | 12 12 12 |
| 18 | 7 |

As previously stated, often times multiple fair mappings can be defined between a given input data set and a given output data set. This particular mapping between 3-dice rolls and 2-dice rolls enables multiple craps-like games to be played, based upon two-dice and three-dice rolls, in which there are common goals and objectives played in the games concurrently.

The mapping concepts of this invention satisfy the need for new mapping schemes that will enable the development and play of new games and gaming methods. For example, there is a desire to map all of the table-out rolls used in various 3-dice games, such as the applicant's proprietary game known as TDC__7__14_Trips_out (7s, 14s, and all Triples), to all of the 2-dice game's table-out rolls (the number 7). By doing so, the two disparate games will synchronize game phases when played, so players of both games will desire the same roll outcomes concurrently. In addition, the Table 15 map of this invention provides perfect bi-lateral symmetry across both the 2-dice and 3-dice point ranges, and also provides a nearly perfect one-to-one association of point numbers mapped.

The 3-dice to 2-dice map, along with other maps in the preferred embodiment allow players to make a 3-dice roll, and the outcome can be used concurrently for all of the following: 3-dice games, 1-36 range games, 2-dice games, 1-18 range games, 1-12 range games, 1-9 range games, 1-6 range games (e.g., 1-die games), 1-4 range games, 1-3 range games, and 1-2 range games. Of course, these game ranges are cited by way of examples and are not to be construed as all-inclusive ranges.

In one preferred embodiment of the invention, depicted schematically in FIG. 3, a single die roll 20 is mapped to outcomes associated with various wagering games 22, 24, 26. The apparatus accepts as input 20 a single selection from the range of 1 to 6, and outputs a set of 3 results; the first is the input value (the die roll input from the 1 to 6 range set), the next value is mapped into a value in the range of 1 to 2, and the last is mapped into a value in the range of 1 to 3. The casino can thus provide multiple games fed by this invention, for example, "Coin Flip" 24 can be fed by the 1 to 2 randomization range output, "Rock, Paper, Scissors" 26 can be fed by the 1 to 3 range output, and "Six Geese" 22 fed by the 1 to 6 range. Note also that the invention can accept a number in the range of 1 to 6 and map that to a 1-dice roll, to be used as input, as described above. This allows alternative randomization generators, i.e., randomizer machines, to be used. As an example of an alternative randomizer machine to the die 20, a six-position spinning wheel (not shown) can be used to generate the 1 to 6-range input, and the results used in games based upon 1-dice rolls.

Figure 4:
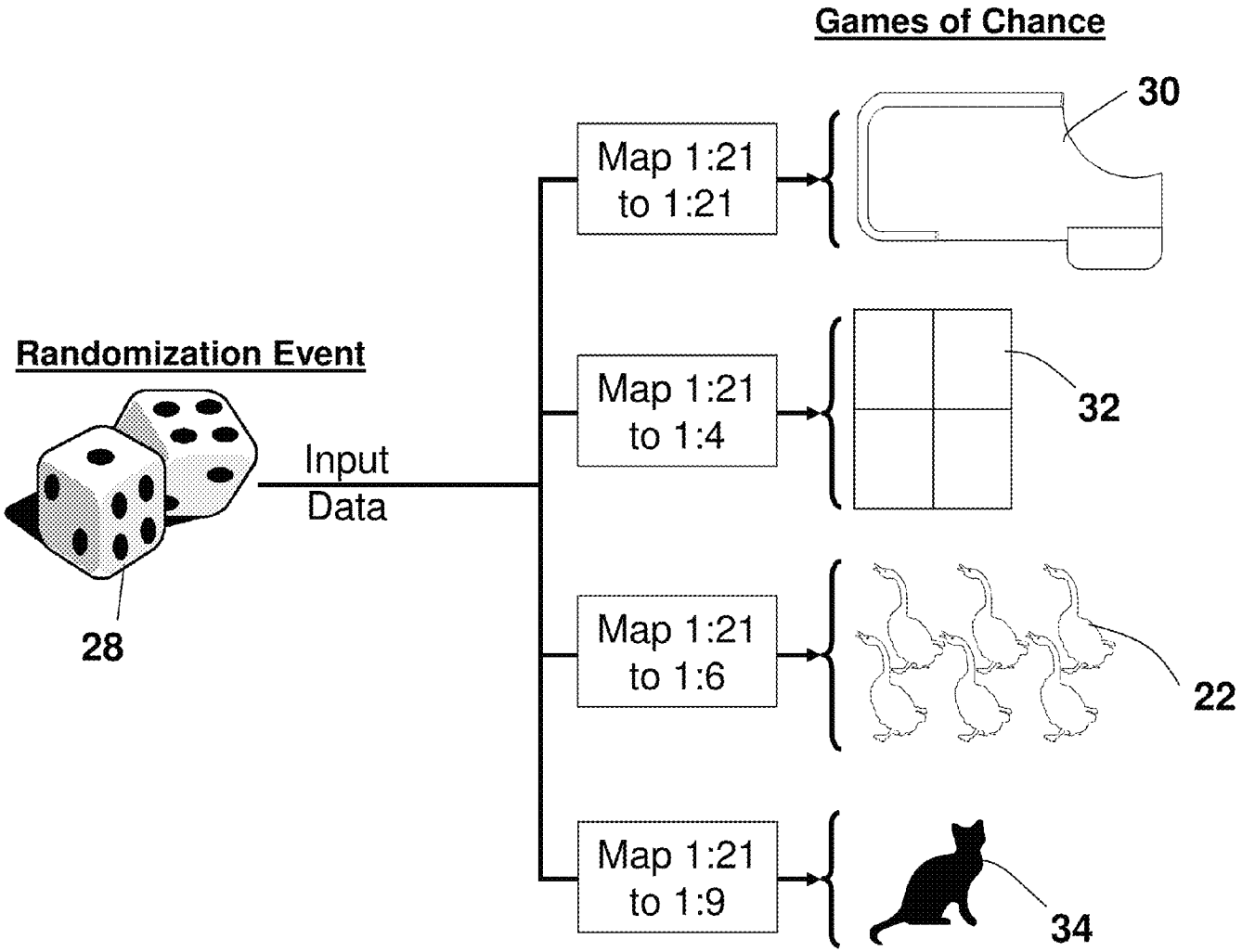
FIG. 4 is a schematic view as in FIG. 3, but showing the concurrent mapping of a two indistinguishable dice roll as input data to concurrent games of chance in the 1:4, 1:6, 1:9 and 1:21 output ranges.

In another example of the invention as shown schematically in FIG. 4, a single two-dice roll 28, using six-sided, indistinguishable dice, is mapped to outcomes associated with various disparate wagering games 22, 30, 32 and 34. The invention accepts as input a single selection from the range of the 21 distinct rolls 28, and outputs a set of 4 results; the first is the input value (the two dice roll input from the 1 to 21 range set), the next value is mapped into a value in the range of 1 to 4, the next value is mapped into a value in the range of 1 to 6, and the last is mapped into a value in the range of 1 to 9. The casino can thus provide multiple disparate games fed by the game system, for example, "Traditional Craps" 30 can be fed by the 1 to 21 randomization range output, "Four Queens" 32 can be feed by the 1 to 4 range output, "Six Geese" 22 fed by the 1 to 6 range output, and "Cat-O-Nine-Tails" 34 fed by the 1 to 9 range output. Note that the 1 to 6 range output can also be used as input for the embodiment described above, additionally providing a 1 to 2 and a 1 to 3 range output, as well.

Figure 5:
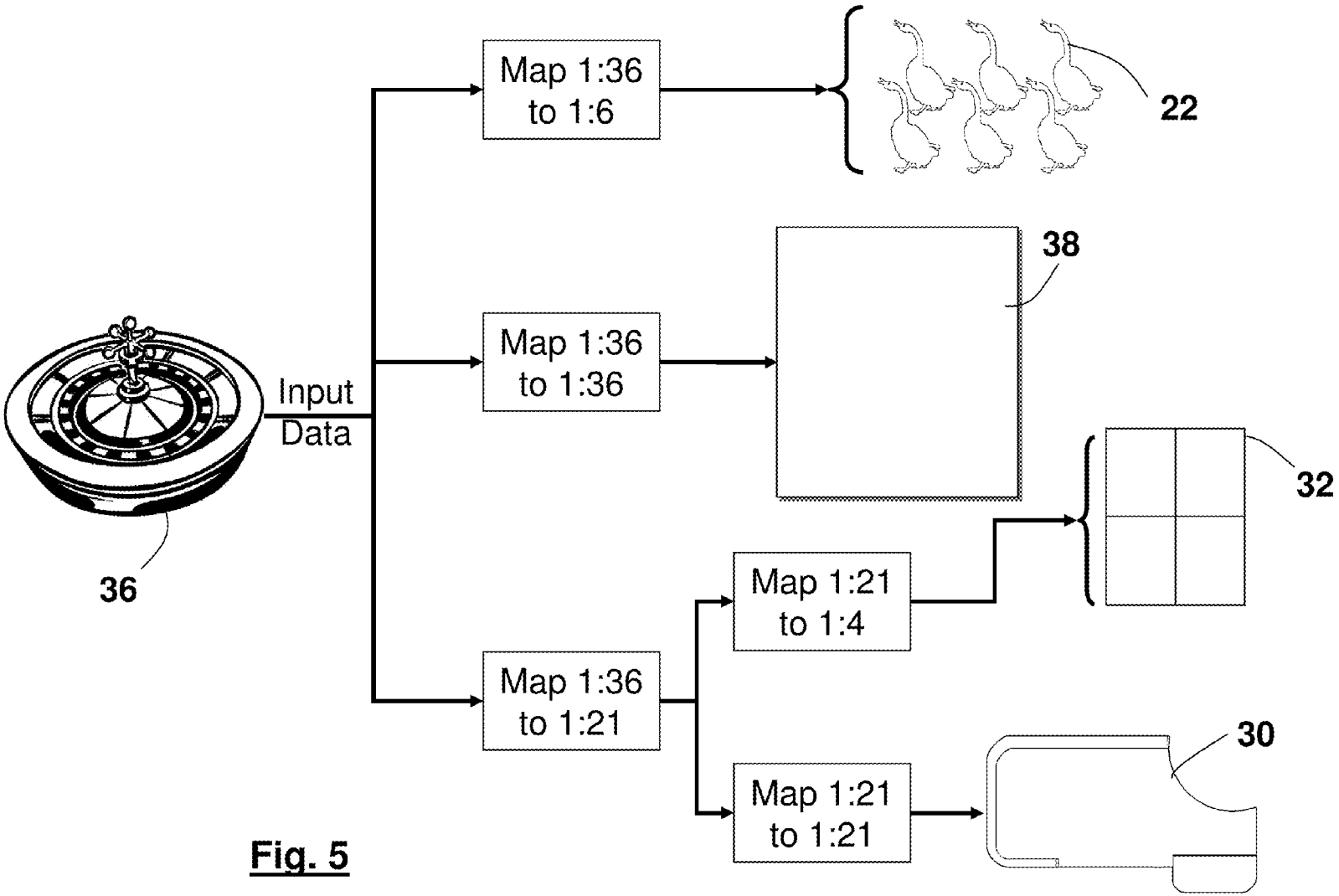
FIG. 5 is a schematic representation of the subject invention as in FIGS. 3 and 4, but showing the mapping of a 36 slot spinning wheel to multiple games of chance having decision ranges in the 1:4, 1:6, 1:21 and 1:36 output ranges.

FIG. 5 depicts yet another example of this invention and can accept a number in the range of 1 to 36 and map that to a 2-dice roll 28, to be used as input, as described above. This allows alternative randomization generators to be used; in this case, a 36-position spinning wheel 36 can be used to generate the 1 to 36-range input, and the results used in games 30, 32 based upon 2-dice rolls. Also shown here are the 1:36 input data from the randomizer machine 36 mapped to the "Six Geese" game 22 as well as a non-traditional "No-Zero" game of roulette 38 that operates on a 1:36 range. I.e., the so-called "zero-map" for the randomizer machine 36.

Tables 16-18 below set forth mapping of a 1:36 input to games of chance having output data ranges of 1:4, 1:6 and 1:9, respectively.

TABLE 16

The 36 - 1:4 range map

| 1:4 Index | Dice Combinations |
|---|---|
| 1 | 1-1, 1-2, 2-1, 1-3, 3-1, 1-4, 4-1, 2-3, 3-2 |
| 2 | 1-5, 5-1, 1-6, 6-1, 2-2, 2-4, 4-2, 2-6, 6-2 |
| 3 | 3-3, 4-4, 5-5, 2-5, 5-2, 3-4, 4-3, 3-5, 5-3 |
| 4 | 4-5, 5-4, 3-6, 6-3, 4-6, 6-4, 5-6, 6-5, 6-6 |

TABLE 17

The 36 - 1:6 range map

| 1:6 Index | Dice Combinations |
|---|---|
| 1 | 1-1, 1-2, 2-1, 1-3, 2-2, 3-1 |
| 2 | 1-4, 2-3, 3-2, 4-1, 1-5, 5-1 |
| 3 | 2-4, 3-3, 4-2, 2-6, 4-4, 6-2 |
| 4 | 1-6, 2-5, 3-4, 4-3, 5-2, 6-1 |
| 5 | 3-5, 5-3, 3-6, 4-5, 5-4, 6-3 |
| 6 | 4-6, 5-5, 6-4, 5-6, 6-5, 6-6 |

TABLE 18

The 36 - 1:9 range map

| 1:9 Index | Dice Combinations |
|---|---|
| 1 | 1-1, 1-2, 2-1, 2-2 |
| 2 | 1-3, 3-1, 1-4, 4-1 |
| 3 | 2-3, 3-2, 1-5, 5-1 |
| 4 | 2-4, 4-2, 3-3, 4-4 |
| 5 | 2-6, 6-2, 1-6, 6-1 |
| 6 | 2-5, 5-2, 3-4, 4-3 |

TABLE 18-continued

| The 36 - 1:9 range map | |
|---|---|
| 1:9 Index | Dice Combinations |
| 7 | 3-5, 5-3, 4-5, 5-4 |
| 8 | 3-6, 6-3, 4-6, 6-4 |
| 9 | 5-6, 6-5, 5-5, 6-6 |

Figure 5A:
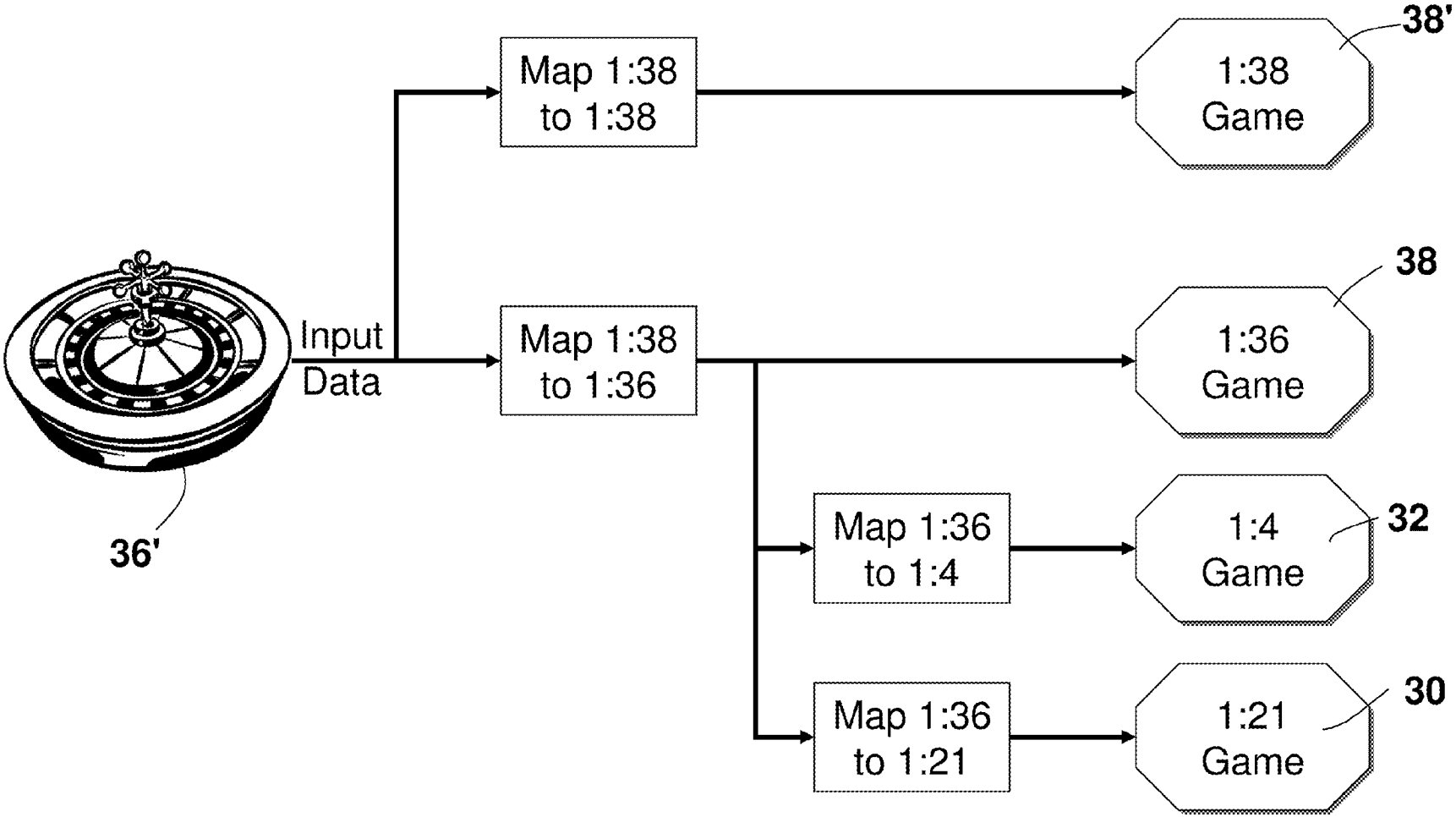
FIG. 5A is a view as in FIG. 5, but depicting a traditional 38 slot roulette wheel as the randomizer machine with mappings provided to multiple disparate games of chance.

FIG. 5A is similar to FIG. 5, but utilizes a standard (U.S.) thirty-eight slot roulette wheel 36' for the randomizer machine. According to this technique, the input data range is 1:38, and can be mapped to game ranges of 1:36 and 1:21, as well as all the zero-map (1:38) which can be used to play traditional (U.S.) roulette 38'. Mappings of a 1:38 input to games of chance having output data ranges of 1:36 are accomplished via the 1:36 map (Table 7) with the 0 and 00 considered null values. In other words, the 1:38 map relies on a 1:36 map to 1:36 with 0 mapped to NULL and 00 mapped to NULL. The output data ranges can, in turn, be mapped to other games of chance 30, 32 as described above in connection with FIG. 4. For example, all games shown in FIG. 5A fed from the 1:36 range will preferably be structured to accept a NULL value. The 2-dice roll (also referred to as a 1:21 input) results from a forward lookup in Table 7. All games can accept as input a NULL value, which is treated just like the CANCEL button in "All Bets Down" state.

Figure 6:
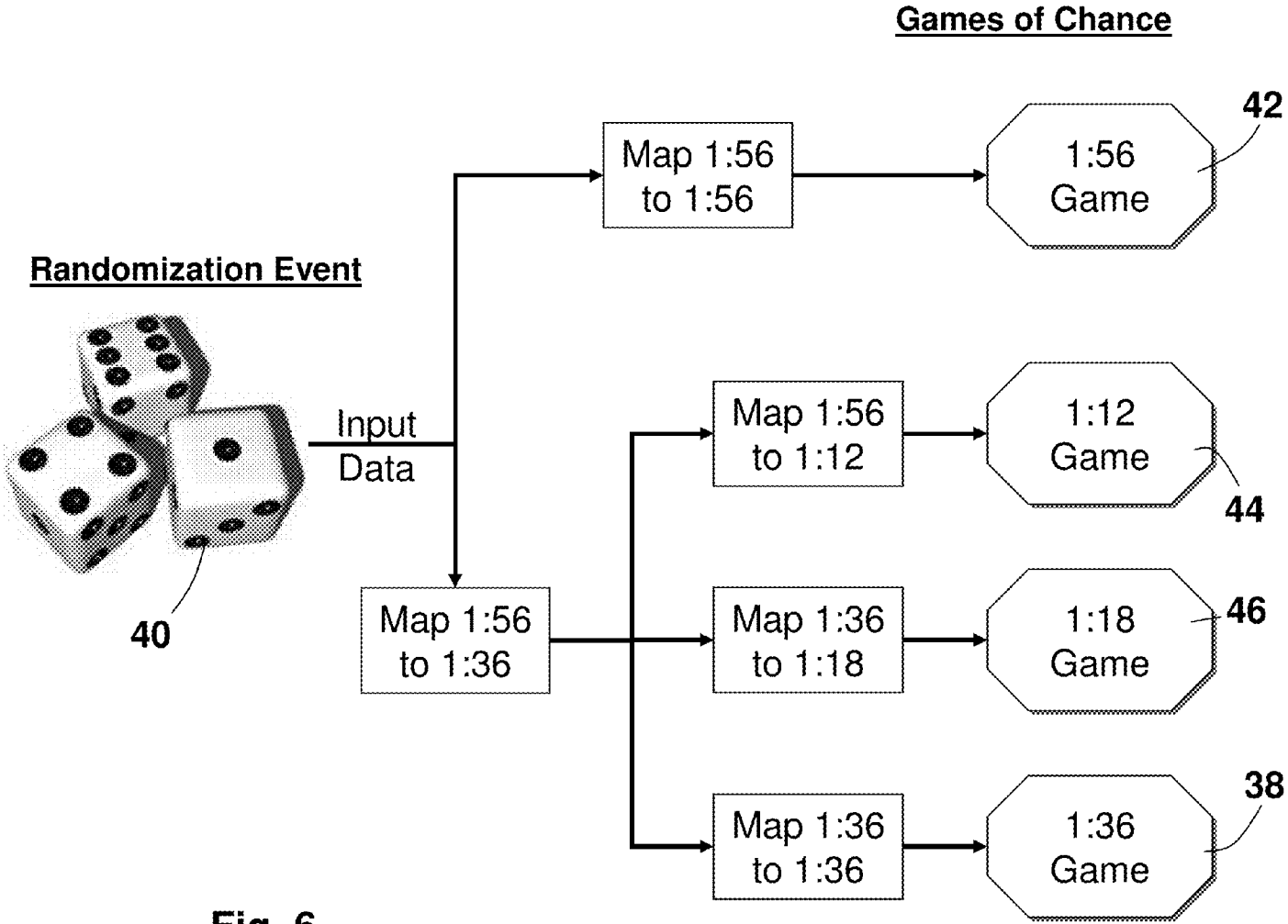
FIG. 6 is a schematic view as in FIG. 4, but depicting the mapping of a randomization event achieved by rolling three indistinguishable dice to concurrent games of chance having decision ranges of 1:12, 1:18, 1:36 and 1:56.

FIG. 6 shows yet another preferred embodiment of the invention, wherein a single three-dice roll 40, using six-sided, indistinguishable dice, is mapped to outcomes associated with various wagering games 38, 42, 44 and 46. The apparatus accepts as input a single selection from the range of the 56 distinct rolls, and outputs a set of four results: the first is the input value (the three dice roll input from the 1 to 56 range set), the next value is mapped into a value in the range of 1 to 12 (via an interim 1:36 map), the next value is mapped into a value in the range of 1 to 18 (again via the interim 1:36 map), and the last is mapped into a value in the range of 1 to 36 (using the zero map from the interim 1:36 map). The casino can thus provide multiple games fed by the apparatus, for example, "3-dice Craps" and "Ricochet" 42 can be fed by the 1 to 56 randomization range output, "Baker's Dozen" 44 can be fed by the 1 to 12 range output, "18 Indians" 46 fed by the 1 to 18 range output, and "No Zero Roulette" 38 fed by the 1 to 36 range output.

Figure 7:
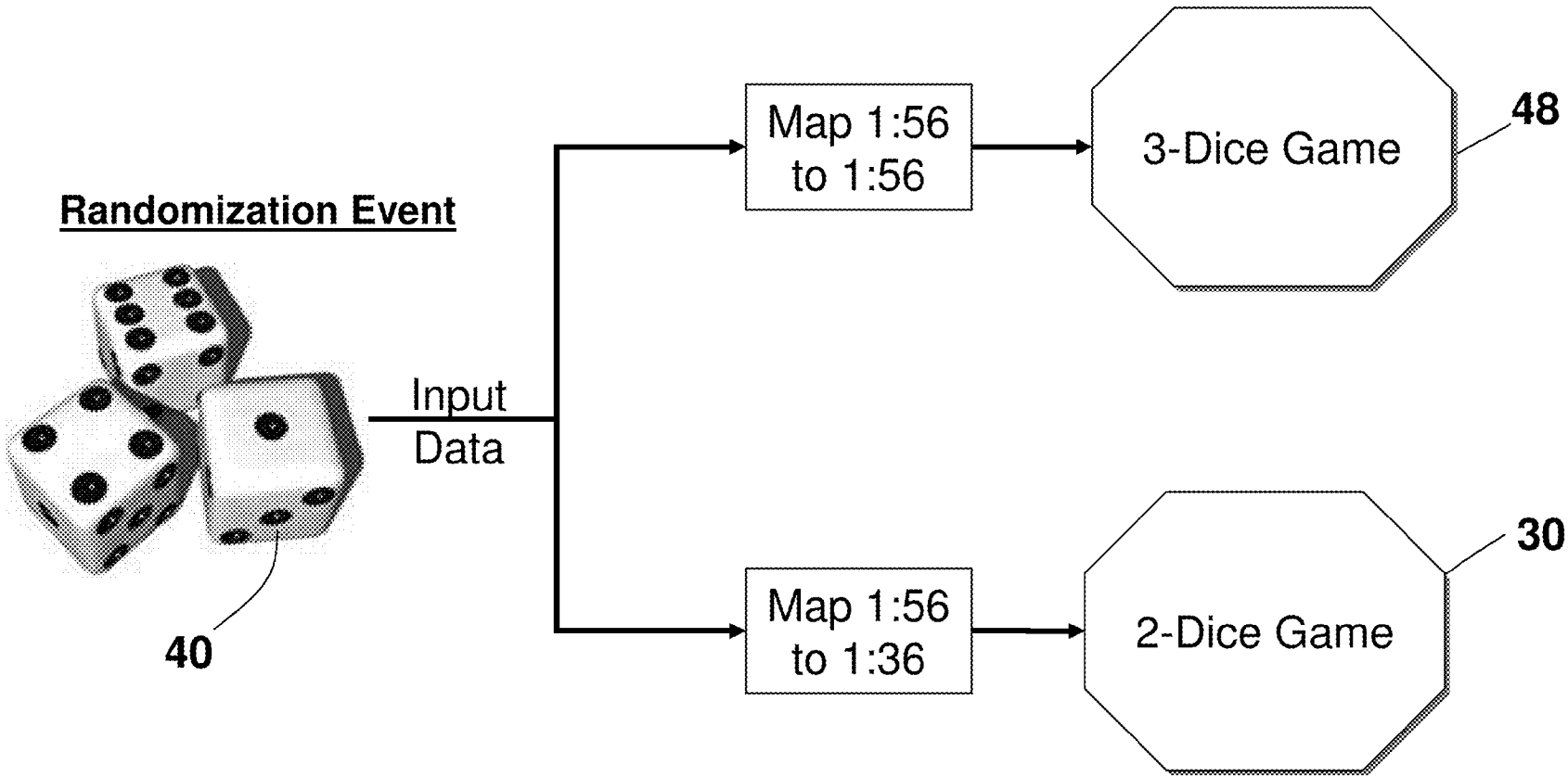
FIG. 7 is a schematic view as in FIG. 6, but depicting an implementation of the subject invention wherein a 3 dice game of chance is played concurrently with a 2 dice game of chance, the simultaneous resolutions of which are based on the roll of three indistinguishable dice.

As depicted in FIG. 7, the 1 to 36 range output 40 can also be used as input for the embodiment described above, additionally providing all of the 2-dice mappings and their permutations, providing 3-dice game players the capability to play 2-dice games like "Traditional Craps" 30, right along with the 3-dice games 48. Note also that the invention can accept a number in the range of 1 to 216 and map that to a 3-dice roll 40, to be used as input, as described above. This allows alternative randomization generators to be used; in this case, a 216-position spinning wheel (not shown) can be used to generate the 1 to 216-range input, and the results used in games based upon 3-dice rolls 40.

Figure 8:
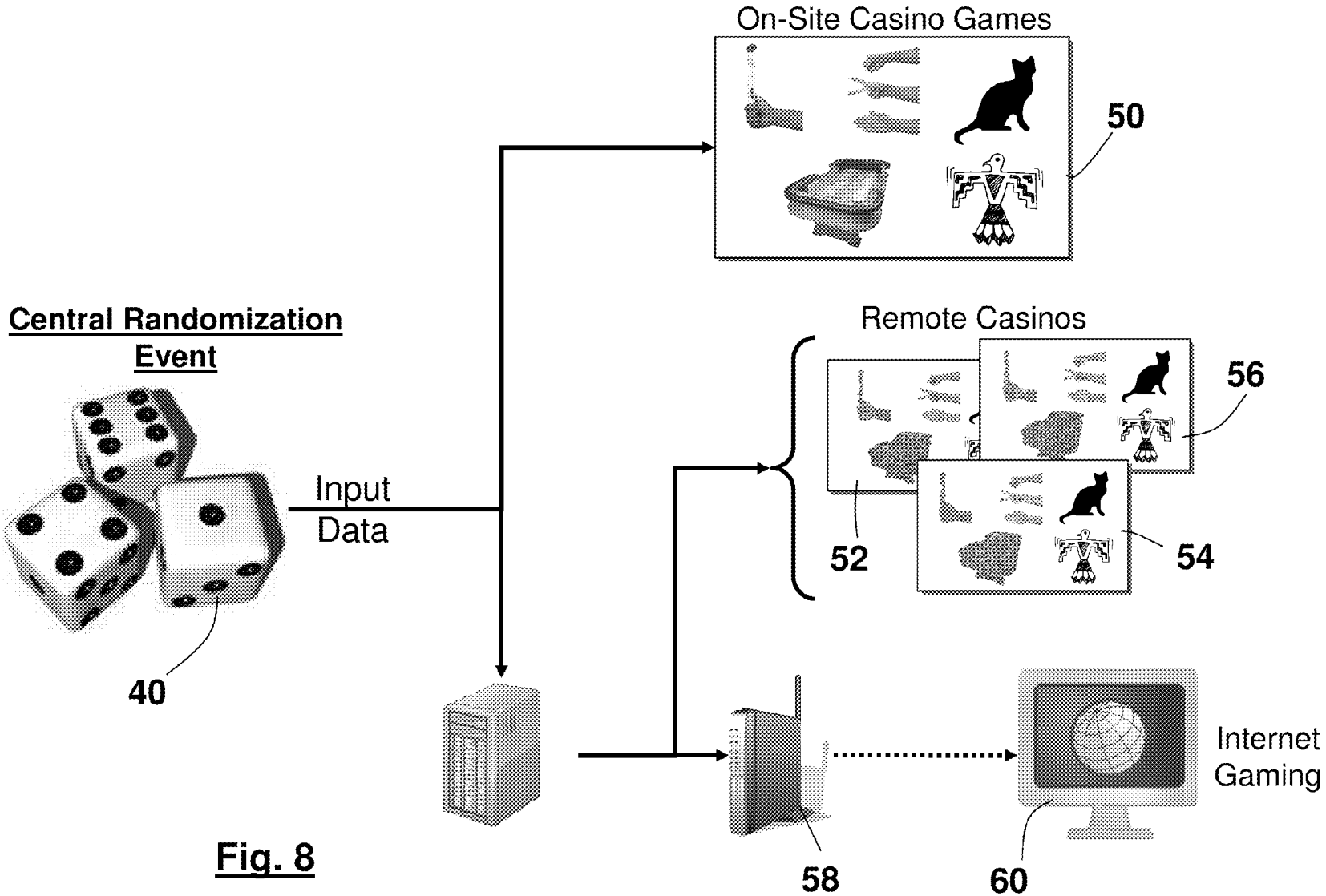
FIG. 8 is a schematic view of the subject invention depicting a method in which a single centralized randomization event, for example the roll of three indistinguishable six-sided dice, can be used to resolve multiple on-sight casino games, as well as casino games in remote casinos and even games of chance played via live internet gaming.
Figure 9:
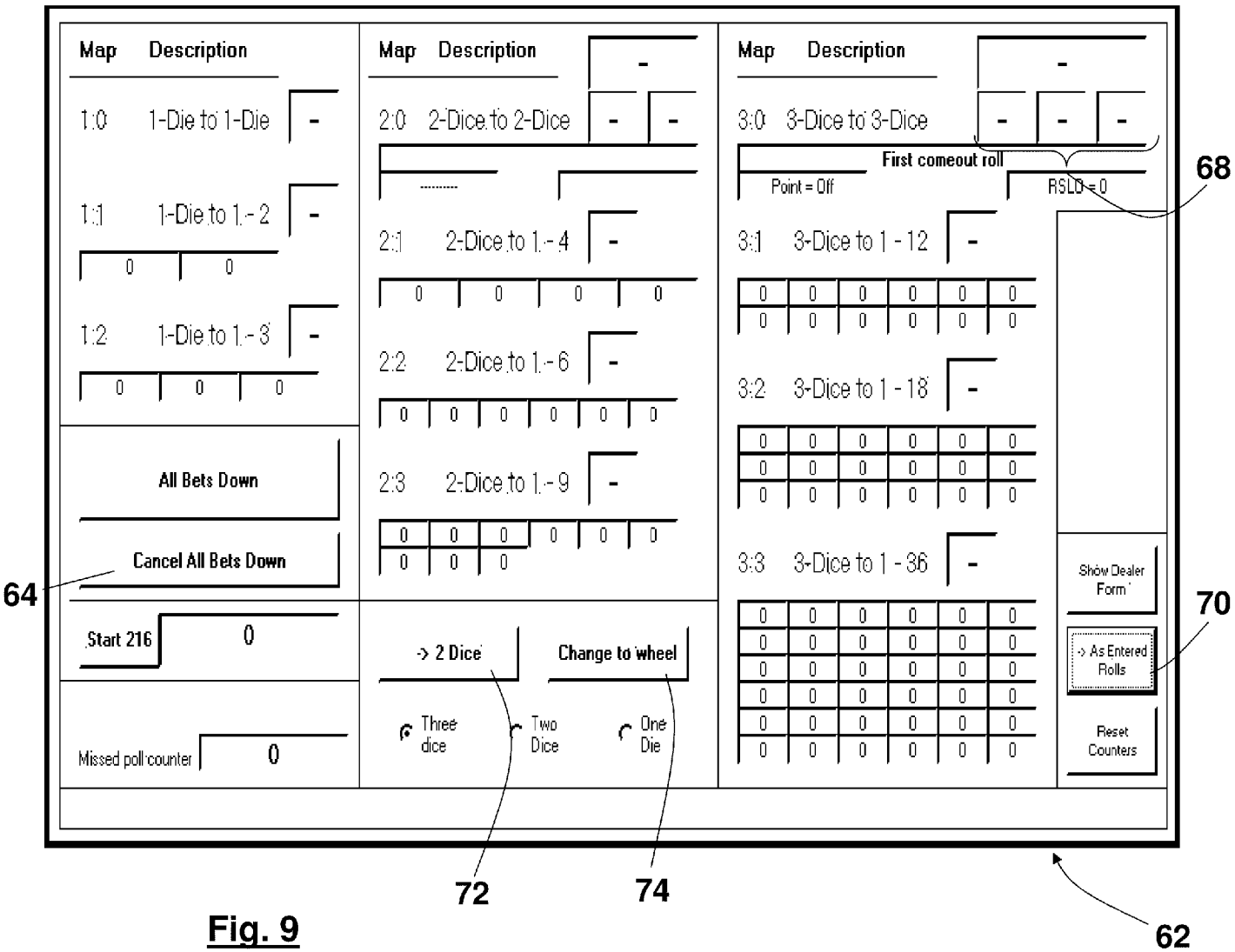
FIGS. 9-12 are screen shots from a graphic user interface (GUI) operatively associated with a computer processor implementing the method of this invention.
Figure 10:
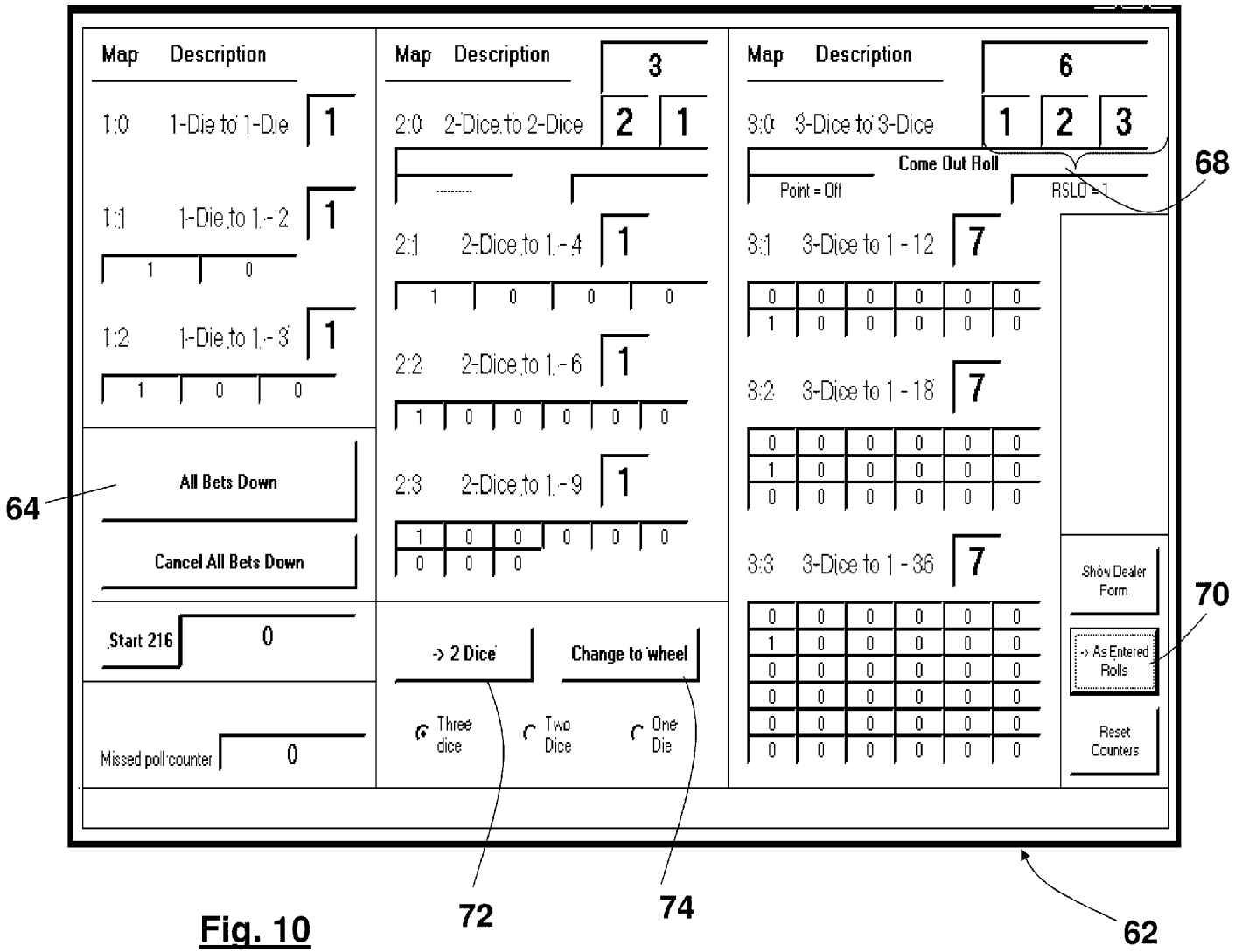
Figure 11:
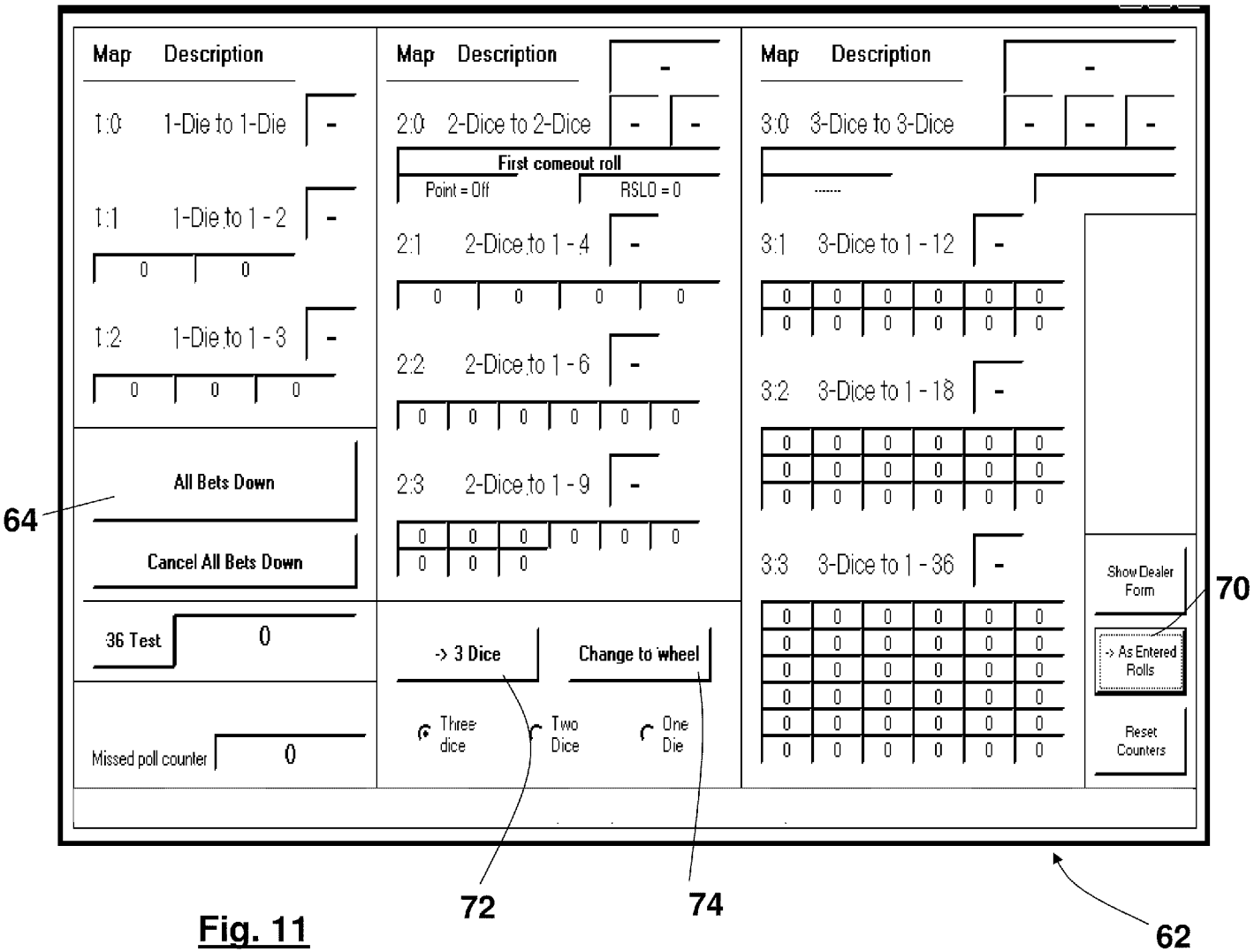

Furthermore, this invention facilitates displaying the outcome of the live random event and all of the various outcomes of wagering games mapped from the live random event, and also facilitates broadcasting these results to other computer systems running various games. In this example, illustrated schematically in FIG. 8, a single three dice roll 40 can concurrently feed multiple games played in multiple casino locations 50, 52, 54, 56 and also over computer networks 58 to games played in remote locations and via the internet 60.

As mentioned prior, in a number of preferred embodiments of the invention, an output set of numbers may comprise an equal number of each unique numeral output (i.e. fair odds systems). However, in other embodiments of the invention each unique numeral output may not repeat equally (i.e. an unfair odds system, as demonstrated in Table 3). The invention may employ a fair odds or unfair odds system.

Table 19 represents a map starting from a 1:56 input (e.g., an indistinguishable 3-dice roll) to a 1:36 range. Then from the 1:36 range maps are provided to: a 2-dice roll, a 1:18 range, a 1:12 range, a 1:9 range, a 1:6 range (e.g., a 1-die roll), a 1:4 range, a 1:3 range (e.g., rock-paper-scissor), and a 1:2 range (e.g., coin flip).

TABLE 19

| 1:56 Index | 3-Dice Combination | | | 3-Dice Point | 1:36 Index | 2-Dice Combination | | 2-Dice Point | 1:18 Index | 1:12 Index | 1:9 Index | 1:6 Index | 1:4 Index | 1:3 Index | 1:2 Index |
|---|---|---|---|---|---|---|---|---|---|---|---|---|---|---|---|
| 1 | 1 | 1 | 1 | 3 | 6 | 1 | 6 | 7 | 6 | 6 | 5 | 4 | 2 | 2 | 2 |
| 2 | 1 | 1 | 2 | 4 | 1 | 1 | 1 | 2 | 1 | 1 | 1 | 1 | 1 | 1 | 1 |
| 3 | 1 | 1 | 3 | 5 | 1 | 1 | 1 | 2 | 1 | 1 | 1 | 1 | 1 | 1 | 1 |
| 4 | 1 | 1 | 4 | 6 | 2 | 1 | 2 | 3 | 2 | 2 | 1 | 1 | 1 | 1 | 1 |
| 5 | 1 | 1 | 5 | 7 | 6 | 1 | 6 | 7 | 6 | 6 | 5 | 4 | 2 | 2 | 2 |
| 6 | 1 | 1 | 6 | 8 | 3 | 1 | 3 | 4 | 3 | 3 | 2 | 1 | 1 | 1 | 1 |
| 7 | 1 | 2 | 2 | 5 | 2 | 1 | 2 | 3 | 2 | 2 | 1 | 1 | 1 | 1 | 1 |
| 8 | 1 | 2 | 3 | 6 | 7 | 2 | 1 | 3 | 7 | 7 | 1 | 1 | 1 | 1 | 1 |
| 9 | 1 | 2 | 4 | 7 | 11 | 2 | 5 | 7 | 11 | 11 | 6 | 4 | 3 | 2 | 2 |
| 10 | 1 | 2 | 5 | 8 | 8 | 2 | 2 | 4 | 8 | 8 | 1 | 1 | 2 | 1 | 1 |
| 11 | 1 | 2 | 6 | 9 | 9 | 2 | 3 | 5 | 9 | 9 | 3 | 2 | 1 | 1 | 1 |
| 12 | 1 | 3 | 3 | 7 | 16 | 3 | 4 | 7 | 16 | 4 | 6 | 4 | 3 | 2 | 2 |
| 13 | 1 | 3 | 4 | 8 | 13 | 3 | 1 | 4 | 13 | 1 | 2 | 1 | 1 | 1 | 1 |
| 14 | 1 | 3 | 5 | 9 | 14 | 3 | 2 | 5 | 14 | 2 | 3 | 2 | 1 | 1 | 1 |
| 15 | 1 | 3 | 6 | 10 | 5 | 1 | 5 | 6 | 5 | 5 | 3 | 2 | 2 | 1 | 1 |
| 16 | 1 | 4 | 4 | 9 | 4 | 1 | 4 | 5 | 4 | 4 | 2 | 2 | 1 | 1 | 1 |
| 17 | 1 | 4 | 5 | 10 | 10 | 2 | 4 | 6 | 10 | 10 | 4 | 3 | 2 | 2 | 1 |
| 18 | 1 | 4 | 6 | 11 | 32 | 6 | 2 | 8 | 14 | 8 | 5 | 3 | 2 | 2 | 1 |
| 19 | 1 | 5 | 5 | 11 | 18 | 3 | 6 | 9 | 18 | 6 | 8 | 5 | 4 | 3 | 2 |
| 20 | 1 | 5 | 6 | 12 | 28 | 5 | 4 | 9 | 10 | 4 | 7 | 5 | 4 | 3 | 2 |
| 21 | 1 | 6 | 6 | 13 | 34 | 6 | 4 | 10 | 16 | 10 | 8 | 6 | 4 | 3 | 2 |
| 22 | 2 | 2 | 2 | 6 | 6 | 1 | 6 | 7 | 6 | 6 | 5 | 4 | 2 | 2 | 2 |
| 23 | 2 | 2 | 3 | 7 | 16 | 3 | 4 | 7 | 16 | 4 | 6 | 4 | 3 | 2 | 2 |
| 24 | 2 | 2 | 4 | 8 | 3 | 1 | 3 | 4 | 3 | 3 | 2 | 1 | 1 | 1 | 1 |
| 25 | 2 | 2 | 5 | 9 | 19 | 4 | 1 | 5 | 1 | 7 | 2 | 2 | 1 | 1 | 1 |
| 26 | 2 | 2 | 6 | 10 | 19 | 4 | 1 | 5 | 1 | 7 | 2 | 2 | 1 | 1 | 1 |

TABLE 19-continued

| 1:56 Index | 3-Dice Combination | | | 3-Dice Point | 1:36 Index | 2-Dice Combination | | 2-Dice Point | 1:18 Index | 1:12 Index | 1:9 Index | 1:6 Index | 1:4 Index | 1:3 Index | 1:2 Index |
|---|---|---|---|---|---|---|---|---|---|---|---|---|---|---|---|
| 27 | 2 | 3 | 3 | 8 | 4 | 1 | 4 | 5 | 4 | 4 | 2 | 2 | 1 | 1 | 1 |
| 28 | 2 | 3 | 4 | 9 | 25 | 5 | 1 | 6 | 7 | 1 | 3 | 2 | 2 | 1 | 1 |
| 29 | 2 | 3 | 5 | 10 | 15 | 3 | 3 | 6 | 15 | 3 | 4 | 3 | 3 | 2 | 1 |
| 30 | 2 | 3 | 6 | 11 | 27 | 5 | 3 | 8 | 9 | 3 | 7 | 5 | 3 | 3 | 2 |
| 31 | 2 | 4 | 4 | 10 | 20 | 4 | 2 | 6 | 2 | 8 | 4 | 3 | 2 | 2 | 1 |
| 32 | 2 | 4 | 5 | 11 | 22 | 4 | 4 | 8 | 4 | 10 | 4 | 3 | 3 | 2 | 1 |
| 33 | 2 | 4 | 6 | 12 | 23 | 4 | 5 | 9 | 5 | 11 | 7 | 5 | 4 | 3 | 2 |
| 34 | 2 | 5 | 5 | 12 | 33 | 6 | 3 | 9 | 15 | 9 | 8 | 5 | 4 | 3 | 2 |
| 35 | 2 | 5 | 6 | 13 | 29 | 5 | 5 | 10 | 11 | 5 | 9 | 6 | 3 | 3 | 2 |
| 36 | 2 | 6 | 6 | 14 | 31 | 6 | 1 | 7 | 13 | 7 | 5 | 4 | 2 | 2 | 2 |
| 37 | 3 | 3 | 3 | 9 | 6 | 1 | 6 | 7 | 6 | 6 | 5 | 4 | 2 | 2 | 2 |
| 38 | 3 | 3 | 4 | 10 | 20 | 4 | 2 | 6 | 2 | 8 | 4 | 3 | 2 | 2 | 1 |
| 39 | 3 | 3 | 5 | 11 | 17 | 3 | 5 | 8 | 17 | 5 | 7 | 5 | 3 | 3 | 2 |
| 40 | 3 | 3 | 6 | 12 | 18 | 3 | 6 | 9 | 18 | 6 | 8 | 5 | 4 | 3 | 2 |
| 41 | 3 | 4 | 4 | 11 | 17 | 3 | 5 | 8 | 17 | 5 | 7 | 5 | 3 | 3 | 2 |
| 42 | 3 | 4 | 5 | 12 | 12 | 2 | 6 | 8 | 12 | 12 | 5 | 3 | 2 | 2 | 1 |
| 43 | 3 | 4 | 6 | 13 | 24 | 4 | 6 | 10 | 6 | 12 | 8 | 6 | 4 | 3 | 2 |
| 44 | 3 | 5 | 5 | 13 | 34 | 6 | 4 | 10 | 16 | 10 | 8 | 6 | 4 | 3 | 2 |
| 45 | 3 | 5 | 6 | 14 | 21 | 4 | 3 | 7 | 3 | 9 | 6 | 4 | 3 | 2 | 2 |
| 46 | 3 | 6 | 6 | 15 | 35 | 6 | 5 | 11 | 17 | 11 | 9 | 6 | 4 | 3 | 2 |
| 47 | 4 | 4 | 4 | 12 | 31 | 6 | 1 | 7 | 13 | 7 | 5 | 4 | 2 | 2 | 2 |
| 48 | 4 | 4 | 5 | 13 | 33 | 6 | 3 | 9 | 15 | 9 | 8 | 5 | 4 | 3 | 2 |
| 49 | 4 | 4 | 6 | 14 | 26 | 5 | 2 | 7 | 8 | 2 | 6 | 4 | 3 | 2 | 2 |
| 50 | 4 | 5 | 5 | 14 | 26 | 5 | 2 | 7 | 8 | 2 | 6 | 4 | 3 | 2 | 2 |
| 51 | 4 | 5 | 6 | 15 | 30 | 5 | 6 | 11 | 12 | 6 | 9 | 6 | 4 | 3 | 2 |
| 52 | 4 | 6 | 6 | 16 | 36 | 6 | 6 | 12 | 18 | 12 | 9 | 6 | 4 | 3 | 2 |
| 53 | 5 | 5 | 5 | 15 | 31 | 6 | 1 | 7 | 13 | 7 | 5 | 4 | 2 | 2 | 2 |
| 54 | 5 | 5 | 6 | 16 | 35 | 6 | 5 | 11 | 17 | 11 | 9 | 6 | 4 | 3 | 2 |
| 55 | 5 | 6 | 6 | 17 | 36 | 6 | 6 | 12 | 18 | 12 | 9 | 6 | 4 | 3 | 2 |
| 56 | 6 | 6 | 6 | 18 | 31 | 6 | 1 | 7 | 13 | 7 | 5 | 4 | 2 | 2 | 2 |

Table 20 represents a map starting from a 1:216 input (e.g., a distinguishable 3-dice roll) to a 1:36 range. Then from the 1:36 range maps are provided to: a 2-dice roll, a 1:18 range, a 1:12 range, a 1:9 range, a 1:6 range (e.g., a 1-die roll), a 1:4 range, a 1:3 range (e.g., rock-paper-scissor), and a 1:2 range (e.g., coin flip).

TABLE 20

| 1:216 Index | 3-Dice Combination | | | 3-Dice Point | 1:36 Index | 2-Dice Combination | | 2-Dice Point | 1:18 Index | 1:12 Index | 1:9 Index | 1:6 Index | 1:4 Index | 1:3 Index | 1:2 Index |
|---|---|---|---|---|---|---|---|---|---|---|---|---|---|---|---|
| 1 | 1 | 1 | 1 | 3 | 6 | 1 | 6 | 7 | 6 | 6 | 5 | 4 | 2 | 2 | 2 |
| 2 | 1 | 1 | 2 | 4 | 1 | 1 | 1 | 2 | 1 | 1 | 1 | 1 | 1 | 1 | 1 |
| 3 | 1 | 1 | 3 | 5 | 1 | 1 | 1 | 2 | 1 | 1 | 1 | 1 | 1 | 1 | 1 |
| 4 | 1 | 1 | 4 | 6 | 2 | 1 | 2 | 3 | 2 | 2 | 1 | 1 | 1 | 1 | 1 |
| 5 | 1 | 1 | 5 | 7 | 6 | 1 | 6 | 7 | 6 | 6 | 5 | 4 | 2 | 2 | 2 |
| 6 | 1 | 1 | 6 | 8 | 3 | 1 | 3 | 4 | 3 | 3 | 2 | 1 | 1 | 1 | 1 |
| 7 | 1 | 2 | 1 | 4 | 1 | 1 | 1 | 2 | 1 | 1 | 1 | 1 | 1 | 1 | 1 |
| 8 | 1 | 2 | 2 | 5 | 2 | 1 | 2 | 3 | 2 | 2 | 1 | 1 | 1 | 1 | 1 |
| 9 | 1 | 2 | 3 | 6 | 7 | 2 | 1 | 3 | 7 | 7 | 1 | 1 | 1 | 1 | 1 |
| 10 | 1 | 2 | 4 | 7 | 11 | 2 | 5 | 7 | 11 | 11 | 6 | 4 | 3 | 2 | 2 |
| 11 | 1 | 2 | 5 | 8 | 8 | 2 | 2 | 4 | 8 | 8 | 1 | 1 | 2 | 1 | 1 |
| 12 | 1 | 2 | 6 | 9 | 9 | 2 | 3 | 5 | 9 | 9 | 3 | 2 | 1 | 1 | 1 |
| 13 | 1 | 3 | 1 | 5 | 1 | 1 | 1 | 2 | 1 | 1 | 1 | 1 | 1 | 1 | 1 |
| 14 | 1 | 3 | 2 | 6 | 7 | 2 | 1 | 3 | 7 | 7 | 1 | 1 | 1 | 1 | 1 |
| 15 | 1 | 3 | 3 | 7 | 16 | 3 | 4 | 7 | 16 | 4 | 6 | 4 | 3 | 2 | 2 |
| 16 | 1 | 3 | 4 | 8 | 13 | 3 | 1 | 4 | 13 | 1 | 2 | 1 | 1 | 1 | 1 |
| 17 | 1 | 3 | 5 | 9 | 14 | 3 | 2 | 5 | 14 | 2 | 3 | 2 | 1 | 1 | 1 |
| 18 | 1 | 3 | 6 | 10 | 5 | 1 | 5 | 6 | 5 | 5 | 3 | 2 | 2 | 1 | 1 |
| 19 | 1 | 4 | 1 | 6 | 2 | 1 | 2 | 3 | 2 | 2 | 1 | 1 | 1 | 1 | 1 |
| 20 | 1 | 4 | 2 | 7 | 11 | 2 | 5 | 7 | 11 | 11 | 6 | 4 | 3 | 2 | 2 |
| 21 | 1 | 4 | 3 | 8 | 13 | 3 | 1 | 4 | 13 | 1 | 2 | 1 | 1 | 1 | 1 |
| 22 | 1 | 4 | 4 | 9 | 4 | 1 | 4 | 5 | 4 | 4 | 2 | 2 | 1 | 1 | 1 |
| 23 | 1 | 4 | 5 | 10 | 10 | 2 | 4 | 6 | 10 | 10 | 4 | 3 | 2 | 2 | 1 |
| 24 | 1 | 4 | 6 | 11 | 32 | 6 | 2 | 8 | 14 | 8 | 5 | 3 | 2 | 2 | 1 |
| 25 | 1 | 5 | 1 | 7 | 6 | 1 | 6 | 7 | 6 | 6 | 5 | 4 | 2 | 2 | 2 |
| 26 | 1 | 5 | 2 | 8 | 8 | 2 | 2 | 4 | 8 | 8 | 1 | 1 | 2 | 1 | 1 |
| 27 | 1 | 5 | 3 | 9 | 14 | 3 | 2 | 5 | 14 | 2 | 3 | 2 | 1 | 1 | 1 |
| 28 | 1 | 5 | 4 | 10 | 10 | 2 | 4 | 6 | 10 | 10 | 4 | 3 | 2 | 2 | 1 |
| 29 | 1 | 5 | 5 | 11 | 18 | 3 | 6 | 9 | 18 | 6 | 8 | 5 | 4 | 3 | 2 |
| 30 | 1 | 5 | 6 | 12 | 28 | 5 | 4 | 9 | 10 | 4 | 7 | 5 | 4 | 3 | 2 |
| 31 | 1 | 6 | 1 | 8 | 3 | 1 | 3 | 4 | 3 | 3 | 2 | 1 | 1 | 1 | 1 |
| 32 | 1 | 6 | 2 | 9 | 9 | 2 | 3 | 5 | 9 | 9 | 3 | 2 | 1 | 1 | 1 |
| 33 | 1 | 6 | 3 | 10 | 5 | 1 | 5 | 6 | 5 | 5 | 3 | 2 | 2 | 1 | 1 |

TABLE 20-continued

| 1:216 Index | 3-Dice Combination | | | 3-Dice Point | 1:36 Index | 2-Dice Combination | | 2-Dice Point | 1:18 Index | 1:12 Index | 1:9 Index | 1:6 Index | 1:4 Index | 1:3 Index | 1:2 Index |
|---|---|---|---|---|---|---|---|---|---|---|---|---|---|---|---|
| 34 | 1 | 6 | 4 | 11 | 32 | 6 | 2 | 8 | 14 | 8 | 5 | 3 | 2 | 2 | 1 |
| 35 | 1 | 6 | 5 | 12 | 28 | 5 | 4 | 9 | 10 | 4 | 7 | 5 | 4 | 3 | 2 |
| 36 | 1 | 6 | 6 | 13 | 34 | 6 | 4 | 10 | 16 | 10 | 8 | 6 | 4 | 3 | 2 |
| 37 | 2 | 1 | 1 | 4 | 1 | 1 | 1 | 2 | 1 | 1 | 1 | 1 | 1 | 1 | 1 |
| 38 | 2 | 1 | 2 | 5 | 2 | 1 | 2 | 3 | 2 | 2 | 1 | 1 | 1 | 1 | 1 |
| 39 | 2 | 1 | 3 | 6 | 7 | 2 | 1 | 3 | 7 | 7 | 1 | 1 | 1 | 1 | 1 |
| 40 | 2 | 1 | 4 | 7 | 11 | 2 | 5 | 7 | 11 | 11 | 6 | 4 | 3 | 2 | 2 |
| 41 | 2 | 1 | 5 | 8 | 8 | 2 | 2 | 4 | 8 | 8 | 1 | 1 | 2 | 1 | 1 |
| 42 | 2 | 1 | 6 | 9 | 9 | 2 | 3 | 5 | 9 | 9 | 3 | 2 | 1 | 1 | 1 |
| 43 | 2 | 2 | 1 | 5 | 2 | 1 | 2 | 3 | 2 | 2 | 1 | 1 | 1 | 1 | 1 |
| 44 | 2 | 2 | 2 | 6 | 6 | 1 | 6 | 7 | 6 | 6 | 5 | 4 | 2 | 2 | 2 |
| 45 | 2 | 2 | 3 | 7 | 16 | 3 | 4 | 7 | 16 | 4 | 6 | 4 | 3 | 2 | 2 |
| 46 | 2 | 2 | 4 | 8 | 3 | 1 | 3 | 4 | 3 | 3 | 2 | 1 | 1 | 1 | 1 |
| 47 | 2 | 2 | 5 | 9 | 19 | 4 | 1 | 5 | 1 | 7 | 2 | 2 | 1 | 1 | 1 |
| 48 | 2 | 2 | 6 | 10 | 19 | 4 | 1 | 5 | 1 | 7 | 2 | 2 | 1 | 1 | 1 |
| 49 | 2 | 3 | 1 | 6 | 7 | 2 | 1 | 3 | 7 | 7 | 1 | 1 | 1 | 1 | 1 |
| 50 | 2 | 3 | 2 | 7 | 16 | 3 | 4 | 7 | 16 | 4 | 6 | 4 | 3 | 2 | 2 |
| 51 | 2 | 3 | 3 | 8 | 4 | 1 | 4 | 5 | 4 | 4 | 2 | 2 | 1 | 1 | 1 |
| 52 | 2 | 3 | 4 | 9 | 25 | 5 | 1 | 6 | 7 | 1 | 3 | 2 | 2 | 1 | 1 |
| 53 | 2 | 3 | 5 | 10 | 15 | 3 | 3 | 6 | 15 | 3 | 4 | 3 | 3 | 2 | 1 |
| 54 | 2 | 3 | 6 | 11 | 27 | 5 | 3 | 8 | 9 | 3 | 7 | 5 | 3 | 3 | 2 |
| 55 | 2 | 4 | 1 | 7 | 11 | 2 | 5 | 7 | 11 | 11 | 6 | 4 | 3 | 2 | 2 |
| 56 | 2 | 4 | 2 | 8 | 3 | 1 | 3 | 4 | 3 | 3 | 2 | 1 | 1 | 1 | 1 |
| 57 | 2 | 4 | 3 | 9 | 25 | 5 | 1 | 6 | 7 | 1 | 3 | 2 | 2 | 1 | 1 |
| 58 | 2 | 4 | 4 | 10 | 20 | 4 | 2 | 6 | 2 | 8 | 4 | 3 | 2 | 2 | 1 |
| 59 | 2 | 4 | 5 | 11 | 22 | 4 | 4 | 8 | 4 | 10 | 4 | 3 | 3 | 2 | 1 |
| 60 | 2 | 4 | 6 | 12 | 23 | 4 | 5 | 9 | 5 | 11 | 7 | 5 | 4 | 3 | 2 |
| 61 | 2 | 5 | 1 | 8 | 8 | 2 | 2 | 4 | 8 | 8 | 1 | 1 | 2 | 1 | 1 |
| 62 | 2 | 5 | 2 | 9 | 19 | 4 | 1 | 5 | 1 | 7 | 2 | 2 | 1 | 1 | 1 |
| 63 | 2 | 5 | 3 | 10 | 15 | 3 | 3 | 6 | 15 | 3 | 4 | 3 | 3 | 2 | 1 |
| 64 | 2 | 5 | 4 | 11 | 22 | 4 | 4 | 8 | 4 | 10 | 4 | 3 | 3 | 2 | 1 |
| 65 | 2 | 5 | 5 | 12 | 33 | 6 | 3 | 9 | 15 | 9 | 8 | 5 | 4 | 3 | 2 |
| 66 | 2 | 5 | 6 | 13 | 29 | 5 | 5 | 10 | 11 | 5 | 9 | 6 | 3 | 3 | 2 |
| 67 | 2 | 6 | 1 | 9 | 9 | 2 | 3 | 5 | 9 | 9 | 3 | 2 | 1 | 1 | 1 |
| 68 | 2 | 6 | 2 | 10 | 19 | 4 | 1 | 5 | 1 | 7 | 2 | 2 | 1 | 1 | 1 |
| 69 | 2 | 6 | 3 | 11 | 27 | 5 | 3 | 8 | 9 | 3 | 7 | 5 | 3 | 3 | 2 |
| 70 | 2 | 6 | 4 | 12 | 23 | 4 | 5 | 9 | 5 | 11 | 7 | 5 | 4 | 3 | 2 |
| 71 | 2 | 6 | 5 | 13 | 29 | 5 | 5 | 10 | 11 | 5 | 9 | 6 | 3 | 3 | 2 |
| 72 | 2 | 6 | 6 | 14 | 31 | 6 | 1 | 7 | 13 | 7 | 5 | 4 | 2 | 2 | 2 |
| 73 | 3 | 1 | 1 | 5 | 1 | 1 | 1 | 2 | 1 | 1 | 1 | 1 | 1 | 1 | 1 |
| 74 | 3 | 1 | 2 | 6 | 7 | 2 | 1 | 3 | 7 | 7 | 1 | 1 | 1 | 1 | 1 |
| 75 | 3 | 1 | 3 | 7 | 16 | 3 | 4 | 7 | 16 | 4 | 6 | 4 | 3 | 2 | 2 |
| 76 | 3 | 1 | 4 | 8 | 13 | 3 | 1 | 4 | 13 | 1 | 2 | 1 | 1 | 1 | 1 |
| 77 | 3 | 1 | 5 | 9 | 14 | 3 | 2 | 5 | 14 | 2 | 3 | 2 | 1 | 1 | 1 |
| 78 | 3 | 1 | 6 | 10 | 5 | 1 | 5 | 6 | 5 | 5 | 3 | 2 | 2 | 1 | 1 |
| 79 | 3 | 2 | 1 | 6 | 7 | 2 | 1 | 3 | 7 | 7 | 1 | 1 | 1 | 1 | 1 |
| 80 | 3 | 2 | 2 | 7 | 16 | 3 | 4 | 7 | 16 | 4 | 6 | 4 | 3 | 2 | 2 |
| 81 | 3 | 2 | 3 | 8 | 4 | 1 | 4 | 5 | 4 | 4 | 2 | 2 | 1 | 1 | 1 |
| 82 | 3 | 2 | 4 | 9 | 25 | 5 | 1 | 6 | 7 | 1 | 3 | 2 | 2 | 1 | 1 |
| 83 | 3 | 2 | 5 | 10 | 15 | 3 | 3 | 6 | 15 | 3 | 4 | 3 | 3 | 2 | 1 |
| 84 | 3 | 2 | 6 | 11 | 27 | 5 | 3 | 8 | 9 | 3 | 7 | 5 | 3 | 3 | 2 |
| 85 | 3 | 3 | 1 | 7 | 16 | 3 | 4 | 7 | 16 | 4 | 6 | 4 | 3 | 2 | 2 |
| 86 | 3 | 3 | 2 | 8 | 4 | 1 | 4 | 5 | 4 | 4 | 2 | 2 | 1 | 1 | 1 |
| 87 | 3 | 3 | 3 | 9 | 6 | 1 | 6 | 7 | 6 | 6 | 5 | 4 | 2 | 2 | 2 |
| 88 | 3 | 3 | 4 | 10 | 20 | 4 | 2 | 6 | 2 | 8 | 4 | 3 | 2 | 2 | 1 |
| 89 | 3 | 3 | 5 | 11 | 17 | 3 | 5 | 8 | 17 | 5 | 7 | 5 | 3 | 3 | 2 |
| 90 | 3 | 3 | 6 | 12 | 18 | 3 | 6 | 9 | 18 | 6 | 8 | 5 | 4 | 3 | 2 |
| 91 | 3 | 4 | 1 | 8 | 13 | 3 | 1 | 4 | 13 | 1 | 2 | 1 | 1 | 1 | 1 |
| 92 | 3 | 4 | 2 | 9 | 25 | 5 | 1 | 6 | 7 | 1 | 3 | 2 | 2 | 1 | 1 |
| 93 | 3 | 4 | 3 | 10 | 20 | 4 | 2 | 6 | 2 | 8 | 4 | 3 | 2 | 2 | 1 |
| 94 | 3 | 4 | 4 | 11 | 17 | 3 | 5 | 8 | 17 | 5 | 7 | 5 | 3 | 3 | 2 |
| 95 | 3 | 4 | 5 | 12 | 12 | 2 | 6 | 8 | 12 | 12 | 5 | 3 | 2 | 2 | 1 |
| 96 | 3 | 4 | 6 | 13 | 24 | 4 | 6 | 10 | 6 | 12 | 8 | 6 | 4 | 3 | 2 |
| 97 | 3 | 5 | 1 | 9 | 14 | 3 | 2 | 5 | 14 | 2 | 3 | 2 | 1 | 1 | 1 |
| 98 | 3 | 5 | 2 | 10 | 15 | 3 | 3 | 6 | 15 | 3 | 4 | 3 | 3 | 2 | 1 |
| 99 | 3 | 5 | 3 | 11 | 17 | 3 | 5 | 8 | 17 | 5 | 7 | 5 | 3 | 3 | 2 |
| 100 | 3 | 5 | 4 | 12 | 12 | 2 | 6 | 8 | 12 | 12 | 5 | 3 | 2 | 2 | 1 |
| 101 | 3 | 5 | 5 | 13 | 34 | 6 | 4 | 10 | 16 | 10 | 8 | 6 | 4 | 3 | 2 |
| 102 | 3 | 5 | 6 | 14 | 21 | 4 | 3 | 7 | 3 | 9 | 6 | 4 | 3 | 2 | 2 |
| 103 | 3 | 6 | 1 | 10 | 5 | 1 | 5 | 6 | 5 | 5 | 3 | 2 | 2 | 1 | 1 |
| 104 | 3 | 6 | 2 | 11 | 27 | 5 | 3 | 8 | 9 | 3 | 7 | 5 | 3 | 3 | 2 |
| 105 | 3 | 6 | 3 | 12 | 18 | 3 | 6 | 9 | 18 | 6 | 8 | 5 | 4 | 3 | 2 |
| 106 | 3 | 6 | 4 | 13 | 24 | 4 | 6 | 10 | 6 | 12 | 8 | 6 | 4 | 3 | 2 |
| 107 | 3 | 6 | 5 | 14 | 21 | 4 | 3 | 7 | 3 | 9 | 6 | 4 | 3 | 2 | 2 |
| 108 | 3 | 6 | 6 | 15 | 35 | 6 | 5 | 11 | 17 | 11 | 9 | 6 | 4 | 3 | 2 |
| 109 | 4 | 1 | 1 | 6 | 2 | 1 | 2 | 3 | 2 | 2 | 1 | 1 | 1 | 1 | 1 |

TABLE 20-continued

| 1:216 Index | 3-Dice Combination | | | 3-Dice Point | 1:36 Index | 2-Dice Combination | | 2-Dice Point | 1:18 Index | 1:12 Index | 1:9 Index | 1:6 Index | 1:4 Index | 1:3 Index | 1:2 Index |
|---|---|---|---|---|---|---|---|---|---|---|---|---|---|---|---|
| 110 | 4 | 1 | 2 | 7 | 11 | 2 | 5 | 7 | 11 | 11 | 6 | 4 | 3 | 2 | 2 |
| 111 | 4 | 1 | 3 | 8 | 13 | 3 | 1 | 4 | 13 | 1 | 2 | 1 | 1 | 1 | 1 |
| 112 | 4 | 1 | 4 | 9 | 4 | 1 | 4 | 5 | 4 | 4 | 2 | 2 | 1 | 1 | 1 |
| 113 | 4 | 1 | 5 | 10 | 10 | 2 | 4 | 6 | 10 | 10 | 4 | 3 | 2 | 2 | 1 |
| 114 | 4 | 1 | 6 | 11 | 32 | 6 | 2 | 8 | 14 | 8 | 5 | 3 | 2 | 2 | 1 |
| 115 | 4 | 2 | 1 | 7 | 11 | 2 | 5 | 7 | 11 | 11 | 6 | 4 | 3 | 2 | 2 |
| 116 | 4 | 2 | 2 | 8 | 3 | 1 | 3 | 4 | 3 | 3 | 2 | 1 | 1 | 1 | 1 |
| 117 | 4 | 2 | 3 | 9 | 25 | 5 | 1 | 6 | 7 | 1 | 3 | 2 | 2 | 1 | 1 |
| 118 | 4 | 2 | 4 | 10 | 20 | 4 | 2 | 6 | 2 | 8 | 4 | 3 | 2 | 2 | 1 |
| 119 | 4 | 2 | 5 | 11 | 22 | 4 | 4 | 8 | 4 | 10 | 4 | 3 | 3 | 2 | 1 |
| 120 | 4 | 2 | 6 | 12 | 23 | 4 | 5 | 9 | 5 | 11 | 7 | 5 | 4 | 3 | 2 |
| 121 | 4 | 3 | 1 | 8 | 13 | 3 | 1 | 4 | 13 | 1 | 2 | 1 | 1 | 1 | 1 |
| 122 | 4 | 3 | 2 | 9 | 25 | 5 | 1 | 6 | 7 | 1 | 3 | 2 | 2 | 1 | 1 |
| 123 | 4 | 3 | 3 | 10 | 20 | 4 | 2 | 6 | 2 | 8 | 4 | 3 | 2 | 2 | 1 |
| 124 | 4 | 3 | 4 | 11 | 17 | 3 | 5 | 8 | 17 | 5 | 7 | 5 | 3 | 3 | 2 |
| 125 | 4 | 3 | 5 | 12 | 12 | 2 | 6 | 8 | 12 | 12 | 5 | 3 | 2 | 2 | 1 |
| 126 | 4 | 3 | 6 | 13 | 24 | 4 | 6 | 10 | 6 | 12 | 8 | 6 | 4 | 3 | 2 |
| 127 | 4 | 4 | 1 | 9 | 4 | 1 | 4 | 5 | 4 | 4 | 2 | 2 | 1 | 1 | 1 |
| 128 | 4 | 4 | 2 | 10 | 20 | 4 | 2 | 6 | 2 | 8 | 4 | 3 | 2 | 2 | 1 |
| 129 | 4 | 4 | 3 | 11 | 17 | 3 | 5 | 8 | 17 | 5 | 7 | 5 | 3 | 3 | 2 |
| 130 | 4 | 4 | 4 | 12 | 31 | 6 | 1 | 7 | 13 | 7 | 5 | 4 | 2 | 2 | 2 |
| 131 | 4 | 4 | 5 | 13 | 33 | 6 | 3 | 9 | 15 | 9 | 8 | 5 | 4 | 3 | 2 |
| 132 | 4 | 4 | 6 | 14 | 26 | 5 | 2 | 7 | 8 | 2 | 6 | 4 | 3 | 2 | 2 |
| 133 | 4 | 5 | 1 | 10 | 10 | 2 | 4 | 6 | 10 | 10 | 4 | 3 | 2 | 2 | 1 |
| 134 | 4 | 5 | 2 | 11 | 22 | 4 | 4 | 8 | 4 | 10 | 4 | 3 | 3 | 2 | 1 |
| 135 | 4 | 5 | 3 | 12 | 12 | 2 | 6 | 8 | 12 | 12 | 5 | 3 | 2 | 2 | 1 |
| 136 | 4 | 5 | 4 | 13 | 33 | 6 | 3 | 9 | 15 | 9 | 8 | 5 | 4 | 3 | 2 |
| 137 | 4 | 5 | 5 | 14 | 26 | 5 | 2 | 7 | 8 | 2 | 6 | 4 | 3 | 2 | 2 |
| 138 | 4 | 5 | 6 | 15 | 30 | 5 | 6 | 11 | 12 | 6 | 9 | 6 | 4 | 3 | 2 |
| 139 | 4 | 6 | 1 | 11 | 32 | 6 | 2 | 8 | 14 | 8 | 5 | 3 | 2 | 2 | 1 |
| 140 | 4 | 6 | 2 | 12 | 23 | 4 | 5 | 9 | 5 | 11 | 7 | 5 | 4 | 3 | 2 |
| 141 | 4 | 6 | 3 | 13 | 24 | 4 | 6 | 10 | 6 | 12 | 8 | 6 | 4 | 3 | 2 |
| 142 | 4 | 6 | 4 | 14 | 26 | 5 | 2 | 7 | 8 | 2 | 6 | 4 | 3 | 2 | 2 |
| 143 | 4 | 6 | 5 | 15 | 30 | 5 | 6 | 11 | 12 | 6 | 9 | 6 | 4 | 3 | 2 |
| 144 | 4 | 6 | 6 | 16 | 36 | 6 | 6 | 12 | 18 | 12 | 9 | 6 | 4 | 3 | 2 |
| 145 | 5 | 1 | 1 | 7 | 6 | 1 | 6 | 7 | 6 | 6 | 5 | 4 | 2 | 2 | 2 |
| 146 | 5 | 1 | 2 | 8 | 8 | 2 | 2 | 4 | 8 | 8 | 1 | 1 | 2 | 1 | 1 |
| 147 | 5 | 1 | 3 | 9 | 14 | 3 | 2 | 5 | 14 | 2 | 3 | 2 | 1 | 1 | 1 |
| 148 | 5 | 1 | 4 | 10 | 10 | 2 | 4 | 6 | 10 | 10 | 4 | 3 | 2 | 2 | 1 |
| 149 | 5 | 1 | 5 | 11 | 18 | 3 | 6 | 9 | 18 | 6 | 8 | 5 | 4 | 3 | 2 |
| 150 | 5 | 1 | 6 | 12 | 28 | 5 | 4 | 9 | 10 | 4 | 7 | 5 | 4 | 3 | 2 |
| 151 | 5 | 2 | 1 | 8 | 8 | 2 | 2 | 4 | 8 | 8 | 1 | 1 | 2 | 1 | 1 |
| 152 | 5 | 2 | 2 | 9 | 19 | 4 | 1 | 5 | 1 | 7 | 2 | 2 | 1 | 1 | 1 |
| 153 | 5 | 2 | 3 | 10 | 15 | 3 | 3 | 6 | 15 | 3 | 4 | 3 | 3 | 2 | 1 |
| 154 | 5 | 2 | 4 | 11 | 22 | 4 | 4 | 8 | 4 | 10 | 4 | 3 | 3 | 2 | 1 |
| 155 | 5 | 2 | 5 | 12 | 33 | 6 | 3 | 9 | 15 | 9 | 8 | 5 | 4 | 3 | 2 |
| 156 | 5 | 2 | 6 | 13 | 29 | 5 | 5 | 10 | 11 | 5 | 9 | 6 | 3 | 3 | 2 |
| 157 | 5 | 3 | 1 | 9 | 14 | 3 | 2 | 5 | 14 | 2 | 3 | 2 | 1 | 1 | 1 |
| 158 | 5 | 3 | 2 | 10 | 15 | 3 | 3 | 6 | 15 | 3 | 4 | 3 | 3 | 2 | 1 |
| 159 | 5 | 3 | 3 | 11 | 17 | 3 | 5 | 8 | 17 | 5 | 7 | 5 | 3 | 3 | 2 |
| 160 | 5 | 3 | 4 | 12 | 12 | 2 | 6 | 8 | 12 | 12 | 5 | 3 | 2 | 2 | 1 |
| 161 | 5 | 3 | 5 | 13 | 34 | 6 | 4 | 10 | 16 | 10 | 8 | 6 | 4 | 3 | 2 |
| 162 | 5 | 3 | 6 | 14 | 21 | 4 | 3 | 7 | 3 | 9 | 6 | 4 | 3 | 2 | 2 |
| 163 | 5 | 4 | 1 | 10 | 10 | 2 | 4 | 6 | 10 | 10 | 4 | 3 | 2 | 2 | 1 |
| 164 | 5 | 4 | 2 | 11 | 22 | 4 | 4 | 8 | 4 | 10 | 4 | 3 | 3 | 2 | 1 |
| 165 | 5 | 4 | 3 | 12 | 12 | 2 | 6 | 8 | 12 | 12 | 5 | 3 | 2 | 2 | 1 |
| 166 | 5 | 4 | 4 | 13 | 33 | 6 | 3 | 9 | 15 | 9 | 8 | 5 | 4 | 3 | 2 |
| 167 | 5 | 4 | 5 | 14 | 26 | 5 | 2 | 7 | 8 | 2 | 6 | 4 | 3 | 2 | 2 |
| 168 | 5 | 4 | 6 | 15 | 30 | 5 | 6 | 11 | 12 | 6 | 9 | 6 | 4 | 3 | 2 |
| 169 | 5 | 5 | 1 | 11 | 18 | 3 | 6 | 9 | 18 | 6 | 8 | 5 | 4 | 3 | 2 |
| 170 | 5 | 5 | 2 | 12 | 33 | 6 | 3 | 9 | 15 | 9 | 8 | 5 | 4 | 3 | 2 |
| 171 | 5 | 5 | 3 | 13 | 34 | 6 | 4 | 10 | 16 | 10 | 8 | 6 | 4 | 3 | 2 |
| 172 | 5 | 5 | 4 | 14 | 26 | 5 | 2 | 7 | 8 | 2 | 6 | 4 | 3 | 2 | 2 |
| 173 | 5 | 5 | 5 | 15 | 31 | 6 | 1 | 7 | 13 | 7 | 5 | 4 | 2 | 2 | 2 |
| 174 | 5 | 5 | 6 | 16 | 35 | 6 | 5 | 11 | 17 | 11 | 9 | 6 | 4 | 3 | 2 |
| 175 | 5 | 6 | 1 | 12 | 28 | 5 | 4 | 9 | 10 | 4 | 7 | 5 | 4 | 3 | 2 |
| 176 | 5 | 6 | 2 | 13 | 29 | 5 | 5 | 10 | 11 | 5 | 9 | 6 | 3 | 3 | 2 |
| 177 | 5 | 6 | 3 | 14 | 21 | 4 | 3 | 7 | 3 | 9 | 6 | 4 | 3 | 2 | 2 |
| 178 | 5 | 6 | 4 | 15 | 30 | 5 | 6 | 11 | 12 | 6 | 9 | 6 | 4 | 3 | 2 |
| 179 | 5 | 6 | 5 | 16 | 35 | 6 | 5 | 11 | 17 | 11 | 9 | 6 | 4 | 3 | 2 |
| 180 | 5 | 6 | 6 | 17 | 36 | 6 | 6 | 12 | 18 | 12 | 9 | 6 | 4 | 3 | 2 |
| 181 | 6 | 1 | 1 | 8 | 3 | 1 | 3 | 4 | 3 | 3 | 2 | 1 | 1 | 1 | 1 |
| 182 | 6 | 1 | 2 | 9 | 9 | 2 | 3 | 5 | 9 | 9 | 3 | 2 | 1 | 1 | 1 |
| 183 | 6 | 1 | 3 | 10 | 5 | 1 | 5 | 6 | 5 | 5 | 3 | 2 | 2 | 1 | 1 |
| 184 | 6 | 1 | 4 | 11 | 32 | 6 | 2 | 8 | 14 | 8 | 5 | 3 | 2 | 2 | 1 |
| 185 | 6 | 1 | 5 | 12 | 28 | 5 | 4 | 9 | 10 | 4 | 7 | 5 | 4 | 3 | 2 |

TABLE 20-continued

| 1:216 Index | 3-Dice Combination | | | 3-Dice Point | 1:36 Index | 2-Dice Combination | | 2-Dice Point | 1:18 Index | 1:12 Index | 1:9 Index | 1:6 Index | 1:4 Index | 1:3 Index | 1:2 Index |
|---|---|---|---|---|---|---|---|---|---|---|---|---|---|---|---|
| 186 | 6 | 1 | 6 | 13 | 34 | 6 | 4 | 10 | 16 | 10 | 8 | 6 | 4 | 3 | 2 |
| 187 | 6 | 2 | 1 | 9 | 9 | 2 | 3 | 5 | 9 | 9 | 3 | 2 | 1 | 1 | 1 |
| 188 | 6 | 2 | 2 | 10 | 19 | 4 | 1 | 5 | 1 | 7 | 2 | 2 | 1 | 1 | 1 |
| 189 | 6 | 2 | 3 | 11 | 27 | 5 | 3 | 8 | 9 | 3 | 7 | 5 | 3 | 3 | 2 |
| 190 | 6 | 2 | 4 | 12 | 23 | 4 | 5 | 9 | 5 | 11 | 7 | 5 | 4 | 3 | 2 |
| 191 | 6 | 2 | 5 | 13 | 29 | 5 | 5 | 10 | 11 | 5 | 9 | 6 | 3 | 3 | 2 |
| 192 | 6 | 2 | 6 | 14 | 31 | 6 | 1 | 7 | 13 | 7 | 5 | 4 | 2 | 2 | 2 |
| 193 | 6 | 3 | 1 | 10 | 5 | 1 | 5 | 6 | 5 | 5 | 3 | 2 | 2 | 1 | 1 |
| 194 | 6 | 3 | 2 | 11 | 27 | 5 | 3 | 8 | 9 | 3 | 7 | 5 | 3 | 3 | 2 |
| 195 | 6 | 3 | 3 | 12 | 18 | 3 | 6 | 9 | 18 | 6 | 8 | 5 | 4 | 3 | 2 |
| 196 | 6 | 3 | 4 | 13 | 24 | 4 | 6 | 10 | 6 | 12 | 8 | 6 | 4 | 3 | 2 |
| 197 | 6 | 3 | 5 | 14 | 21 | 4 | 3 | 7 | 3 | 9 | 6 | 4 | 3 | 2 | 2 |
| 198 | 6 | 3 | 6 | 15 | 35 | 6 | 5 | 11 | 17 | 11 | 9 | 6 | 4 | 3 | 2 |
| 199 | 6 | 4 | 1 | 11 | 32 | 6 | 2 | 8 | 14 | 8 | 5 | 3 | 2 | 2 | 1 |
| 200 | 6 | 4 | 2 | 12 | 23 | 4 | 5 | 9 | 5 | 11 | 7 | 5 | 4 | 3 | 2 |
| 201 | 6 | 4 | 3 | 13 | 24 | 4 | 6 | 10 | 6 | 12 | 8 | 6 | 4 | 3 | 2 |
| 202 | 6 | 4 | 4 | 14 | 26 | 5 | 2 | 7 | 8 | 2 | 6 | 4 | 3 | 2 | 2 |
| 203 | 6 | 4 | 5 | 15 | 30 | 5 | 6 | 11 | 12 | 6 | 9 | 6 | 4 | 3 | 2 |
| 204 | 6 | 4 | 6 | 16 | 36 | 6 | 6 | 12 | 18 | 12 | 9 | 6 | 4 | 3 | 2 |
| 205 | 6 | 5 | 1 | 12 | 28 | 5 | 4 | 9 | 10 | 4 | 7 | 5 | 4 | 3 | 2 |
| 206 | 6 | 5 | 2 | 13 | 29 | 5 | 5 | 10 | 11 | 5 | 9 | 6 | 3 | 3 | 2 |
| 207 | 6 | 5 | 3 | 14 | 21 | 4 | 3 | 7 | 3 | 9 | 6 | 4 | 3 | 2 | 2 |
| 208 | 6 | 5 | 4 | 15 | 30 | 5 | 6 | 11 | 12 | 6 | 9 | 6 | 4 | 3 | 2 |
| 209 | 6 | 5 | 5 | 16 | 35 | 6 | 5 | 11 | 17 | 11 | 9 | 6 | 4 | 3 | 2 |
| 210 | 6 | 5 | 6 | 17 | 36 | 6 | 6 | 12 | 18 | 12 | 9 | 6 | 4 | 3 | 2 |
| 211 | 6 | 6 | 1 | 13 | 34 | 6 | 4 | 10 | 16 | 10 | 8 | 6 | 4 | 3 | 2 |
| 212 | 6 | 6 | 2 | 14 | 31 | 6 | 1 | 7 | 13 | 7 | 5 | 4 | 2 | 2 | 2 |
| 213 | 6 | 6 | 3 | 15 | 35 | 6 | 5 | 11 | 17 | 11 | 9 | 6 | 4 | 3 | 2 |
| 214 | 6 | 6 | 4 | 16 | 36 | 6 | 6 | 12 | 18 | 12 | 9 | 6 | 4 | 3 | 2 |
| 215 | 6 | 6 | 5 | 17 | 36 | 6 | 6 | 12 | 18 | 12 | 9 | 6 | 4 | 3 | 2 |
| 216 | 6 | 6 | 6 | 18 | 31 | 6 | 1 | 7 | 13 | 7 | 5 | 4 | 2 | 2 | 2 |

Table 21 represents a map starting from a 1:126 input. This map is particularly applicable when a Sic-Bo roll is used as the randomizer machine. Sic-Bo is a 3-dice game that uses two indistinguishable dice and one die colored differently from the other two (known as the Off Colored, or OC, die). Sic-Bo is therefore based upon 126 distinct rolls, in addition to the 56 distinct rolls determined from the dice thrown, when interpreted as all indistinguishable. Thus, Table 23 illustrates a map starting from the 126 distinct combinations (e.g., from a Sic-Bo roll) mapped to the 56 distinct combinations found in an indistinguishable 3-Dice roll. From there, mapping is carried forward to the 1:36 range (e.g., a distinguishable 3-dice roll). Then from the 1:36 range maps are provided to a 2-dice roll, a 1:18 range, a 1:12 range, a 1:9 range, a 1:6 range (e.g., a 1-die roll), a 1:4 range, a 1:3 range (e.g., rock-paper-scissor), and a 1:2 range (e.g., coin flip).

TABLE 21

| 1:126 Index | OC Die | Sic-Bo | 3-Dice Point | 1:36 Index | 2-Dice Combination | | 2-Dice Point | 1:18 Index | 1:12 Index | 1:9 Index | 1:6. Index | 1:4 Index | 1:3 Index | 1:2 Index |
|---|---|---|---|---|---|---|---|---|---|---|---|---|---|---|
| 1 | 1 | 1 1-1 | 3 | 6 | 1 | 6 | 7 | 6 | 6 | 5 | 4 | 2 | 2 | 2 |
| 2 | 1 | 1 1-2 | 4 | 1 | 1 | 1 | 2 | 1 | 1 | 1 | 1 | 1 | 1 | 1 |
| 3 | 1 | 1 1-3 | 5 | 1 | 1 | 1 | 2 | 1 | 1 | 1 | 1 | 1 | 1 | 1 |
| 4 | 1 | 1 1-4 | 6 | 2 | 1 | 2 | 3 | 2 | 2 | 1 | 1 | 1 | 1 | 1 |
| 5 | 1 | 1 1-5 | 7 | 6 | 1 | 6 | 7 | 6 | 6 | 5 | 4 | 2 | 2 | 2 |
| 6 | 1 | 1 1-6 | 8 | 3 | 1 | 3 | 4 | 3 | 3 | 2 | 1 | 1 | 1 | 1 |
| 7 | 1 | 1 2-2 | 5 | 2 | 1 | 2 | 3 | 2 | 2 | 1 | 1 | 1 | 1 | 1 |
| 8 | 1 | 1 2-3 | 6 | 7 | 2 | 1 | 3 | 7 | 7 | 1 | 1 | 1 | 1 | 1 |
| 9 | 1 | 1 2-4 | 7 | 11 | 2 | 5 | 7 | 11 | 11 | 6 | 4 | 3 | 2 | 2 |
| 10 | 1 | 1 2-5 | 8 | 8 | 2 | 2 | 4 | 8 | 8 | 1 | 1 | 2 | 1 | 1 |
| 11 | 1 | 1 2-6 | 9 | 9 | 2 | 3 | 5 | 9 | 9 | 3 | 2 | 1 | 1 | 1 |
| 12 | 1 | 1 3-3 | 7 | 16 | 3 | 4 | 7 | 16 | 4 | 6 | 4 | 3 | 2 | 2 |
| 13 | 1 | 1 3-4 | 8 | 13 | 3 | 1 | 4 | 13 | 1 | 2 | 1 | 1 | 1 | 1 |
| 14 | 1 | 1 3-5 | 9 | 14 | 3 | 2 | 5 | 14 | 2 | 3 | 2 | 1 | 1 | 1 |
| 15 | 1 | 1 3-6 | 10 | 5 | 1 | 5 | 6 | 5 | 5 | 3 | 2 | 2 | 1 | 1 |
| 16 | 1 | 1 4-4 | 9 | 4 | 1 | 4 | 5 | 4 | 4 | 2 | 2 | 1 | 1 | 1 |
| 17 | 1 | 1 4-5 | 10 | 10 | 2 | 4 | 6 | 10 | 10 | 4 | 3 | 2 | 2 | 1 |
| 18 | 1 | 1 4-6 | 11 | 32 | 6 | 2 | 8 | 14 | 8 | 5 | 3 | 2 | 2 | 1 |
| 19 | 1 | 1 5-5 | 11 | 18 | 3 | 6 | 9 | 18 | 6 | 8 | 5 | 4 | 3 | 2 |
| 20 | 1 | 1 5-6 | 12 | 28 | 5 | 4 | 9 | 10 | 4 | 7 | 5 | 4 | 3 | 2 |
| 21 | 1 | 1 6-6 | 13 | 34 | 6 | 4 | 10 | 16 | 10 | 8 | 6 | 4 | 3 | 2 |
| 22 | 2 | 2 1-1 | 4 | 1 | 1 | 1 | 2 | 1 | 1 | 1 | 1 | 1 | 1 | 1 |
| 23 | 2 | 2 1-2 | 5 | 2 | 1 | 2 | 3 | 2 | 2 | 1 | 1 | 1 | 1 | 1 |
| 24 | 2 | 2 1-3 | 6 | 7 | 2 | 1 | 3 | 7 | 7 | 1 | 1 | 1 | 1 | 1 |
| 25 | 2 | 2 1-4 | 7 | 11 | 2 | 5 | 7 | 11 | 11 | 6 | 4 | 3 | 2 | 2 |
| 26 | 2 | 2 1-5 | 8 | 8 | 2 | 2 | 4 | 8 | 8 | 1 | 1 | 2 | 1 | 1 |

TABLE 21-continued

| 1:126 Index | OC Die | Sic-Bo | 3-Dice Point | 1:36 Index | 2-Dice Combination | | 2-Dice Point | 1:18 Index | 1:12 Index | 1:9 Index | 1:6. Index | 1:4 Index | 1:3 Index | 1:2 Index |
|---|---|---|---|---|---|---|---|---|---|---|---|---|---|---|
| 27 | 2 | 2 1-6 | 9 | 9 | 2 | 3 | 5 | 9 | 9 | 3 | 2 | 1 | 1 | 1 |
| 28 | 2 | 2 2-2 | 6 | 6 | 1 | 6 | 7 | 6 | 6 | 5 | 4 | 2 | 2 | 2 |
| 29 | 2 | 2 2-3 | 7 | 16 | 3 | 4 | 7 | 16 | 4 | 6 | 4 | 3 | 2 | 2 |
| 30 | 2 | 2 2-4 | 8 | 3 | 1 | 3 | 4 | 3 | 3 | 2 | 1 | 1 | 1 | 1 |
| 31 | 2 | 2 2-5 | 9 | 19 | 4 | 1 | 5 | 1 | 7 | 2 | 2 | 1 | 1 | 1 |
| 32 | 2 | 2 2-6 | 10 | 19 | 4 | 1 | 5 | 1 | 7 | 2 | 2 | 1 | 1 | 1 |
| 33 | 2 | 2 3-3 | 8 | 4 | 1 | 4 | 5 | 4 | 4 | 2 | 2 | 1 | 1 | 1 |
| 34 | 2 | 2 3-4 | 9 | 25 | 5 | 1 | 6 | 7 | 1 | 3 | 2 | 2 | 1 | 1 |
| 35 | 2 | 2 3-5 | 10 | 15 | 3 | 3 | 6 | 15 | 3 | 4 | 3 | 3 | 2 | 1 |
| 36 | 2 | 2 3-6 | 11 | 27 | 5 | 3 | 8 | 9 | 3 | 7 | 5 | 3 | 3 | 2 |
| 37 | 2 | 2 4-4 | 10 | 20 | 4 | 2 | 6 | 2 | 8 | 4 | 3 | 2 | 2 | 1 |
| 38 | 2 | 2 4-5 | 11 | 22 | 4 | 4 | 8 | 4 | 10 | 4 | 3 | 3 | 2 | 1 |
| 39 | 2 | 2 4-6 | 12 | 23 | 4 | 5 | 9 | 5 | 11 | 7 | 5 | 4 | 3 | 2 |
| 40 | 2 | 2 5-5 | 12 | 33 | 6 | 3 | 9 | 15 | 9 | 8 | 5 | 4 | 3 | 2 |
| 41 | 2 | 2 5-6 | 13 | 29 | 5 | 5 | 10 | 11 | 5 | 9 | 6 | 3 | 3 | 2 |
| 42 | 2 | 2 6-6 | 14 | 31 | 6 | 1 | 7 | 13 | 7 | 5 | 4 | 2 | 2 | 2 |
| 43 | 3 | 3 1-1 | 5 | 1 | 1 | 1 | 2 | 1 | 1 | 1 | 1 | 1 | 1 | 1 |
| 44 | 3 | 3 1-2 | 6 | 7 | 2 | 1 | 3 | 7 | 7 | 1 | 1 | 1 | 1 | 1 |
| 45 | 3 | 3 1-3 | 7 | 16 | 3 | 4 | 7 | 16 | 4 | 6 | 4 | 3 | 2 | 2 |
| 46 | 3 | 3 1-4 | 8 | 13 | 3 | 1 | 4 | 13 | 1 | 2 | 1 | 1 | 1 | 1 |
| 47 | 3 | 3 1-5 | 9 | 14 | 3 | 2 | 5 | 14 | 2 | 3 | 2 | 1 | 1 | 1 |
| 48 | 3 | 3 1-6 | 10 | 5 | 1 | 5 | 6 | 5 | 5 | 3 | 2 | 2 | 1 | 1 |
| 49 | 3 | 3 2-2 | 7 | 16 | 3 | 4 | 7 | 16 | 4 | 6 | 4 | 3 | 2 | 2 |
| 50 | 3 | 3 2-3 | 8 | 4 | 1 | 4 | 5 | 4 | 4 | 2 | 2 | 1 | 1 | 1 |
| 51 | 3 | 3 2-4 | 9 | 25 | 5 | 1 | 6 | 7 | 1 | 3 | 2 | 2 | 1 | 1 |
| 52 | 3 | 3 2-5 | 10 | 15 | 3 | 3 | 6 | 15 | 3 | 4 | 3 | 3 | 2 | 1 |
| 53 | 3 | 3 2-6 | 11 | 27 | 5 | 3 | 8 | 9 | 3 | 7 | 5 | 3 | 3 | 2 |
| 54 | 3 | 3 3-3 | 9 | 6 | 1 | 6 | 7 | 6 | 6 | 5 | 4 | 2 | 2 | 2 |
| 55 | 3 | 3 3-4 | 10 | 20 | 4 | 2 | 6 | 2 | 8 | 4 | 3 | 2 | 2 | 1 |
| 56 | 3 | 3 3-5 | 11 | 17 | 3 | 5 | 8 | 17 | 5 | 7 | 5 | 3 | 3 | 2 |
| 57 | 3 | 3 3-6 | 12 | 18 | 3 | 6 | 9 | 18 | 6 | 8 | 5 | 4 | 3 | 2 |
| 58 | 3 | 3 4-4 | 11 | 17 | 3 | 5 | 8 | 17 | 5 | 7 | 5 | 3 | 3 | 2 |
| 59 | 3 | 3 4-5 | 12 | 12 | 2 | 6 | 8 | 12 | 12 | 5 | 3 | 2 | 2 | 1 |
| 60 | 3 | 3 4-6 | 13 | 24 | 4 | 6 | 10 | 6 | 12 | 8 | 6 | 4 | 3 | 2 |
| 61 | 3 | 3 5-5 | 13 | 34 | 6 | 4 | 10 | 16 | 10 | 8 | 6 | 4 | 3 | 2 |
| 62 | 3 | 3 5-6 | 14 | 21 | 4 | 3 | 7 | 3 | 9 | 6 | 4 | 3 | 2 | 2 |
| 63 | 3 | 3 6-6 | 15 | 35 | 6 | 5 | 11 | 17 | 11 | 9 | 6 | 4 | 3 | 2 |
| 64 | 4 | 4 1-1 | 6 | 2 | 1 | 2 | 3 | 2 | 2 | 1 | 1 | 1 | 1 | 1 |
| 65 | 4 | 4 1-2 | 7 | 11 | 2 | 5 | 7 | 11 | 11 | 6 | 4 | 3 | 2 | 2 |
| 66 | 4 | 4 1-3 | 8 | 13 | 3 | 1 | 4 | 13 | 1 | 2 | 1 | 1 | 1 | 1 |
| 67 | 4 | 4 1-4 | 9 | 4 | 1 | 4 | 5 | 4 | 4 | 2 | 2 | 1 | 1 | 1 |
| 68 | 4 | 4 1-5 | 10 | 10 | 2 | 4 | 6 | 10 | 10 | 4 | 3 | 2 | 2 | 1 |
| 69 | 4 | 4 1-6 | 11 | 32 | 6 | 2 | 8 | 14 | 8 | 5 | 3 | 2 | 2 | 1 |
| 70 | 4 | 4 2-2 | 8 | 3 | 1 | 3 | 4 | 3 | 3 | 2 | 1 | 1 | 1 | 1 |
| 71 | 4 | 4 2-3 | 9 | 25 | 5 | 1 | 6 | 7 | 1 | 3 | 2 | 2 | 1 | 1 |
| 72 | 4 | 4 2-4 | 10 | 20 | 4 | 2 | 6 | 2 | 8 | 4 | 3 | 2 | 2 | 1 |
| 73 | 4 | 4 2-5 | 11 | 22 | 4 | 4 | 8 | 4 | 10 | 4 | 3 | 3 | 2 | 1 |
| 74 | 4 | 4 2-6 | 12 | 23 | 4 | 5 | 9 | 5 | 11 | 7 | 5 | 4 | 3 | 2 |
| 75 | 4 | 4 3-3 | 10 | 20 | 4 | 2 | 6 | 2 | 8 | 4 | 3 | 2 | 2 | 1 |
| 76 | 4 | 4 3-4 | 11 | 17 | 3 | 5 | 8 | 17 | 5 | 7 | 5 | 3 | 3 | 2 |
| 77 | 4 | 4 3-5 | 12 | 12 | 2 | 6 | 8 | 12 | 12 | 5 | 3 | 2 | 2 | 1 |
| 78 | 4 | 4 3-6 | 13 | 24 | 4 | 6 | 10 | 6 | 12 | 8 | 6 | 4 | 3 | 2 |
| 79 | 4 | 4 4-4 | 12 | 31 | 6 | 1 | 7 | 13 | 7 | 5 | 4 | 2 | 2 | 2 |
| 80 | 4 | 4 4-5 | 13 | 33 | 6 | 3 | 9 | 15 | 9 | 8 | 5 | 4 | 3 | 2 |
| 81 | 4 | 4 4-6 | 14 | 26 | 5 | 2 | 7 | 8 | 2 | 6 | 4 | 3 | 2 | 2 |
| 82 | 4 | 4 5-5 | 14 | 26 | 5 | 2 | 7 | 8 | 2 | 6 | 4 | 3 | 2 | 2 |
| 83 | 4 | 4 5-6 | 15 | 30 | 5 | 6 | 11 | 12 | 6 | 9 | 6 | 4 | 3 | 2 |
| 84 | 4 | 4 6-6 | 16 | 36 | 6 | 6 | 12 | 18 | 12 | 9 | 6 | 4 | 3 | 2 |
| 85 | 5 | 5 1-1 | 7 | 6 | 1 | 6 | 7 | 6 | 6 | 5 | 4 | 2 | 2 | 2 |
| 86 | 5 | 5 1-2 | 8 | 8 | 2 | 2 | 4 | 8 | 8 | 1 | 1 | 2 | 1 | 1 |
| 87 | 5 | 5 1-3 | 9 | 14 | 3 | 2 | 5 | 14 | 2 | 3 | 2 | 1 | 1 | 1 |
| 88 | 5 | 5 1-4 | 10 | 10 | 2 | 4 | 6 | 10 | 10 | 4 | 3 | 2 | 2 | 1 |
| 89 | 5 | 5 1-5 | 11 | 18 | 3 | 6 | 9 | 18 | 6 | 8 | 5 | 4 | 3 | 2 |
| 90 | 5 | 5 1-6 | 12 | 28 | 5 | 4 | 9 | 10 | 4 | 7 | 5 | 4 | 3 | 2 |
| 91 | 5 | 5 2-2 | 9 | 19 | 4 | 1 | 5 | 1 | 7 | 2 | 2 | 1 | 1 | 1 |
| 92 | 5 | 5 2-3 | 10 | 15 | 3 | 3 | 6 | 15 | 3 | 4 | 3 | 3 | 2 | 1 |
| 93 | 5 | 5 2-4 | 11 | 22 | 4 | 4 | 8 | 4 | 10 | 4 | 3 | 3 | 2 | 1 |
| 94 | 5 | 5 2-5 | 12 | 33 | 6 | 3 | 9 | 15 | 9 | 8 | 5 | 4 | 3 | 2 |
| 95 | 5 | 5 2-6 | 13 | 29 | 5 | 5 | 10 | 11 | 5 | 9 | 6 | 3 | 3 | 2 |
| 96 | 5 | 5 3-3 | 11 | 17 | 3 | 5 | 8 | 17 | 5 | 7 | 5 | 3 | 3 | 2 |
| 97 | 5 | 5 3-4 | 12 | 12 | 2 | 6 | 8 | 12 | 12 | 5 | 3 | 2 | 2 | 1 |
| 98 | 5 | 5 3-5 | 13 | 34 | 6 | 4 | 10 | 16 | 10 | 8 | 6 | 4 | 3 | 2 |
| 99 | 5 | 5 3-6 | 14 | 21 | 4 | 3 | 7 | 3 | 9 | 6 | 4 | 3 | 2 | 2 |
| 100 | 5 | 5 4-4 | 13 | 33 | 6 | 3 | 9 | 15 | 9 | 8 | 5 | 4 | 3 | 2 |
| 101 | 5 | 5 4-5 | 14 | 26 | 5 | 2 | 7 | 8 | 2 | 6 | 4 | 3 | 2 | 2 |
| 102 | 5 | 5 4-6 | 15 | 30 | 5 | 6 | 11 | 12 | 6 | 9 | 6 | 4 | 3 | 2 |
| 103 | 5 | 5 5-5 | 15 | 31 | 6 | 1 | 7 | 13 | 7 | 5 | 4 | 2 | 2 | 2 |

TABLE 21-continued

| 1:126 Index | OC Die | Sic-Bo | 3-Dice Point | 1:36 Index | 2-Dice Combination | 2-Dice Point | 1:18 Index | 1:12 Index | 1:9 Index | 1:6. Index | 1:4 Index | 1:3 Index | 1:2 Index |
|---|---|---|---|---|---|---|---|---|---|---|---|---|---|
| 104 | 5 | 5 5-6 | 16 | 35 | 6 | 5 | 11 | 17 | 11 | 9 | 6 | 4 | 3 | 2 |
| 105 | 5 | 5 6-6 | 17 | 36 | 6 | 6 | 12 | 18 | 12 | 9 | 6 | 4 | 3 | 2 |
| 106 | 6 | 6 1-1 | 8 | 3 | 1 | 3 | 4 | 3 | 3 | 2 | 1 | 1 | 1 | 1 |
| 107 | 6 | 6 1-2 | 9 | 9 | 2 | 3 | 5 | 9 | 9 | 3 | 2 | 1 | 1 | 1 |
| 108 | 6 | 6 1-3 | 10 | 5 | 1 | 5 | 6 | 5 | 5 | 3 | 2 | 2 | 1 | 1 |
| 109 | 6 | 6 1-4 | 11 | 32 | 6 | 2 | 8 | 14 | 8 | 5 | 3 | 2 | 2 | 1 |
| 110 | 6 | 6 1-5 | 12 | 28 | 5 | 4 | 9 | 10 | 4 | 7 | 5 | 4 | 3 | 2 |
| 111 | 6 | 6 1-6 | 13 | 34 | 6 | 4 | 10 | 16 | 10 | 8 | 6 | 4 | 3 | 2 |
| 112 | 6 | 6 2-2 | 10 | 19 | 4 | 1 | 5 | 1 | 7 | 2 | 2 | 1 | 1 | 1 |
| 113 | 6 | 6 2-3 | 11 | 27 | 5 | 3 | 8 | 9 | 3 | 7 | 5 | 3 | 3 | 2 |
| 114 | 6 | 6 2-4 | 12 | 23 | 4 | 5 | 9 | 5 | 11 | 7 | 5 | 4 | 3 | 2 |
| 115 | 6 | 6 2-5 | 13 | 29 | 5 | 5 | 10 | 11 | 5 | 9 | 6 | 3 | 3 | 2 |
| 116 | 6 | 6 2-6 | 14 | 31 | 6 | 1 | 7 | 13 | 7 | 5 | 4 | 2 | 2 | 2 |
| 117 | 6 | 6 3-3 | 12 | 18 | 3 | 6 | 9 | 18 | 6 | 8 | 5 | 4 | 3 | 2 |
| 118 | 6 | 6 3-4 | 13 | 24 | 4 | 6 | 10 | 6 | 12 | 8 | 6 | 4 | 3 | 2 |
| 119 | 6 | 6 3-5 | 14 | 21 | 4 | 3 | 7 | 3 | 9 | 6 | 4 | 3 | 2 | 2 |
| 120 | 6 | 6 3-6 | 15 | 35 | 6 | 5 | 11 | 17 | 11 | 9 | 6 | 4 | 3 | 2 |
| 121 | 6 | 6 4-4 | 14 | 26 | 5 | 2 | 7 | 8 | 2 | 6 | 4 | 3 | 2 | 2 |
| 122 | 6 | 6 4-5 | 15 | 30 | 5 | 6 | 11 | 12 | 6 | 9 | 6 | 4 | 3 | 2 |
| 123 | 6 | 6 4-6 | 16 | 36 | 6 | 6 | 12 | 18 | 12 | 9 | 6 | 4 | 3 | 2 |
| 124 | 6 | 6 5-5 | 16 | 35 | 6 | 5 | 11 | 17 | 11 | 9 | 6 | 4 | 3 | 2 |
| 125 | 6 | 6 5-6 | 17 | 36 | 6 | 6 | 12 | 18 | 12 | 9 | 6 | 4 | 3 | 2 |
| 126 | 6 | 6 6-6 | 18 | 31 | 6 | 1 | 7 | 13 | 7 | 5 | 4 | 2 | 2 | 2 |

To avoid confusion, it may be helpful to restate some of the mapping relations described above and represented among the drawing figures. Each range is simply a finite set of real numbers. For example, the "1 die roll" described as "1:6" can be expressed mathematically as {1,2,3,4,5,6}. This example range can be characterized as being linear in nature, such that each member consists of a distinct consecutive real number. Linear ranges described herein include: 1:2, 1:3, 1:4, 1:6, 1:9, 1:12, 1:18, 1:36, 1:38, and 1:216. On the other hand, non-line arranges are also described herein, including: 1:21 (2 indistinguishable dice), 1:56 (3 indistinguishable dice) and 1:126 (Sic-Bo dice). Members of these non-linear sets include elements that represent roll combinations. For example, some members of the 1:21 range (as shown in Table 8) represent multiple occurrences of the non-double numbers in the 1:36 range, like 1-2 and 2-1. The syntax used to describe all ranges herein is "1:n", regardless of whether it represents a linear or non-linear set of numbers.

In preferred embodiments of the invention, computer software enables the maps. Moreover, casino gaming devices may employ the software to implement this invention. Foreseeably, the gaming devices could allow players to wager on various randomized events mapped from one initial random event. When computerized devices employ the invention, the input method may be through a touch screen. A casino worker inputs the initial event into a computerized device via the touch screen 62, as suggested in FIGS. 9-21. Other input mechanisms may include a vision recognition system, a manual chart lookup system, an audio recognition system, a keyboard, or any combination thereof. The output events may be broadcast to end users through visual displays, audio broadcasting, via computer networks 58, or any combination thereof. Specifically, the output is ideally suited to be broadcast to multiple games being concurrent played, via computer network protocols. Another intention of this invention is to coordinate the gaming wagering phases of the various games it will be supplying randomization input for. This also occurs via computer network protocols.

Figure 12:
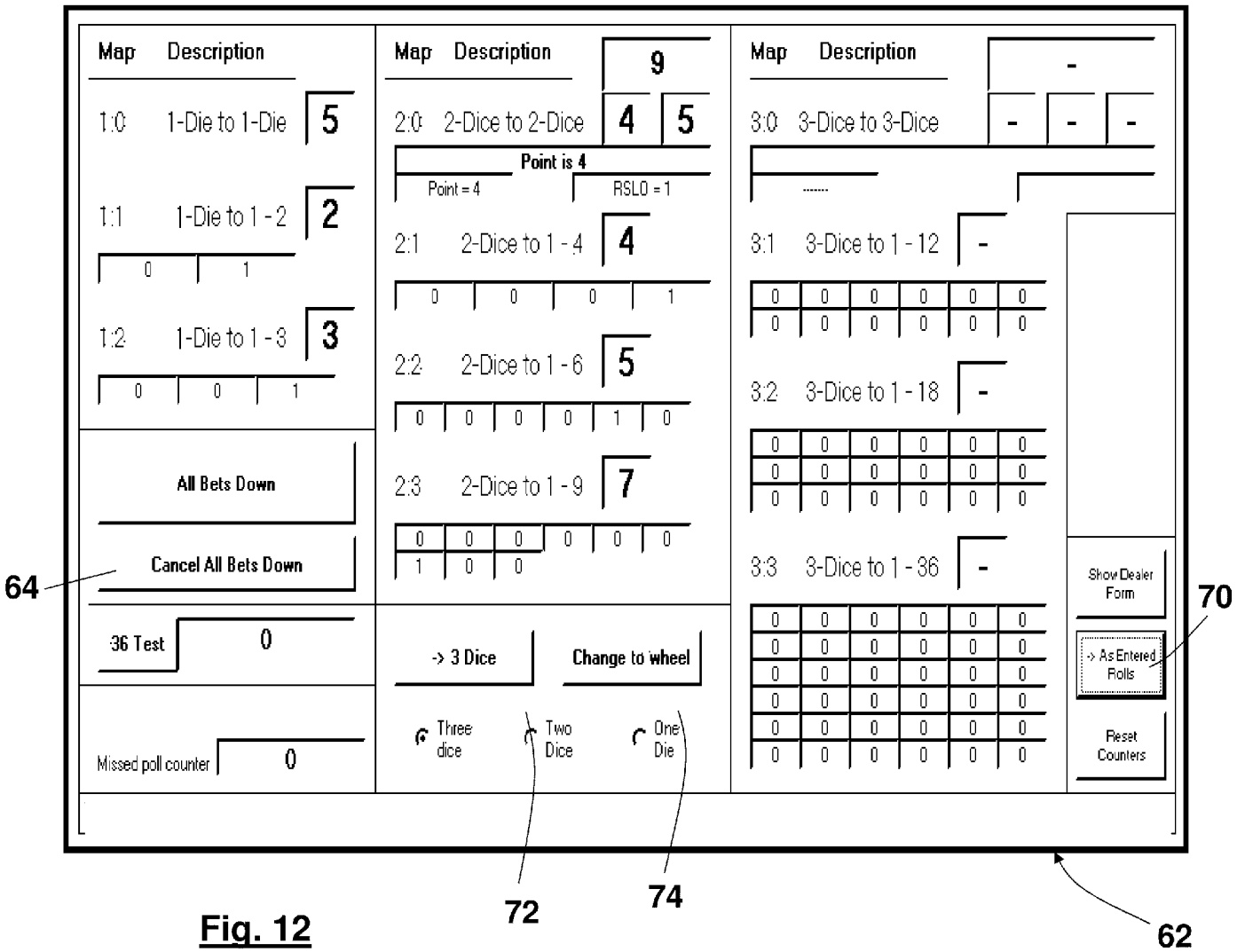
Figures 13, 14, 15:
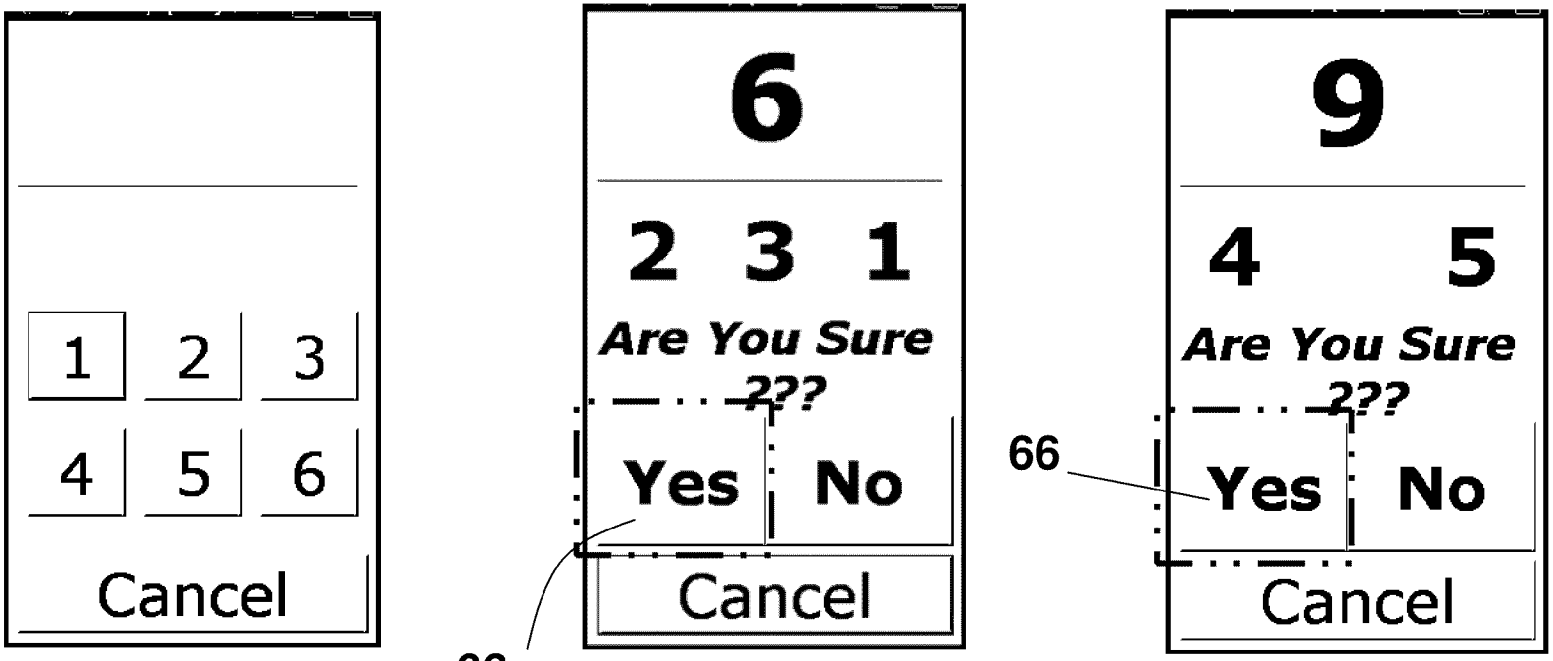
FIGS. 13-15A depict number entry screens on a GUI through which the results of a randomization event can be input and subsequently mapped to multiple data maps according to this invention.

An example of a graphic user interface 62 is now described. FIGS. 9-12 illustrate the visual displays outputted by the example apparatus. FIGS. 13-15 illustrate the visual displays that a dealer might use to input randomized event data. Initially, the output screen 62 appears in a mode in which it accepts 3-dice rolls as randomized event input, illustrated in FIG. 9. When the dealer presses the "All Bets Down" button 64, the apparatus brings up an input screen, shown in FIG. 13. At this point, the dealer may enter a three dice roll into the input screen, and then confirm the input. In FIG. 14, the dealer has entered the roll of "2-1-3" into the input screen. Furthermore, the screen in FIG. 14, requests the dealer to confirm the three-number input. The dealer confirms the entry by pressing the "Yes" button 66.

Next, the input screen disappears, and the output screen displays the results of mapping the three-number combination to the other number sets, as explained previously. Note that the entry of "2-1-3" displays in the "Zero Map" of the output screen as "1-2-3" in the window 68. The display of 1, 2, and 3 illustrates the normalization process that occurs prior to displaying the one of fifty-six distinct combinations of a three dice roll.

Normalization is implemented to provide a consistent display for ambiguous roll combinations. Normalized rolls always display lower numbers from left to right, for example if a 2-dice roll of "2-1" is entered, the normalized display will show "1-2". Similarly, for a 3-dice roll, if a "5-6-4" is entered, the normalized display will show "4-5-6".

The dealer may press the "As Entered Rolls" button 70, which overrides the normalization process, thus displaying entries exactly as they are entered. The normalization process only affects the display of the results and does not alter the mapping processes in its preferred implementation.

Figure 15A:
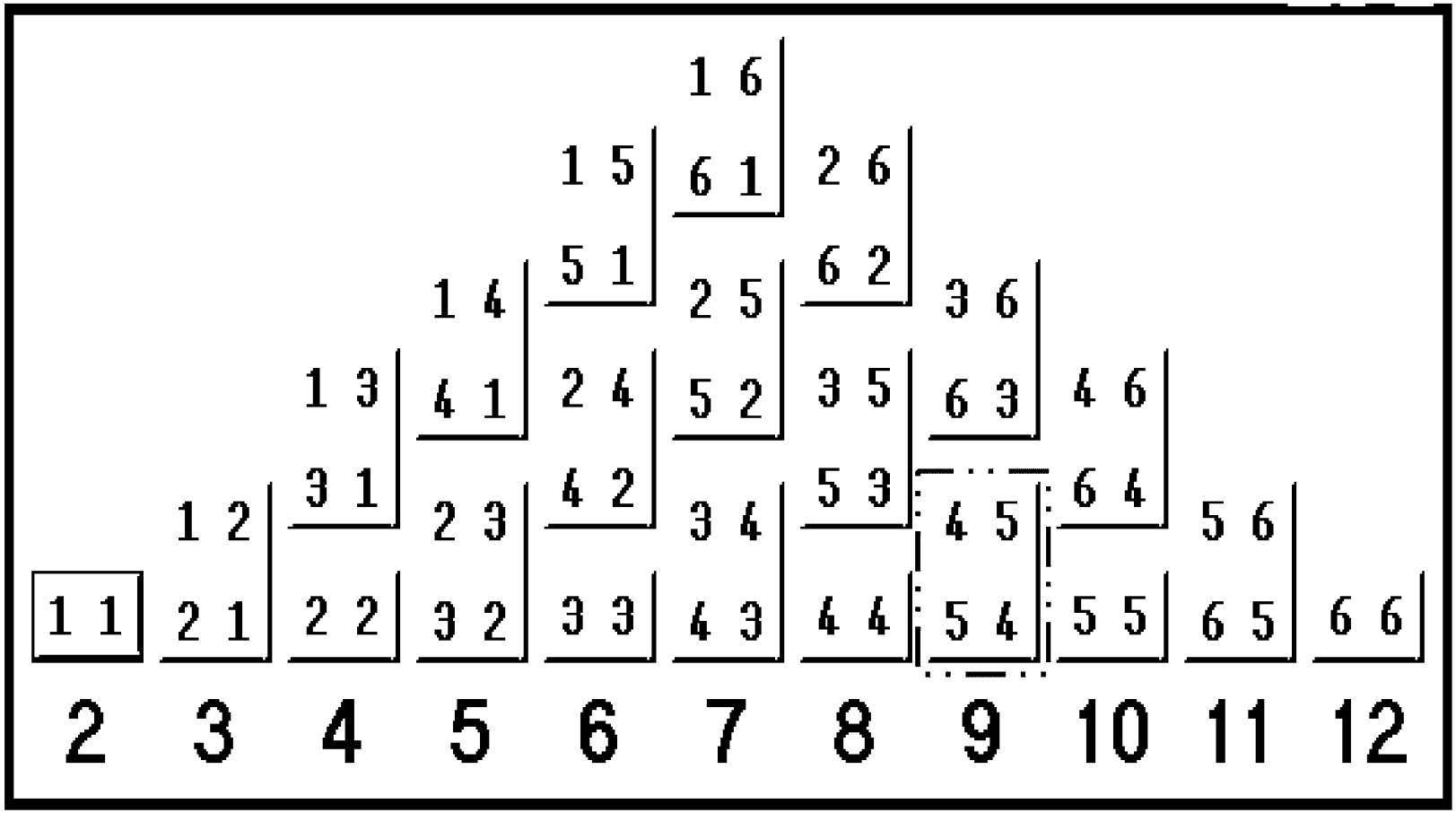
Figure 16:
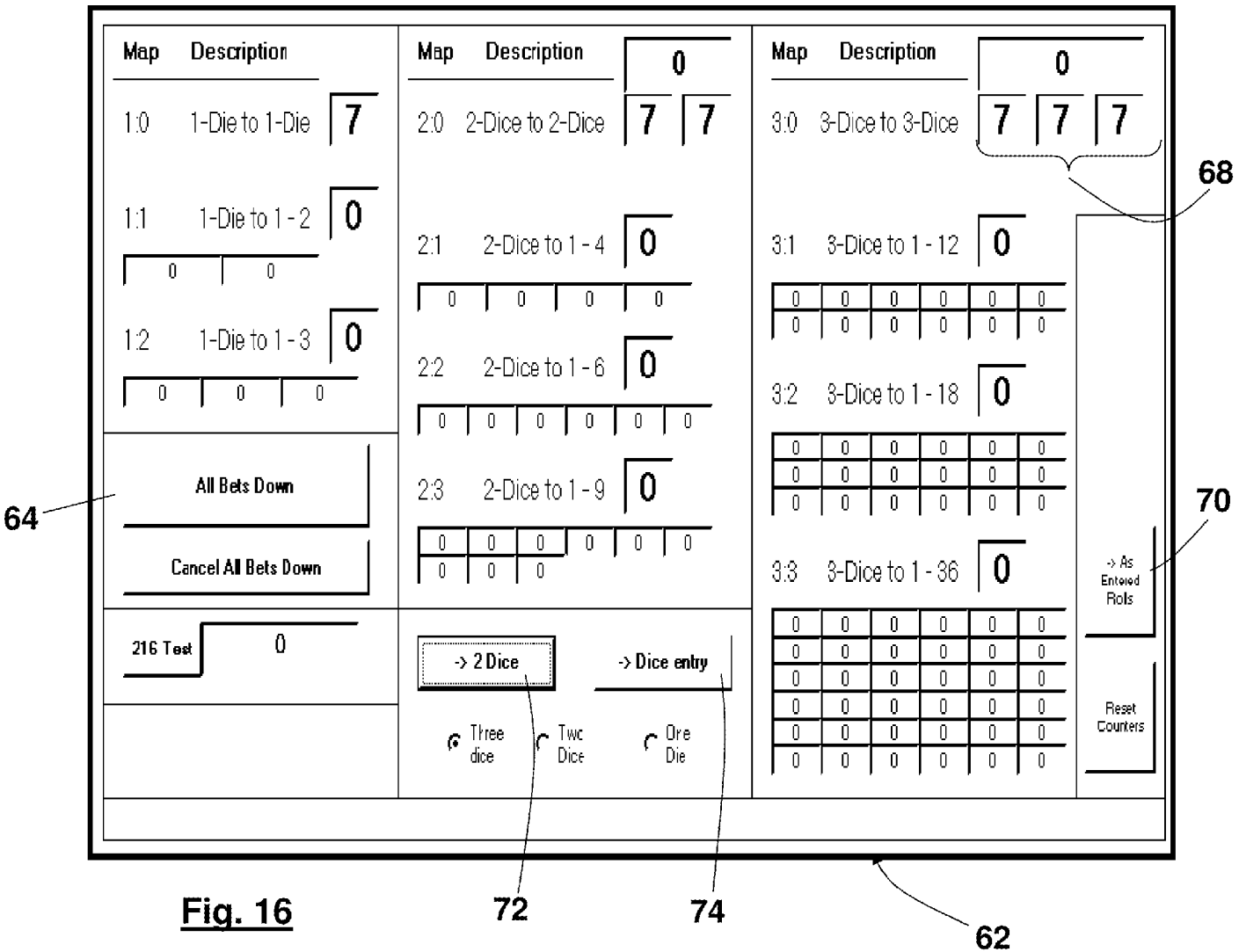
FIGS. 16-17 depict still further examples of a GUI displaying the results of numbers mapped from a randomizer machine to multiple data maps according to this invention.

The dealer may also press a "Change the Number of Dice" button 72 to alter the mode so that it accepts a 2-dice entry, rather than the previous 3-dice entry mode. The output screen changes to screenshot shown in FIG. 11, only displaying one and two dice roll results. FIG. 15A illustrates the input screen for a two dice roll input of "5-4". FIG. 15 shows the confirmation screen which appears automatically in response to clicking the icons representing a "5-4" dice roll. The operator presses "Yes" to continue. FIG. 12 illustrates the output screen showing the "4-5" zero-map, as well as all of the other mappings produced by the apparatus resulting from this two dice roll.

Figure 17:
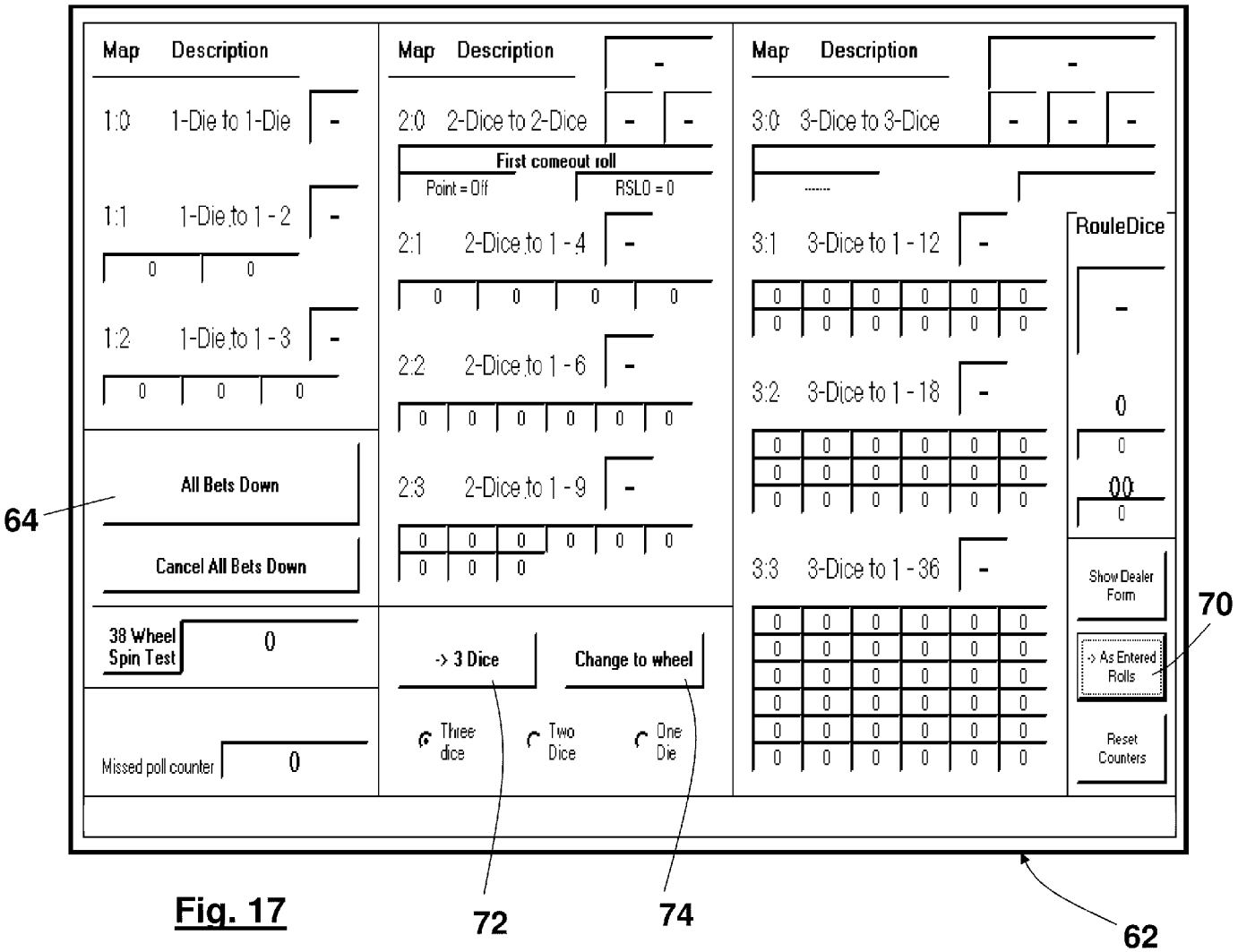
Figure 18:
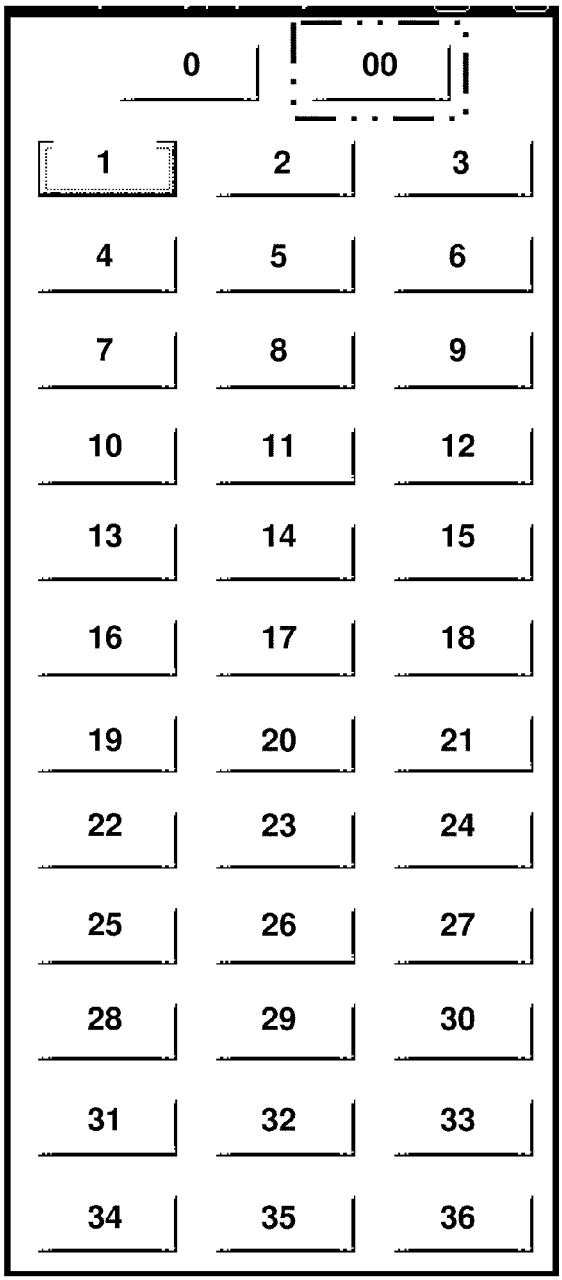
FIG. 18 shows the data entry GUI for a 38 number randomizer, such as may be found in a traditional 38 slot roulette wheel.
Figure 19:
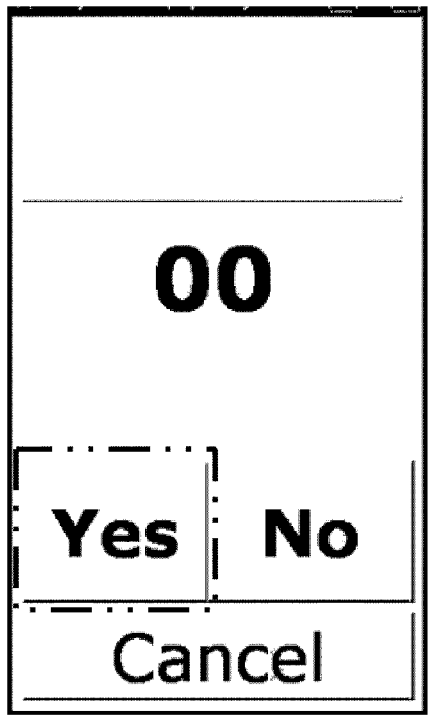
FIG. 19 shows the confirmation screen associated with a "00" selection from the data entry screen of FIG. 18.
Figure 20:
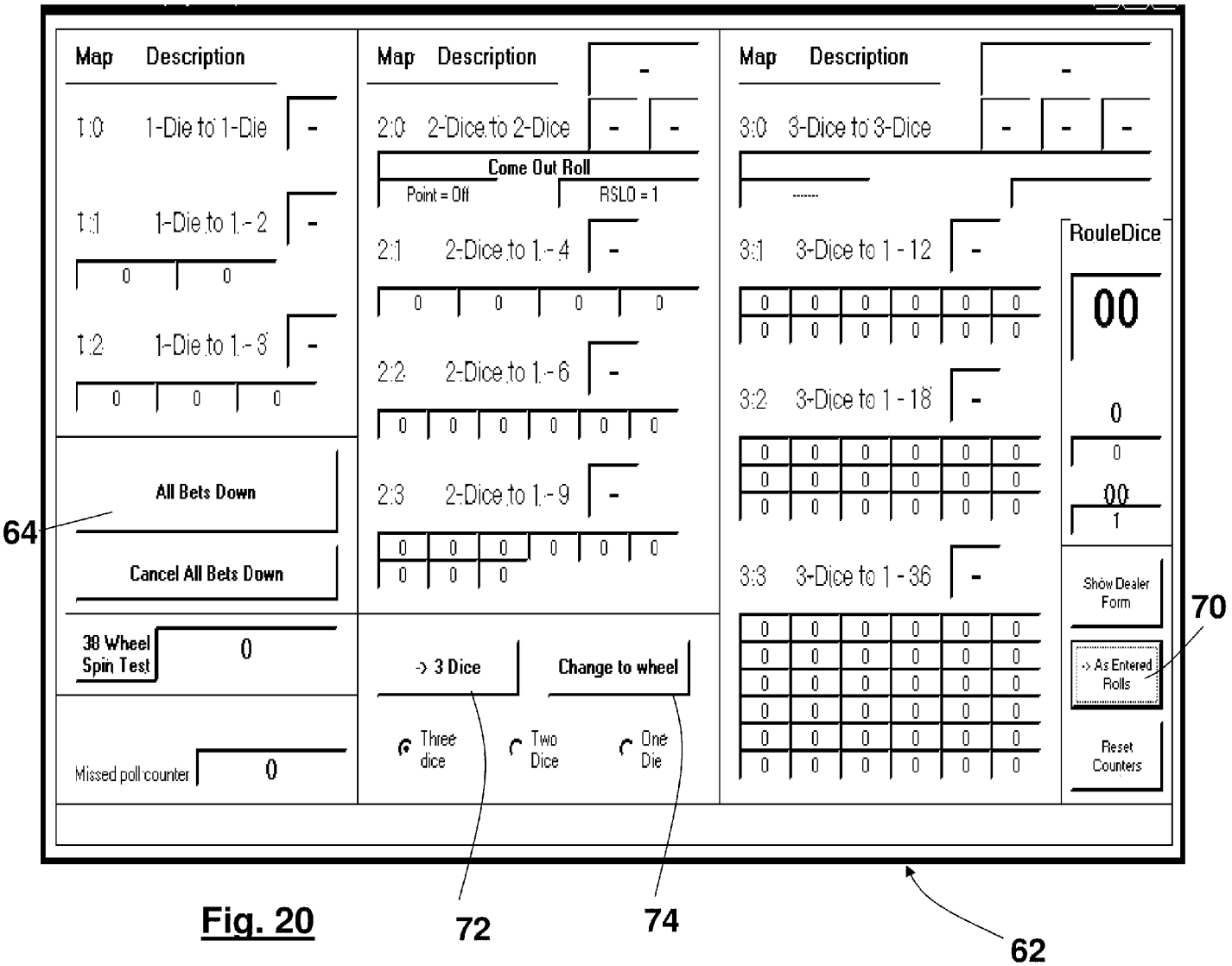
FIG. 20 is another view of the GUI of FIG. 18 following entry of the "00" selection as in FIG. 19.
Figure 21:
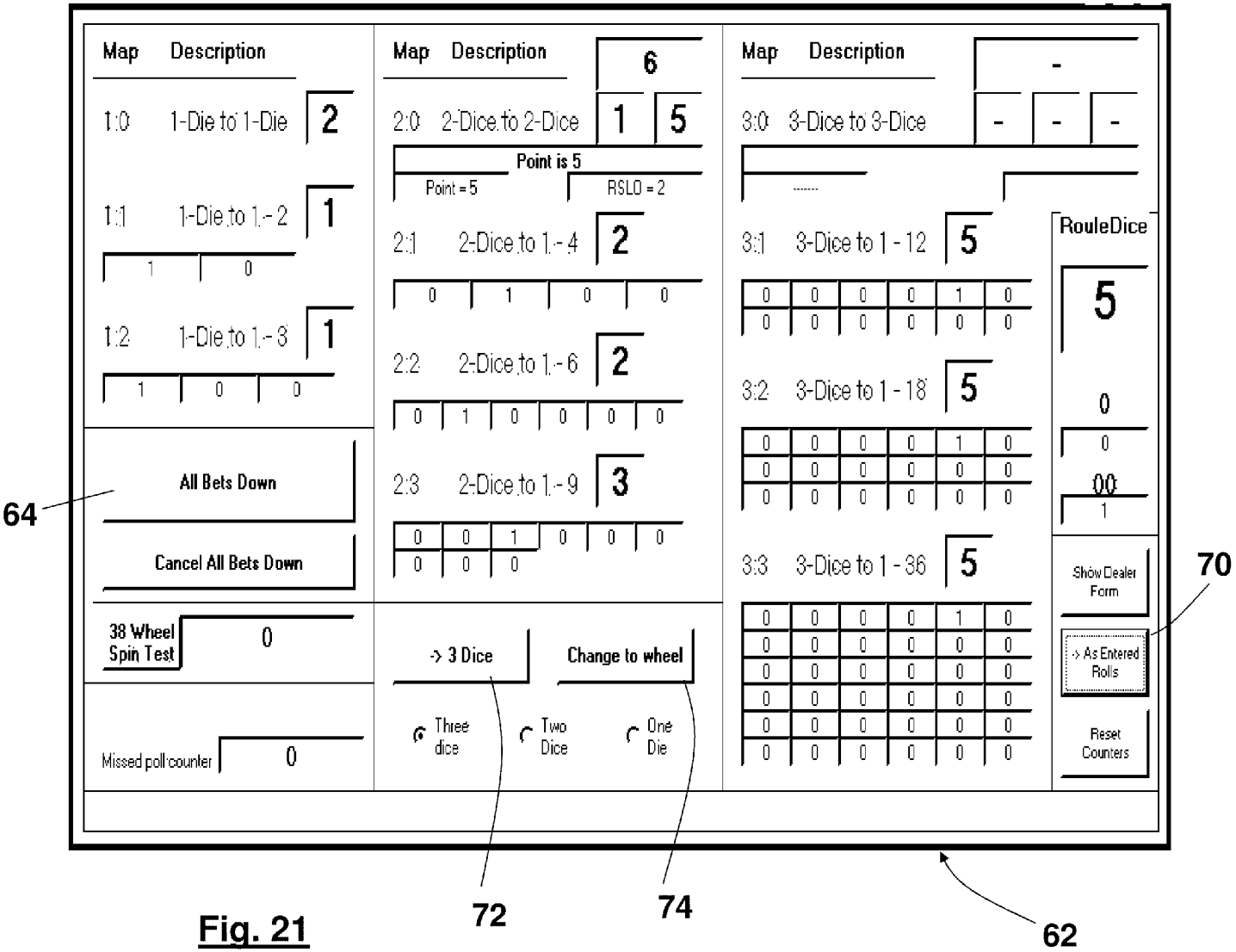
FIG. 21 is a view as in FIG. 20 but showing the results following entry of a "5."

While in 2-dice entry mode, the dealer may also press the "Change to Wheel" button 74 to alter the mode of the apparatus to accept a number from 1 to 38, rather than a 2-dice entry. This may be referred to as "38-Wheel Spin" mode, shown in FIG. 17. The 1:38 spin can be used directly for 1:38 range games such as (U.S. style) Roulette 38' as illustrated in FIG. 5A. The apparatus also maps the number entered into a 1:36 range by considering the 0 and 00 spins to be "null values." The 1:36 range number is then mapped to a 2-Dice roll, using the data shown in Table 7, and treats it as an input of such. FIG. 18 shows the operator entry screen when the "All Bets Down" icon 64 is pressed (FIG. 17). The operator enters a "00" by clicking the associated icon. FIG. 19 shows the confirmation screen that appears automatically, in response to which the operator presses "Yes" icon. FIG. 20 shows the resulting output screen on the GUI 62. The "00" spin demonstrates a null value mapping, and does not map to anything except for the "00" counter. FIG. 21 shows the output screen after a subsequent "5" spin is entered in the manner described above, demonstrating a non-null mapping to the 1:36 range, and the rest of the mappings taking place.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A method for concurrently resolving a plurality of different games of chance having different decision ranges using a single randomization event, said method comprising the steps of:

providing a first game of chance having an outcome determined by the selection of a number within a first number range;

providing a second game of chance different than the first game of chance, the second game of chance having an outcome determined by the selection of a number within a second number range;

providing an input data set defined as numbers derived from all possible outcomes of a given randomizer machine, the input data set being dissimilar to at least one of the first and second number ranges;

providing a randomizer machine configured to randomly select a number from the input data set;

creating a first data map associating each number in the first number range with a number in the input data set;

creating a second data map associating each number in the second number range with a number in the input data set;

placing a wager on the first game of chance;

placing a wager on the second game of chance;

obtaining a number from the randomizer machine;

mapping the number from the randomizer machine to a number in the first number range using the first data map;

mapping the number from the randomizer machine to a number in the second number range using the second data map; and concurrently resolving the first and second games of chance based on the input data from the randomizer machine, whereby a plurality of disparate games of chance can be predictably decided on the basis of a common randomization event.

2. The method of claim 1 wherein said step of obtaining a number from the randomizer machine includes forcibly displacing at least one selection element and allowing the selection element to naturally come to rest under the influence of environmental resistance.

3. The method of claim 2 wherein said step of forcibly displacing at least one selection element includes rolling at least one six-sided die.

4. The method of claim 2 wherein said step of forcibly displacing at least one selection element includes spinning a wheel.

5. The method of claim 1 wherein said step of providing an input data set includes defining a greater quantity of input data numbers than the quantity of numbers in the second number range.

6. The method of claim 1 wherein said step of providing an input data set includes establishing each number as unique from every other number in the input data range.

7. The method of claim 6 wherein said step of creating a second data map includes associating at least two numbers from the input data range with the same number in the second number range.

8. The method of claim 6 wherein said step of establishing each number as unique includes designating the input data numbers 1-56.

9. The method of claim 8 wherein said step of obtaining a number from the randomizer machine includes rolling three indistinguishable six-sided dice.

10. The method of claim 6 wherein said step of establishing each number as unique includes designating the input data numbers 1-216, and wherein said step of obtaining a number from the randomizer machine includes rolling three separately distinguishable six-sided dice.

11. The method of claim 6 wherein said step of establishing each number as unique includes designating the input data numbers 1-216, wherein said step of obtaining a number from the randomizer machine includes spinning a wheel having 216 distinct positions.

12. The method of claim 1 wherein said step of creating a second data map includes associating 2, 3, 4, 6, 9, 12, 18, 21 or 36 distinct numbers in the second number range with 56 distinct numbers in the input data set.

13. The method of claim 1 wherein said step of a second data map includes associating 2, 3, 4, 6, 9, 12, 18 or 21 distinct numbers in the second number range with 36 distinct numbers in the input data set.

14. The method of claim 1 wherein said step of creating a second data map includes associating 2, 3, 4, 6, 9, 12 or 18 distinct numbers in the second number range with 21 distinct numbers in the input data set.

15. The method of claim 1 wherein said step of creating a second data map includes associating 2, 3 or 4 distinct numbers in the second number range with 6 distinct numbers in the input data set.

16. A method for concurrently resolving a plurality of different games of chance having different decision ranges using a single randomization event, said method comprising the steps of:

providing a first game of chance having an outcome determined by the selection of a number within a first number range;

providing a second game of chance different than the first game of chance, the second game of chance having an outcome determined by the selection of a number within a second number range;

providing an input data set defined as numbers derived from all possible outcomes of a randomizer machine, said step of providing an input data set including defining a greater quantity of input data numbers than the quantity of numbers in the second number range and establishing each number in the input data set as unique from every other number in the input data set;

providing a randomizer machine configured to randomly select a number from the input data set, the randomizer machine selected from the group consisting of: at least one six-sided die, a spinning wheel, a two-sided coin, and a deck of playing cards;

creating a first data map associating each number in the first number range with a number in the input data set;

creating a second data map associating each number in the second number range with a number in the input data set;

placing a wager on the first game of chance;

placing a wager on the second game of chance;

obtaining a number from the randomizer machine by forcibly displacing at least one selection element and allowing the selection element to naturally come to rest under the influence of environmental resistance;

mapping the number from the randomizer machine to a number in the first number range using the first data map;

mapping the number from the randomizer machine to a number in the second number range using the second data map; and concurrently resolving the first and second games of chance based on the input data from the randomizer machine, whereby a plurality of disparate games of chance can be predictably decided on the basis of a common randomization event.

17. A gaming system for concurrently playing and resolving a plurality of disparate games of chance using a single randomization event, said gaming system comprising:

a first game of chance having an outcome determined by the selection of a number within a first number range;

a second game of chance different than said first game of chance and spaced remotely therefrom, said second game of chance having an outcome determined by the selection of a number within a second number range;

a randomizer machine configured to randomly select one number from an input data set, wherein said input data set is defined as numbers derived from all possible outcomes of said randomizer machine;

a first data map associating each number in said first number range with a number in said input data set;

a second data map associating each number in said second number range with a number in said input data set; and a computer processor configured to map the number from said randomizer machine to a number in said first number set using said first data map and to a number in said second number range using said second data map;

whereby said first and second games of chance can be concurrently resolved based on said input data from said randomizer machine.

18. The gaming system of claim 17 wherein said randomizer machine is selected from the group consisting of: at least one six-sided die, a spinning wheel, a two-sided coin, and a deck of playing cards.

19. The gaming system of claim 17 wherein said randomizer machine comprises at least two indistinguishable six-sided dice.

20. The gaming system of claim 17 wherein said randomizer machine comprises at least two separately distinguishable six-sided dice.

* * * * *